US007085509B2

(12) United States Patent
Kubota et al.

(10) Patent No.: US 7,085,509 B2
(45) Date of Patent: Aug. 1, 2006

(54) PROCESS CARTRIDGE AND ELECTROPHOTOGRAPHIC IMAGE FORMING APPARATUS

(75) Inventors: Takeshi Kubota, Mishima (JP); Hideshi Kawaguchi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/007,488

(22) Filed: Dec. 9, 2004

(65) Prior Publication Data

US 2005/0135832 A1 Jun. 23, 2005

(30) Foreign Application Priority Data

Dec. 9, 2003 (JP) ..... 2003-411073
Dec. 6, 2004 (JP) ..... 2004-352402

(51) Int. Cl.
*G03G 15/00* (2006.01)
*G03G 21/18* (2006.01)

(52) U.S. Cl. ..... 399/90; 399/111

(58) Field of Classification Search ..... 399/88–90, 399/111

See application file for complete search history.

(56) References Cited

U.S. PATENT DOCUMENTS

| | | | | |
|---|---|---|---|---|
| 5,311,253 | A | 5/1994 | Ohmori et al. | 399/111 |
| 5,559,581 | A | 9/1996 | Sugiura et al. | 355/200 |
| 5,561,496 | A | 10/1996 | Sugiura et al. | 355/200 |
| 5,634,178 | A | 5/1997 | Sugiura et al. | 399/110 |
| 5,642,187 | A | 6/1997 | Nomura et al. | 399/111 |
| 5,650,841 | A | 7/1997 | Matsuda et al. | 399/111 |
| 5,678,139 | A | 10/1997 | Nomura et al. | 399/114 |
| 5,697,022 | A | 12/1997 | Matsuda et al. | 399/102 |
| 5,825,472 | A | 10/1998 | Araki et al. | 355/200 |
| 5,867,751 | A | 2/1999 | Nomura et al. | 399/90 |
| 5,907,751 | A | 5/1999 | Kawaguchi et al. | 399/117 |
| 5,953,562 | A | 9/1999 | Kawaguchi et al. | 399/117 |
| 6,047,153 | A | 4/2000 | Kawaguchi | 399/263 |
| 6,084,622 | A | 7/2000 | Sugiura et al. | 347/170 |
| 6,236,822 | B1 | 5/2001 | Kawaguchi | 399/114 |

(Continued)

FOREIGN PATENT DOCUMENTS

JP 62-215278 9/1987

(Continued)

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A process cartridge is detachably mountable to a main assembly of an electrophotographic image forming apparatus. The main assembly includes an output contact movable between electrical connecting and retracting positions, a displaceable member for moving the output contact, and an elastic member for elastically urging the displaceable member to urge the output contact toward the retracted position. The process cartridge includes a drum, a process device actable on the drum, an operating member, a movable operation member operable by the operating member, after mounting the cartridge to the main assembly, to move the displaceable member, in interrelation with which the output contact is moved from the retracted to the electrical connection position against an elastic force of the elastic member, and an input electrical contact for receiving a voltage enabling the process device by engagement with the output contact moved to the electrical connecting position.

23 Claims, 51 Drawing Sheets

U.S. PATENT DOCUMENTS

| | | | | |
|---|---|---|---|---|
| 6,272,300 | B1 | 8/2001 | Fujiwara et al. | 399/113 |
| 6,311,026 | B1 | 10/2001 | Higeta et al. | 399/13 |
| 6,661,977 | B1 | 12/2003 | Kubota | 399/12 |
| 2004/0105699 | A1 | 6/2004 | Kubota | 399/111 |
| 2005/0135831 | A1 | 6/2005 | Kawaguchi et al. | 399/90 |
| 2005/0135832 | A1 | 6/2005 | Kubota et al. | 399/90 |
| 2005/0191079 | A1 | 9/2005 | Yokoi et al. | 399/90 |
| 2005/0191080 | A1 | 9/2005 | Oguma et al. | 399/90 |

FOREIGN PATENT DOCUMENTS

| | | |
|---|---|---|
| JP | 7-77921 | 3/1995 |
| JP | 9-68833 | 3/1997 |
| JP | 10-74030 | 3/1998 |

(a)

(b)

(a)

(b)

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus usable with the process cartridge.

Here, the electrophotographic image forming apparatus is A apparatus for forming the image on a recording material (recording sheet, OHP sheet or the like) through an electrophotographic image forming process.

It includes A electrophotographic copying machine, electrophotographic printer or the like.

The process cartridge is a cartridge containing as a unit an electrophotographic photosensitive member and process means including at least one of charging member and developing member, which cartridge is detachably mountable to a main assembly of the electrophotographic image forming apparatus.

With the electrophotographic image forming apparatus of the process cartridge type, the process cartridge can be mounted to or demounted from the main assembly of the image forming apparatus by the user without an expert serviceman. Therefore, the operationality of the image forming apparatus is remarkably improved.

In such an electrophotographic image forming apparatus, it is necessary to supply electric voltages to a charging member for electrically charging the electrophotographic photosensitive member (photosensitive drum), a developing member for developing an electrostatic latent image formed on the photosensitive drum, and the like, which are contained in the process cartridge.

Heretofore, a provision of the cartridge is provided with an input electrical contact for electrical connection between the cartridge and the main assembly of the apparatus when the cartridge is mounted in place in the main assembly of the image forming apparatus. On the other hand, the main assembly of the apparatus is provided with an output contact. With this structure, when the cartridge is mounted to the main assembly of the apparatus, the input electrical contact is connected with the output contact. By doing so, the voltage can be supplied from the main assembly of the apparatus to the cartridge.

More particularly, the following structure is known.

A movable protection plate covering the contact member (the output contact) is provided in the main assembly of the apparatus. When the printer (image forming apparatus) is subjected to a maintenance operation, the operator and/or a tool is prevented from touching the contact member. By inserting motion of the cartridge into the main assembly of the apparatus, the protection plate is retracted to a retracted position. By doing so, the electrical connection is permitted between the contact member in the main assembly of the apparatus Ad the contact member on the cartridge (input electrical contact) (paragraphs ([0012]–[0015], FIG. 1–FIG. 3 of Japanese Laid-open Patent Application Hei 7-77921).

When the unit is dismounted from the main assembly of the apparatus, a connector pin (output contact) is hidden inside a partition wall. By doing so, the serviceman or user is prevented from touching the connector pin. By the insertion of the unit into the main assembly of the apparatus, the connector pin enters the unit insertion space. Thus, the connector pin and connector portion of the unit (input electrical contact) are electrically connected (Japanese Laid-open Patent Application Sho 62-215278).

In addition, the drum shutter is provided with a regulating portion. The regulating portion is effective to covering the electrical contact (input electrical contact). By doing so, the contact defect which may be caused by deposition of foreign matter on the electrical contact, can be prevented. By the entering of the cartridge into the main assembly of the apparatus, the electrical contact of the cartridge and the electrical contact of the main assembly of the apparatus (output contact) are electrically connected. (Japanese Laid-open Patent Application Hei 10-74030).

A contact member (output contact) is provided and is movable between a retracted position and a regular position. By doing so, the contact portion of the cartridge (input electrical contact) and the contact member of the main assembly of the apparatus are contacted with each other in order. Before the cartridge is inserted into the main assembly of the apparatus, the contact member (output contact) is in the retracted position. When the cartridge is mounted to the main assembly of the apparatus, the contact member is moved to the regular position. By this, the contact portion and the contact portion are electrically connected with each other. (Japanese Laid-open Patent Application Hei 9-68833).

The present invention provides a further improvements in such structures.

SUMMARY OF THE INVENTION

Accordingly, it is a principal object of the present invention to provide a process cartridge and an electrophotographic image forming apparatus wherein the reliability of electrical connection between an input electrical contact of a process cartridge and an output contact provided in a main assembly of an image forming apparatus when the process cartridge is mounted in the main assembly of the electrophotographic image forming apparatus.

It is Aother object of the present invention to provide a process cartridge and an electrophotographic image forming apparatus wherein damage of an electric circuit provided in the main assembly of the electrophotographic image forming apparatus can be prevented.

It is a further object of the present invention to provide a process cartridge and an electrophotographic image forming apparatus wherein the reliability of the electrical connection of establishment of electrical contacts is improved, by connecting the input electrical contact and the output contact after the process cartridge is set in the main assembly of the electrophotographic image forming apparatus.

These and other objects, features Ad advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to the embodiments of the process cartridge and the electrophotographic image forming apparatus according to the present invention.

EMBODIMENT 1

Figure 1:
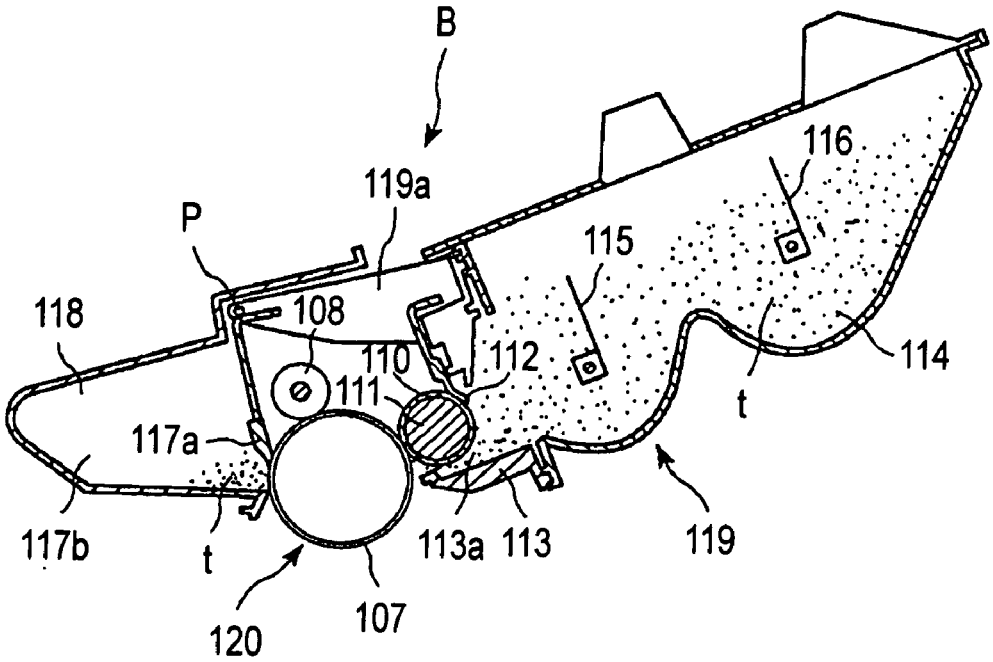
FIG. 1 is a sectional view of the process cartridge according to an embodiment of the present invention.

(1) General Structure of Process Cartridge:

Referring to FIG. 1, a process cartridge B (cartridge) according to a first embodiment of the present invention will be described. FIG. 1 is a sectional view of the cartridge B.

Figure 2:
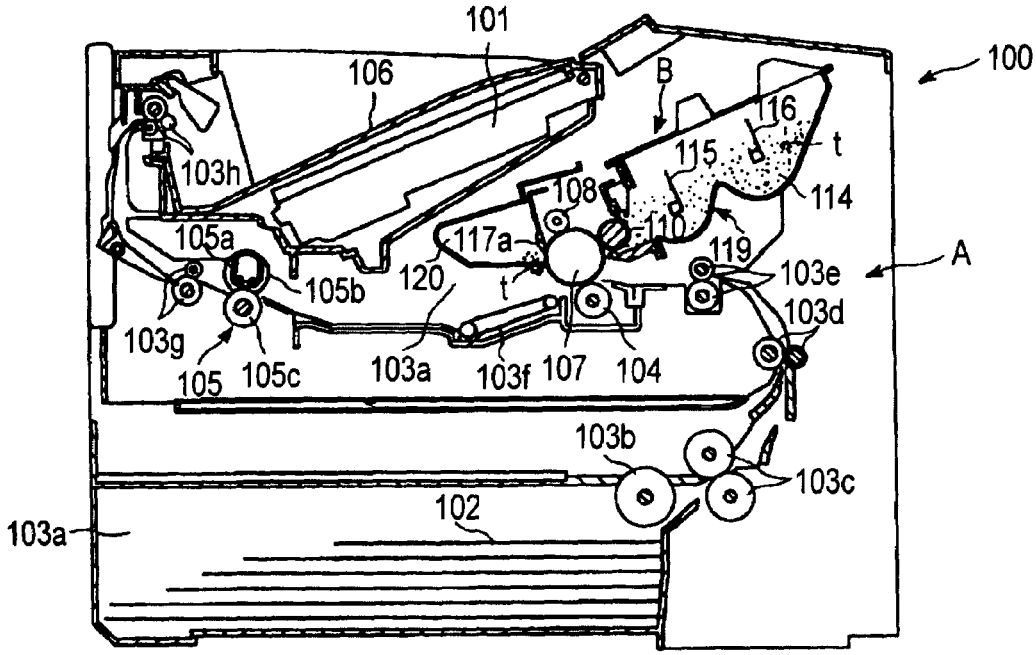
FIG. 2 illustrates a structure of an image forming apparatus according to an embodiment of the present invention.

In FIG. 1, the cartridge B comprises A electrophotographic photosensitive drum (photosensitive drum) 107. As shown in FIG. 2, when the cartridge B is mounted to the main assembly A of the electrophotographic image forming apparatus (main assembly of the apparatus), the photosensitive drum 107 is rotatable by receiving a driving force from the main assembly A.

Disposed opposed to an outer surface of the photosensitive drum 107 is a charging roller 108 functioning as a charging member. The charging roller 108 is supplied with a voltage from the main assembly A of the apparatus Ad electrically charges the photosensitive drum 107. The charging roller 108 is contacted to the photosensitive drum 107 and is rotated by the photosensitive drum 107.

When the cartridge B is mounted to the main assembly A of the apparatus, the charging roller 108 is supplied with a voltage from the main assembly 100 of the apparatus through a charging output contact 144*a* (FIG. 4) functioning as A output contact and a charging input electrical contact 141*a* (FIG. 10) functioning as A input electrical contact. The charging roller 108 functions by the voltage to electrically charge the photosensitive drum 107.

The cartridge B includes a developing roller 110 functioning as a developing member. The developing roller 110 supplies the developer t into a developing zone adjacent a photosensitive drum 107. The developing roller 110 develops A electrostatic latent image formed on the photosensitive drum 107 with the developer t. The developing roller 110 contains a magnet roller (stationary magnet) 111.

When the cartridge B is mounted to the main assembly A of the apparatus, the developing roller 110 is supplied with a voltage from the main assembly 100 of the apparatus through a development output contact (unshown) functioning as A output contact and a development input electrical contact (unshown) functioning as A input electrical contact. The developing roller 110 functions by the thus applied voltage to develop the electrostatic latent image.

To the peripheral surface of the developing roller 110, a developing blade 112 is contacted. The developing blade 112 functions to regulate an amount of the developer t deposited on the peripheral surface of the developing roller 110. The developing blade 112 also functions to triboelectrically charge the developer t.

The developer t accommodated in the developer accommodating container 114 is supplied out into the developer chamber 113*a* by rotation of the stirring members 115, 116. The developing roller 110 supplied with the voltage through the electrical contact 160*a* is rotated. By doing so, a layer of the developer having the triboelectric charge applied by the developing blade 112 is formed on the surface of the developing roller 110. The developer t is transferred onto the photosensitive drum 107 in accordance with the pattern of the latent image. Thus, the latent image developed.

The developed image on the photosensitive drum 107 is transferred onto a recording material 102 by a transfer roller 104.

Disposed opposed to the outer surface of the photosensitive drum 107 is A elastic cleaning blade 117*a*. The cleaning blade 117*a* has A edge which is contacted to the photosensitive drum 107. The blade 117*a* functions to remove the developer t remaining on the photosensitive drum 107 after transfer of the developed image onto the recording material 102. The developer t removed from the surface of the photosensitive drum 107 by the blade 117*a* is accommodated in a removed developer container 117*b*.

The cartridge B is constituted by the developing unit 119 and the drum unit 120.

The developing unit 119 has a developing device frame 113 as a part of the cartridge frame. The developing unit 119 contains the developing roller 110, the developing blade 112, the developer chamber 113*a*, the developer accommodating container 114 and stirring members 115, 116. A development input electrical contact (unshown) is provided exposed from the developing device frame 113.

The drum unit 120 has a drum frame 118 as a part of the cartridge frame. The drum unit 120 contains the photosensitive drum 107, the cleaning blade 117*a*, the removed developer container 117*b* and the charging roller 108. A charging input electrical electrical contact 141*a* is provided exposed on the drum frame 118.

One end of the photosensitive drum 107 is supported by the drum frame 118. An outer end of the drum shaft 139 functions as a cartridge guide 140L1 which will be described hereinafter referring to FIG. 7.

Figure 6:
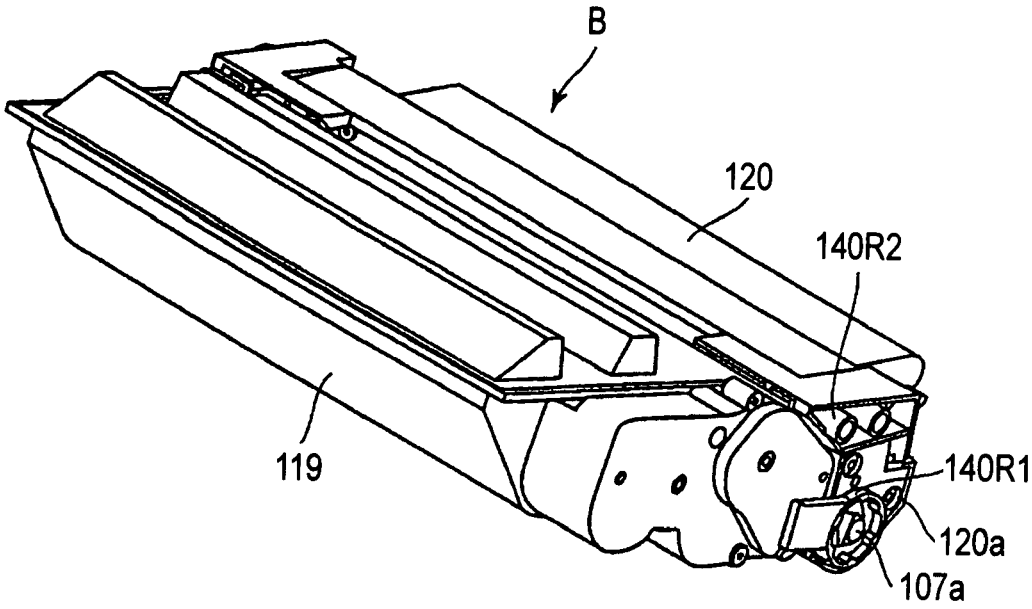
FIG. 6 is a perspective view of a process cartridge according to the embodiment of the present invention.
Figure 7:
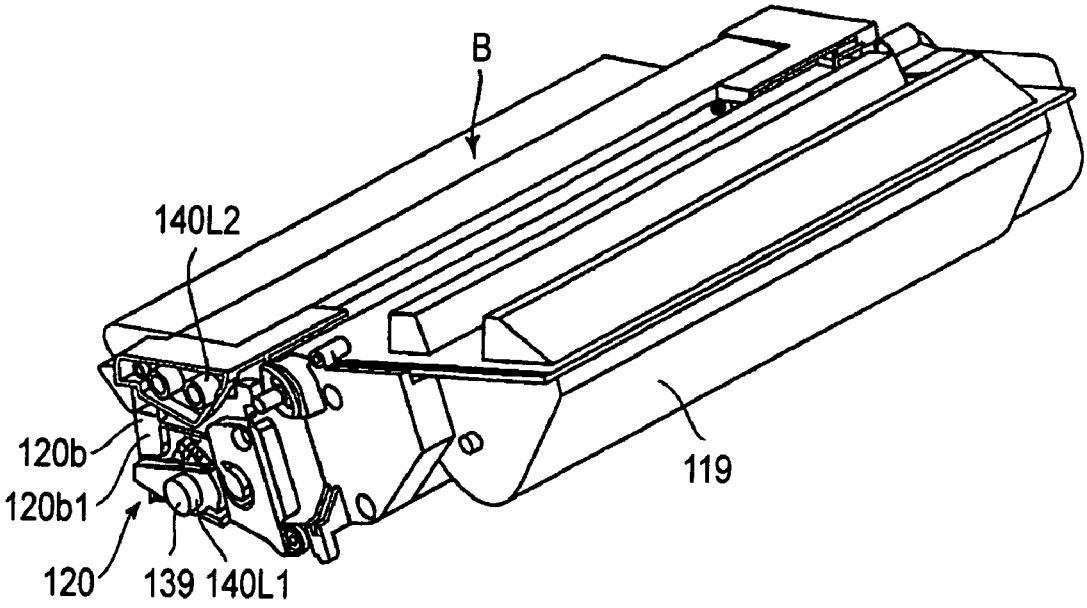
FIG. 7 is a perspective view of a process cartridge according to the embodiment of the present invention.

As will be understood from FIG. 6, cartridge guides 140R1, 140R2 are provided at one longitudinal end 120*a* of the drum unit 120. As shown in FIG. 7, a cartridge guide 140L1 and another cartridge guide 140L2 are provided at the other longitudinal end 120*b*.

The developing unit 119 and the drum unit 120 are rotatably coupled with each other by pins P (FIG. 1). The developing roller 110 is urged to the photosensitive drum 107 by A elastic force provided by elastic members 121, 122 (FIG. 8) interposed between the units 119, 120. Designated by 119*a* is A arm which is provided in the developing unit 119. The arm 119*a* is engaged with the drum unit 120, too. A pin P is penetrated through holes formed in the units 119, 120.

Figure 8:
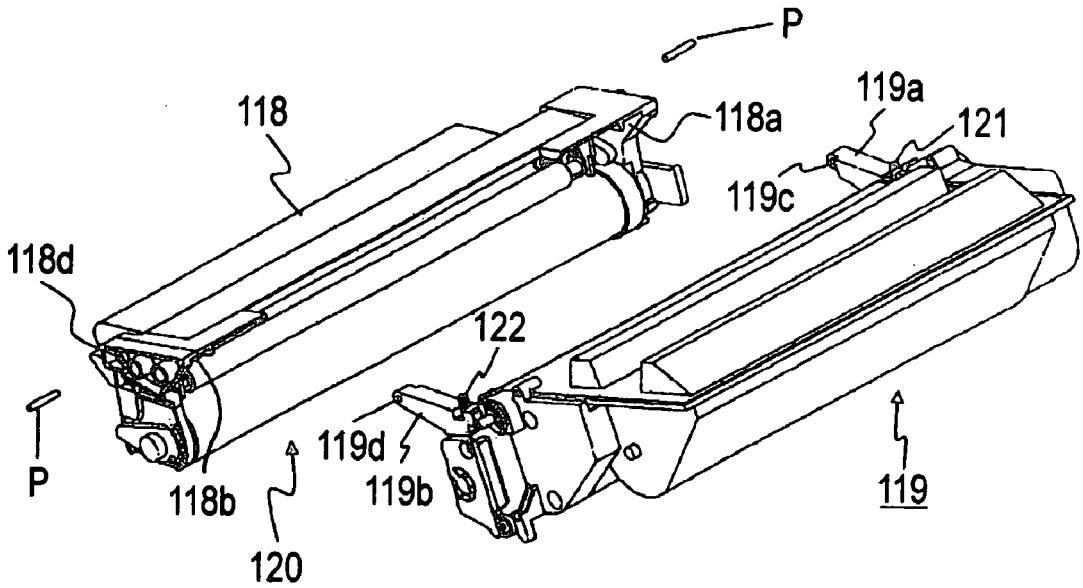
FIG. 8 is a perspective view wherein the developing unit and the drum unit are shown as being separated to illustrate the structures of the process cartridge of the embodiment of the present invention.
Figure 9:
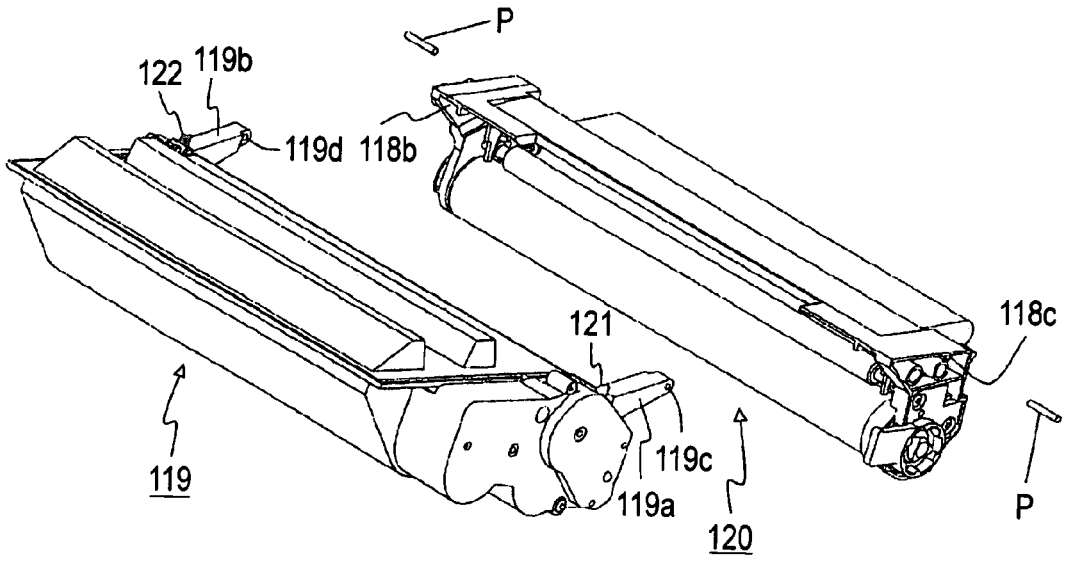
FIG. 9 is a perspective view wherein the developing unit and the drum unit are shown as being separated to illustrate the structures of the process cartridge of the embodiment of the present invention.

Referring to FIGS. 8 and 9, more detailed description will be made. Free ends of arm portions 119*a*, 119*b* are provided adjacent longitudinally opposite end portions of the developing device frame 113, and are provided with circular rotation holes 119*c*, 119*d* extending parallel with developing roller 110. At two positions of the longitudinal ends of the drum frame 118, recesses 118*a*, 118*b* are provided to receive the arm portion 119*a*, 119*b*. The arm portions 119*a*, 119*b* are inserted into recesses 118*a*, 118*b*. Then, coupling members, namely, pins P are inserted into mounting holes 118*c*, 118*d* of the drum frame 118. In addition, pins P are engaged into the rotation holes 119*c*, 119*d* of the arm portions 119*a*, 119*b*. Then, in the pins P are press-fitted into holes (unshown) formed inside of the drum frame 118. In this manner, the pins P are mounted. By doing so, the drum unit 120 and the developing unit 119 are rotatably coupled by the pins (coupling members) and therefore, they are rotatable about the pins. In this case, compression coil springs 121, 122 mounted to the base portions of the arm portion 119*a* and 119*b* abut to upper walls of the recesses 118*a*, 118*b* of the drum frame 118. By this, the developing unit 119 is urged downwardly by the elastic force provided by the springs 121, 122. In this manner, the developing roller 110 is assuredly press against the photosensitive drum 107.

(2) (2) Electrophotographic Image Forming Apparatus:

Referring to FIG. 2, the description will be made as to the electrophotographic image forming apparatus 100 with which the cartridge B is usable. FIG. 2 shows a general arrangement of an electrophotographic image forming apparatus (image forming apparatus) 100.

The description will be made as to a laser beam printer which is A exemplary image forming apparatus 100.

In the image forming operation, a surface of the photosensitive drum 107 is uniformly charged by the charging roller 108. A laser beam is emitted from a laser diode and is projected onto the photosensitive drum 107 in accordance with image information with optical means 101 including a polygonal mirror, lenses Ad deflection mirrors (unshown). By doing so, an electrostatic latent image is formed on the photosensitive drum 107 corresponding to the image information. The latent image is developed by the developing roller 110 which has been described hereinbefore.

On the other hand, in synchronism with the formation of the developed image, a recording material 102 in a cassette 103*a* is fed out by pick-up roller 103*b* and is fed to a transfer position by feeding rollers 103*c*, 103*d*, 103*e*. At the transfer position, a transfer roller 104 (transferring means) is provided. The transfer roller 104 is supplied with a voltage. By this, the developed image formed on the photosensitive drum 107 is transferred onto the recording material 102.

The recording material 102 now having the developed image transferred thereto is fed to fixing means 105 through a guide 103*f*. The fixing means 105 includes a driving roller 105*c* and a fixing roller 105*b* containing a heater 105*a* therein. The fixing means 105 applies heat and pressure to the recording material 102 passing therethrough to fix the developed image on the recording material 102. The recording material 102 is fed by a pair of rollers 103*g* and 103*g* onto a tray 106. The roller 103*b*, the pair of feeding rollers 103*c*, 103*d*, 103*e*, the guide 103*f*, the pair of rollers 103*g* and 103*h* and so on constitute feeding means 103 for the recording material 102.

The cartridge B is mounted into or demounted from the main assembly A of the apparatus in the following manner.

Figure 3:
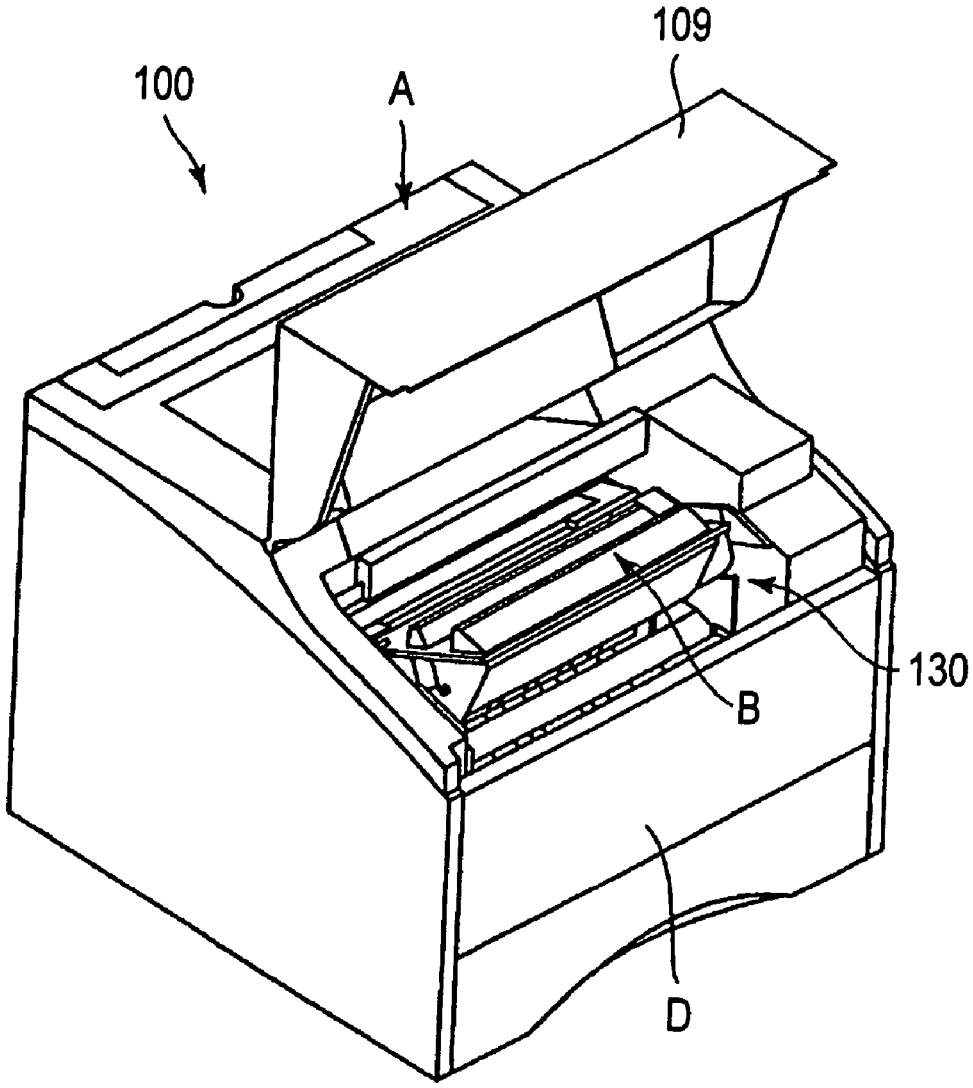
FIG. 3 is a perspective view of an image forming apparatus according to an embodiment of the present invention.

As shown in FIG. 3, the operator opens a door 109 provided in the main assembly A of the apparatus. The cartridge B is demountably mounted to cartridge mounting means 130 provided in the main assembly A of the apparatus.

Figure 4:
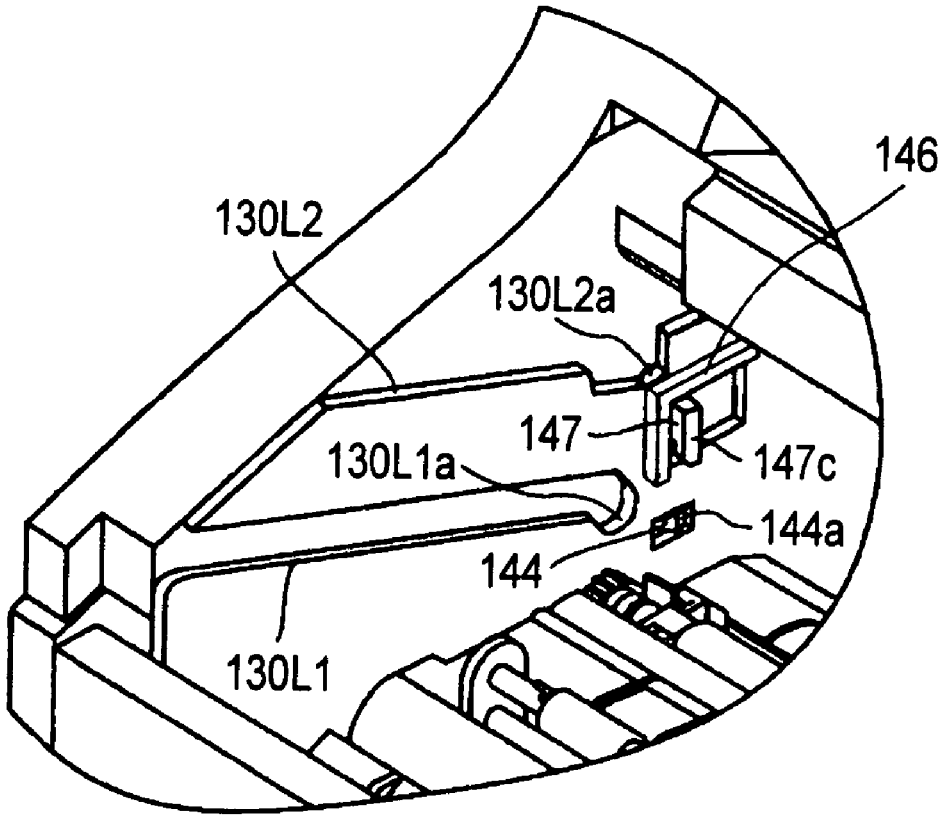
FIG. 4 shows a mounting portion of the main assembly of the apparatus to accept the process cartridge according to the embodiment of the present invention.
Figure 5:
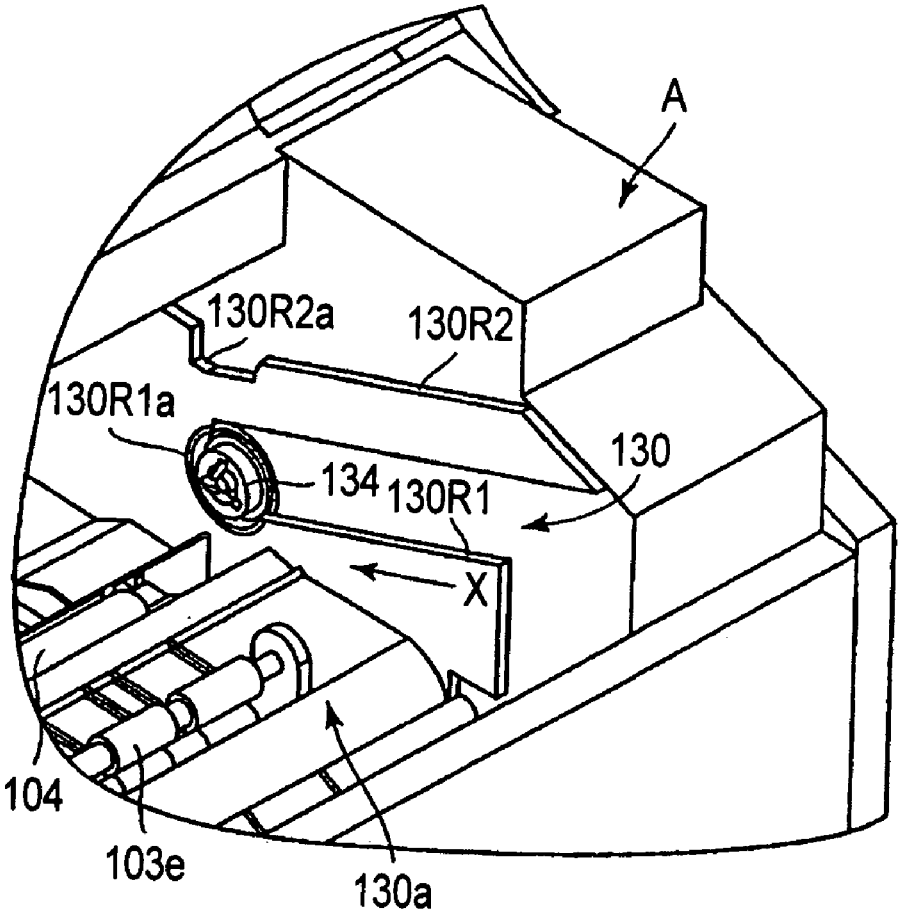
FIG. 5 shows a mounting portion of the main assembly of the apparatus to accept the process cartridge according to the embodiment of the present invention.

As shown in FIGS. 4 and 5, the mounting means 130 of this embodiment includes main assembly guides 130R1, 130R2, 130L1 and 130L2 in the main assembly A of the apparatus. When the cartridge B is mounted to the main assembly A of the apparatus, it is inserted toward the cartridge mounting portion 130*a* such that cartridge guides 140R1 and 140R2 (FIG. 6) are guided by the main assembly guides 130R1 and 130R2, and the cartridge guides 140L1 and 140L2 (FIG. 7) are guided by the main assembly guides 130L1 and 130L2.

The cartridge guide 140R1 is engaged with the positioning portion 130R1*a* of the main assembly guide 130R1, and the cartridge guide 140R2 is seated on the positioning portion 130R2*a* of the main assembly guide 130R2. The cartridge guide 140L1 is engaged with the positioning portion 130L1*a* of the main assembly guide 130L1, and the cartridge guide 140L2 is seated on the positioning portion 130L2*a* of the main assembly guide 130L2. At this time, the cartridge B is demountably mounted to the cartridge mounting portion 130*a* by the mounting means 130. By the cartridge B mounted in place in the cartridge mounting portion 130*a*, the image forming operation is enabled. Here, the cartridge mounting portion 130*a* is the space occupied by the cartridge B which is mounted in place to the main assembly A of the apparatus by the mounting means 130.

When the cartridge B is mounted, a coupling 134 (FIG. 5) functioning as a driving force transmitting portion is at a retracted position, so that it does not interfere with the cartridge B which is being inserted for mounting. When the cover 109 is closed, the coupling 134 provided in the main assembly A of the apparatus is brought into engagement with a coupling 107*a* (FIG. 6) of the coupling 107*a* of the cartridge B functioning as a driving force receiving portion. Then, the process cartridge is capable of receiving a driving force for rotating the photosensitive drum 107 from the main assembly A of the apparatus.

Figure 10:
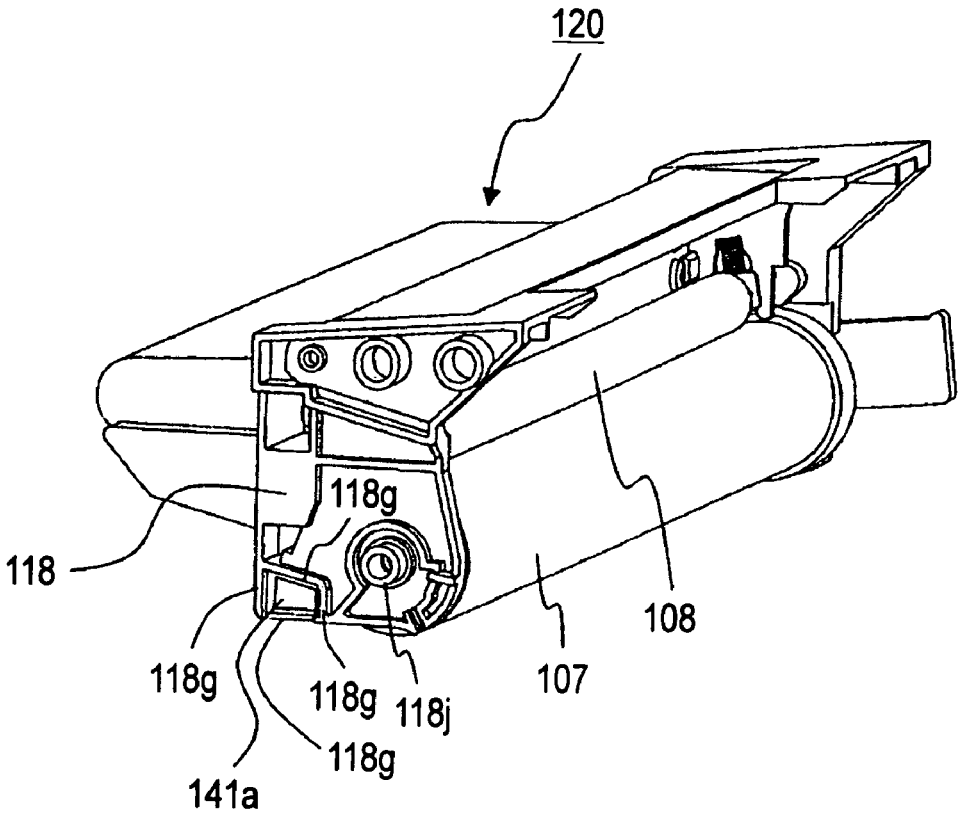
FIG. 10 illustrates a structure of a drum unit of the process cartridge according to an embodiment of the present invention.

(3) Cartridge Charging Contact Member:

As shown in FIG. 10, the drum unit 120 is provided with the input electrical contact member (input electrical contact member) 141 for receiving a charging voltage to be supplied to the charging roller 108 from the main assembly A of the apparatus. The cartridge charging contact member 141 is mounted to the drum frame 118. More particularly, the charging contact member 141 has a contact 141*a* on a side surface of the drum frame 118 to establish electrical connection with the output contact member in the main assembly of the apparatus A, that is, an electrical contact (output contact) 144*a* (FIG. 13) of the main assembly charging contact member 144. The other end portion of the cartridge charging contact member 141 is electrically connected with the charging roller 108 inside the drum unit 120.

Figure 11:
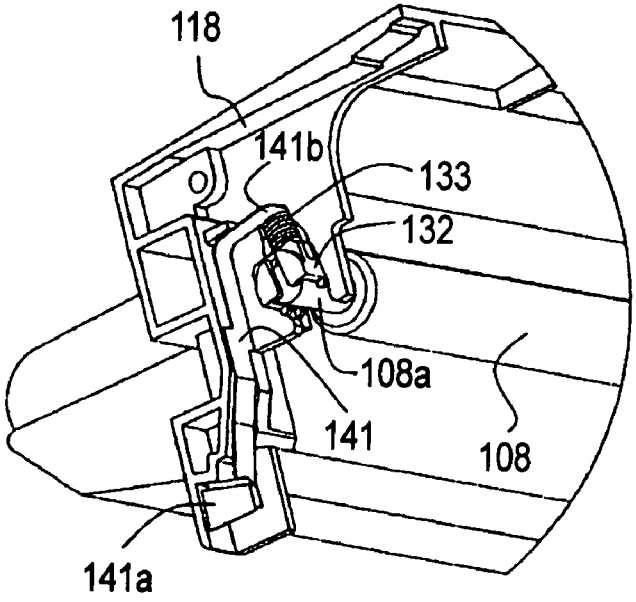
FIG. 11 illustrates a structure of a drum unit of the process cartridge according to an embodiment of the present invention.

FIG. 11 is a perspective view wherein a side of the drum frame 118 has been removed so that inside of the drum frame 118 can be seen. As shown in the Figure, the charging roller 108 has a metal shaft 108*a* which is is rotatably supported by charging roller bearings 132 molded from electroconductive resin material. The charging roller 108 is mounted in the drum frame 118. Between the charging roller bearing 132 and the drum frame 108, there is provided a charging roller pressing spring 133. The spring 133 functions to urge the charging roller 108 to the photosensitive drum 107 (unshown in FIG. 11) by a predetermined force.

The charging contact member 141 is in the form of a metal plate having an electrical contact 141*a* for electrical contact to the contact 144*a* provided in the main assembly of the apparatus, and a contact 141*b* for contact to said spring 133. The (charging contact member 141) is mounted to the drum frame 118. Therefore, the contact 141*a* is electrically connected with a charging roller 108 through the contact 141*b*, the spring 133, the bearing 132 and the metal shaft 108*a*.

The electrical contact 141*a* is surrounded by a rib 118*g* so as not to projects beyond the side surface of the drum frame 118.

(4) Cartridge Movable Member:

Referring to FIGS. 12, 13, 14, 62 and 63, the description will be made as to the structure and operation of the movable operation member, more particularly, cartridge movable member 142, mounted on the cartridge B.

As shown in the Figure, the movable member 142 is rotatably provided on a side opposite from a side where the coupling 107*a* (FIG. 6) (driving force receiving portion) is provided. Here, the coupling (driving force receiving portion) functions to receive a driving force from the main assembly of the apparatus A when the cartridge B is set in the main assembly of the apparatus A.

The movable member 142 is mounted by engaging a hole of a cylindrical portion 142*a* with a shaft 118*j* (FIG. 10) provided on a side surface of the drum frame 118 and then press-fitting the drum shaft 139 into the hole of the shaft 118*j*. By this, the movable member 142 is retained and prevented from disengagement. The movable member 142 is rotatably mounted coaxially with the rotational axis of the photosensitive drum 107. The shaft 118*j* is extended coaxially with the photosensitive drum 107. The operation member 142 is disposed on one end surface of the drum frame 118.

To the movable member 142, a twisted coil spring 143 (elastic function member) is provided at the cylindrical portion 142*a*. One of arm portions 143*a* of the movable member 142 is hooked on a locking portion 142*e*. The other arm portion 143*b* is mounted in a groove 118*d* formed in a side surface of the drum frame 118. Therefore, the movable member 142 is normally urged for rotation in the direction of arrow a. The abutting portion 142*b* of the movable member 142 urged by the spring 143 abuts to an abutting portion 118*e* of the drum frame 118. By doing so, the movable member 142 is positioned in the rotational direction. The movable member 142 is movable relative to the drum frame 118.

When the movable member 142 rotates in the direction of the arrow b, the movable member 142 is rotatable until the abutting portion 142*c* thereof abuts to the abutting portion 118*f* the drum frame.

Figure 13:
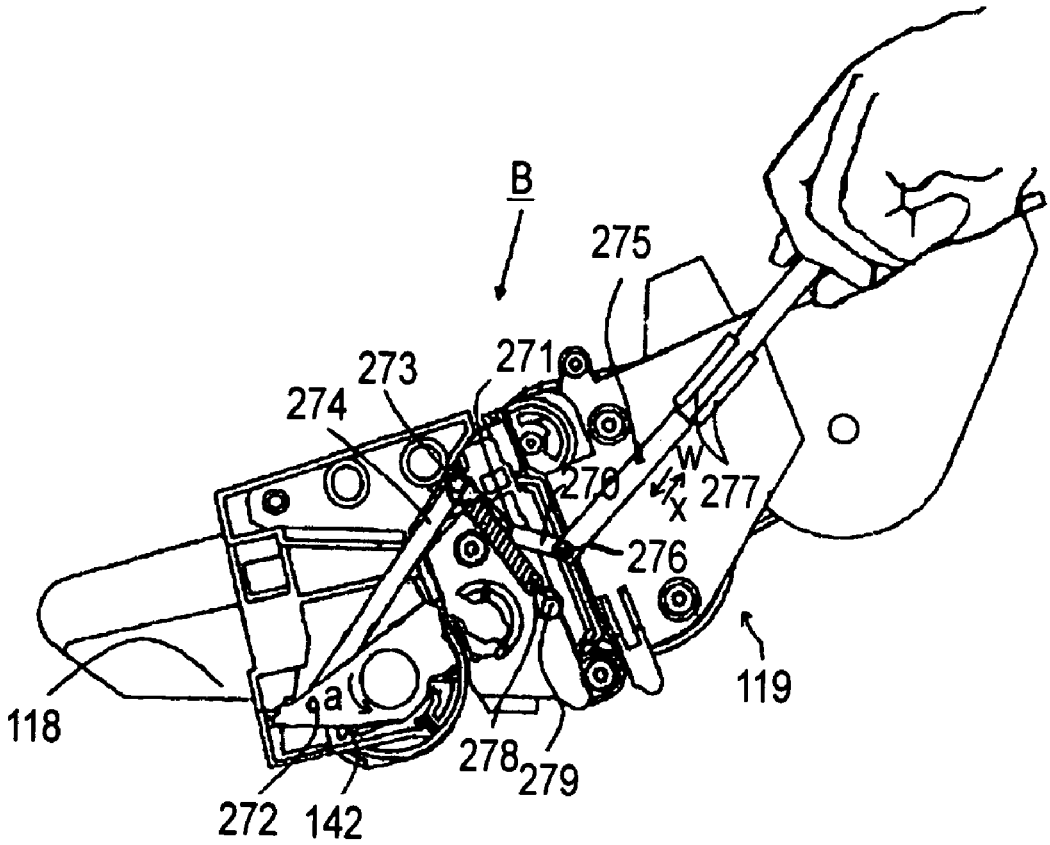
FIG. 13 illustrates a structure of a movable operation member of the process cartridge according to the embodiment of the present invention.

As shown in FIG. 13, the developing unit 119 has a cartridge arm 270 which is rotatable about the center of the cartridge shaft portion 271. Here, the movable member 142 and an end of the arm 270, there is provided a rotatable first link 274 at each of the first cartridge connecting portion 272 and the second cartridge connecting portion 273. To the other end portion of the arm 270, a second link 275 (operation member) is rotatably mounted at a third cartridge connecting portion 276. The second link 275 is mounted on a mounting portion 277 provided on a side surface of the developing unit 119 for sliding movement in the directions indicated by arrows w, x. On the link 274 and the connecting portion 273, a tension spring 278 is stretched. The other end of the tension spring 278 is hooked on the shaft portion 279.

Figure 12:
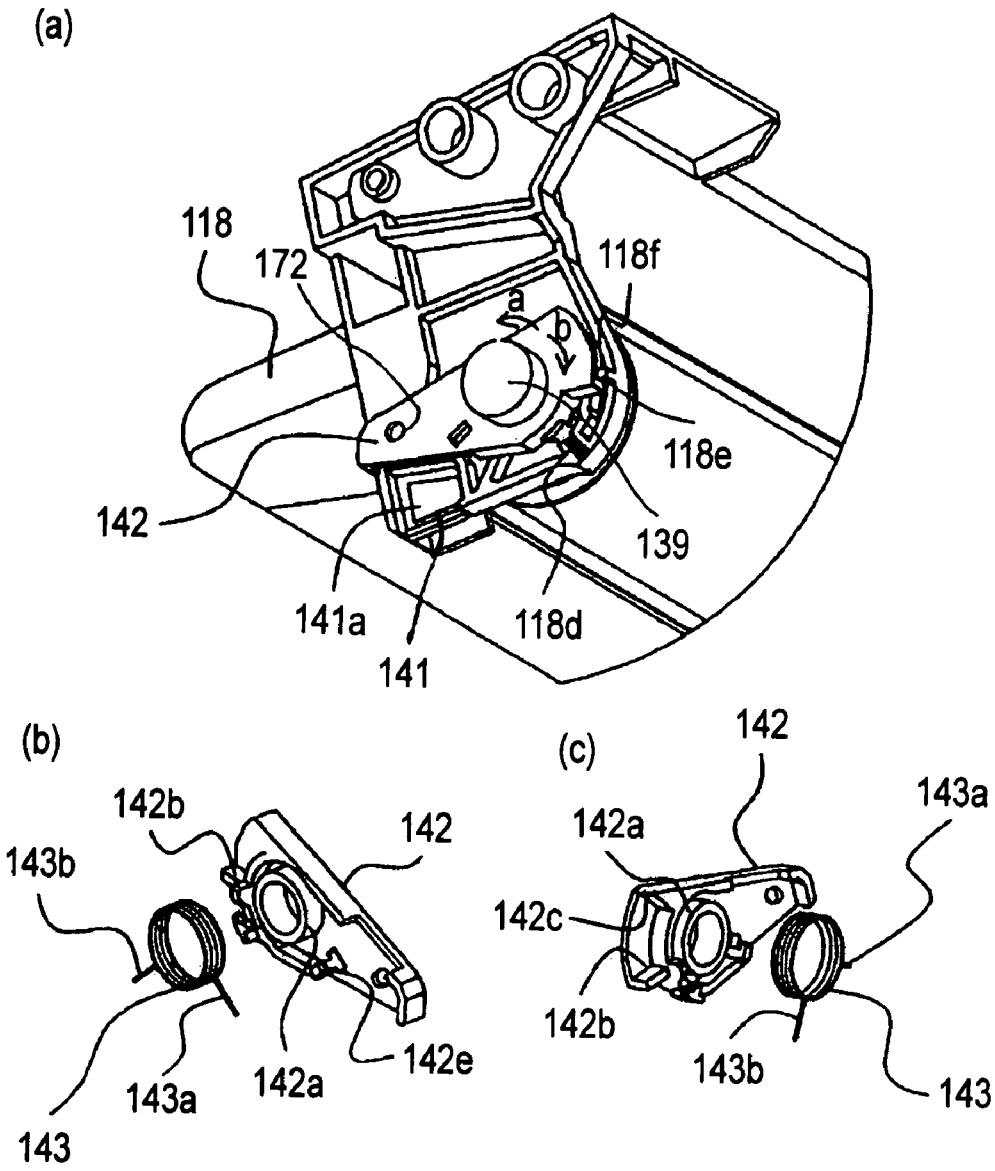
FIG. 12 illustrates a structure of a movable operation member of the process cartridge according to the embodiment of the present invention.
Figure 62:
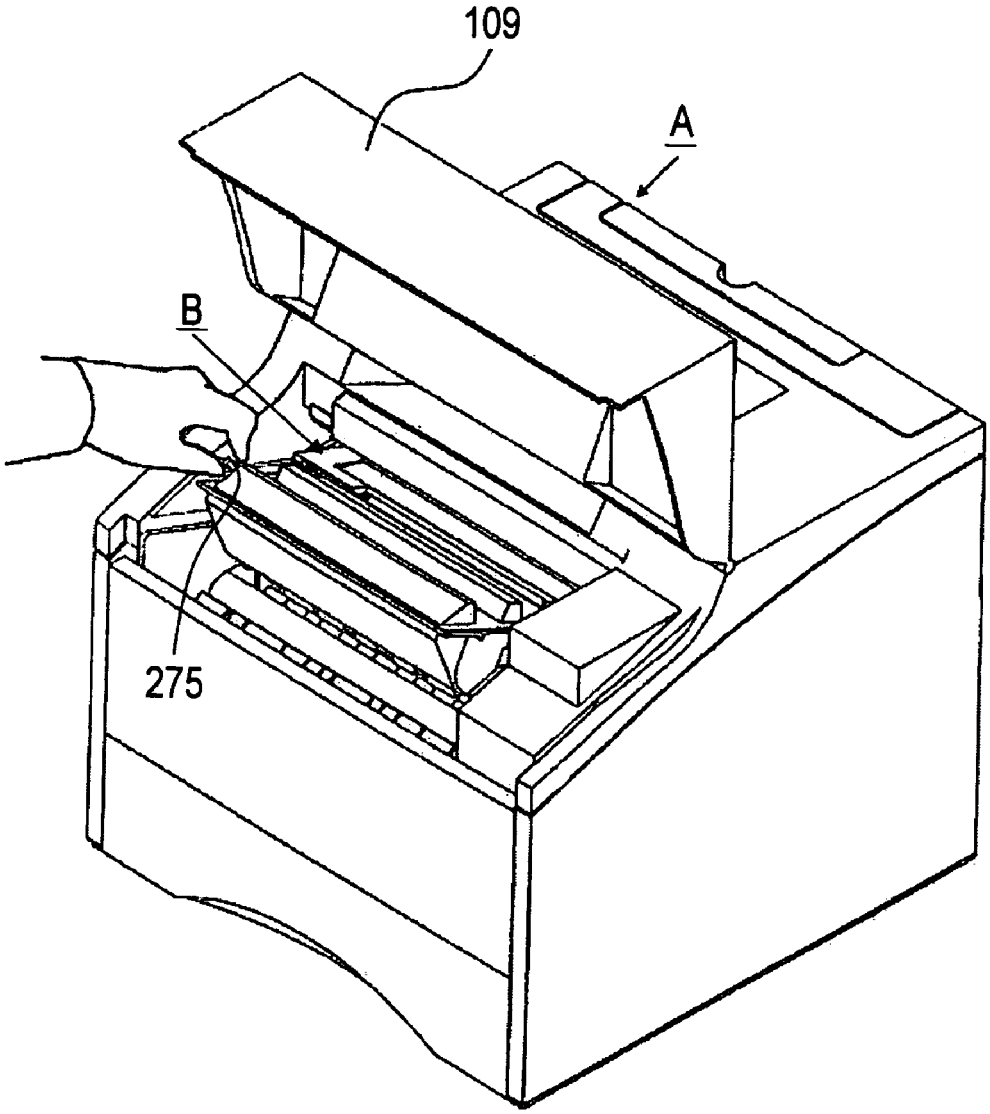
FIG. 62 is a perspective view illustrating a state in which an operator is manipulating an operation member of a process cartridge according to an embodiment of the present invention.
Figure 63:
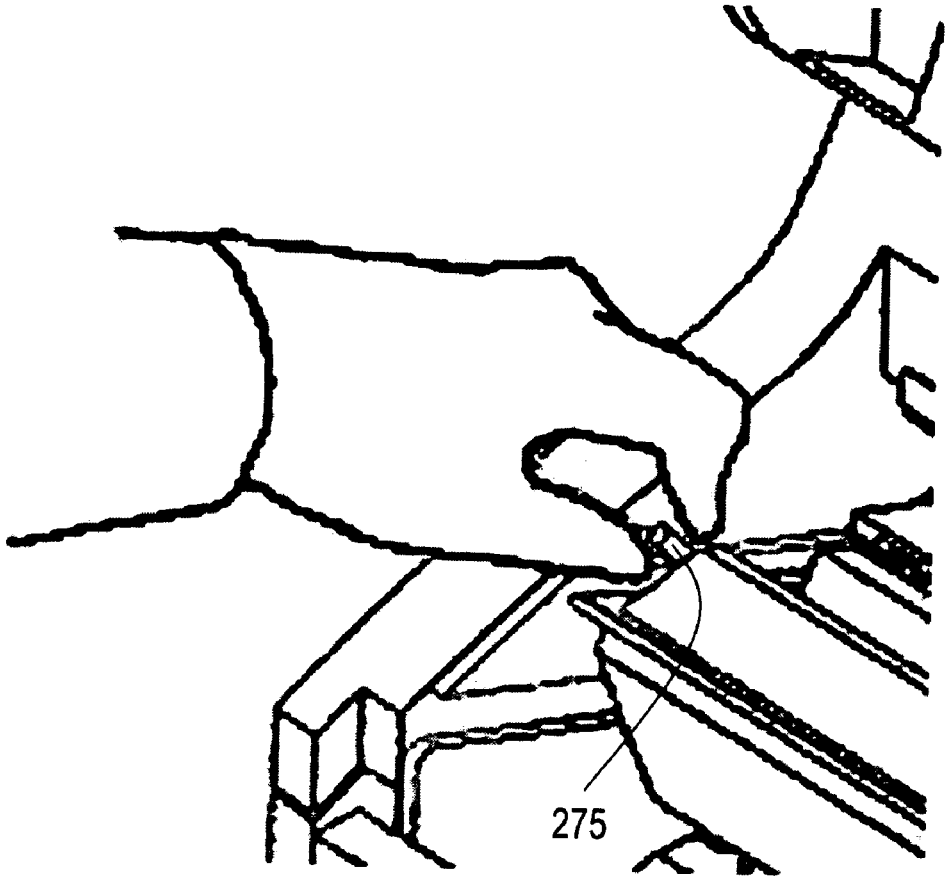
FIG. 63 is a perspective view enlarging a part of FIG. 62.

With the structure of this embodiment, the movable member 142 is rotatable by the operator manually operating the link 275 (operation member). FIGS. 13, 62, 63 shows a state in which the user directly manipulate the link 275 in the direction of the arrow x (pull it toward the user). When the link 275 is moved in the direction x, the arm 270 rotates in the couterclockwise direction. This rotates t said movable member 142 in the direction of arrow a. At this time, the movable member 142 is rotatable until the movable member 142 abuts to the abutting portion 118*e* of the drum frame 118 (FIG. 12). When the movable member 142 abuts to the abutting portion 118*e*, the connecting portion 273 is disposed in a left side area of a line connecting the center of rotation of the arm 270 (the center of the shaft 271) and the center of the tension spring supporting shaft portion 279. Therefore, the force of the spring 278 tends to rotate the arm 270 in the couterclockwise direction. A spring 278 is mounted on the shaft portion 279.

Therefore, the movable member 142 is placed at a position where the abutting portion 118*e* abuts. When the movable member 142 is in this state, the charging contact member 141 is covered by the movable member 142.

Figure 14:
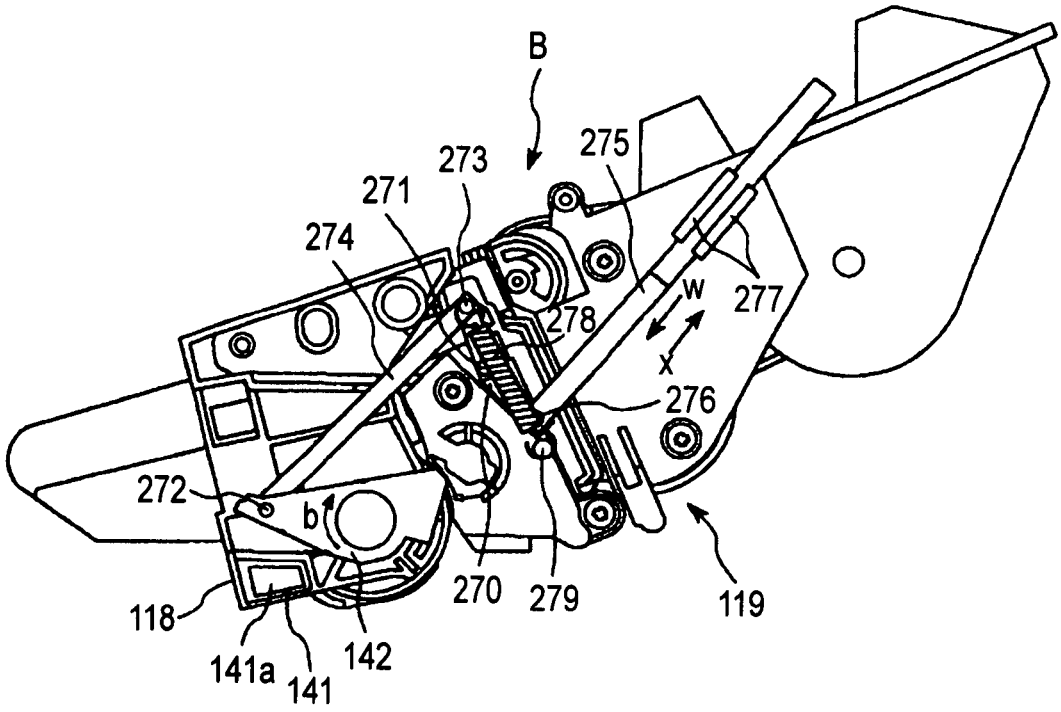
FIG. 14 illustrates a structure of a movable operation member of the process cartridge according to the embodiment of the present invention.

FIG. 14 shows a state in which the operator manipulates the second link 275 in the direction of the arrow w (pushing direction). By the operation of the link 275, the arm 270 rotates in the clockwise direction. And, the movable member 142 rotates in the direction of the arrow b. At this time, the movable member 142 is rotatable until the movable member 142 abuts to an abutting portion 118*f* (FIG. 12) provided in the drum frame 118. When the movable member 142 abuts to the abutting portion 118*f*, the connecting portion 273 is disposed in a righthand side area of a line connecting the center of rotation of the arm 270 (the center of the shaft 271) and the center of the supporting shaft portion 279. Therefore, the force of the tension spring 278 tends to rotates the arm 270 in the clockwise direction. By doing so, the movable member 142 is placed at a position abutting the abutting portion 118*f*. When the movable member 142 is in this state, the electrical contact 141*a* of the charging contact member 141 is exposed.

As described hereinbefore, the movable member 142 is movable relative to the drum frame (cartridge frame) 118. By the operator operating the link 275 after the cartridge B is mounted to the main assembly of the apparatus A, the movable member 142 is brought into engagement with the displaceable engaging portion 147*c* of the displaceable member 147 to move the displaceable member 147, and in interrelation with the movement of the displaceable member 147, the output contact 144*a* is moved from the retracted position to the electrical connection position against the elastic force of the compression spring 149.

(5) Charging Contact Member of Main Assembly of Apparatus A:

The description will be made as to the main assembly charging contact member 144 (output contact member) provided in the main assembly of the apparatus A.

Figure 15:
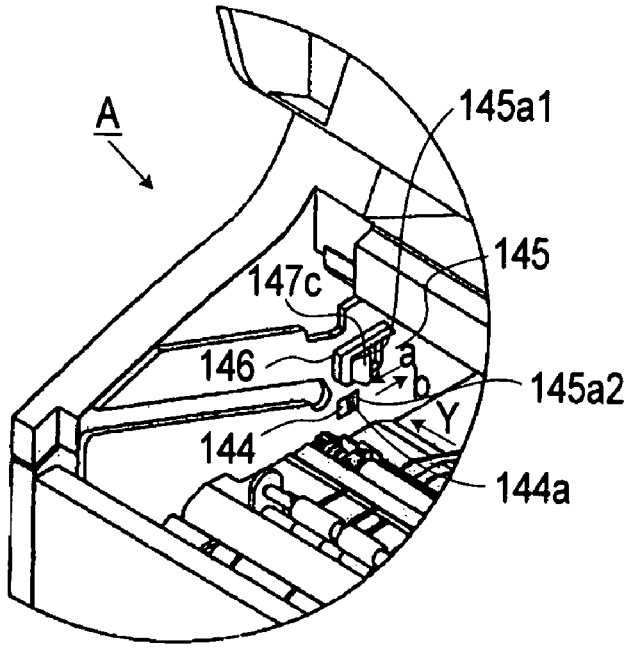
FIG. 15 illustrates a structure of an electrical contact portion provided in the main assembly of the image forming apparatus according to the embodiment of the present invention.
Figure 15:
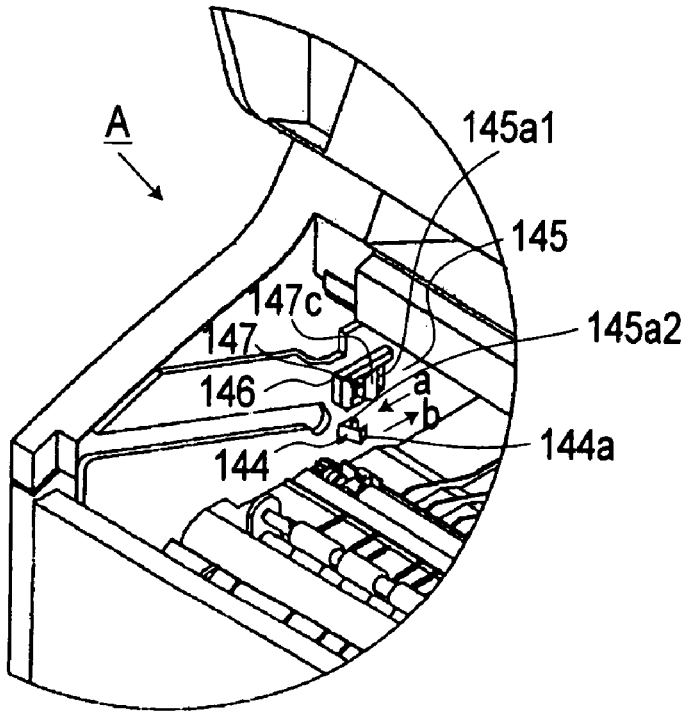

As shown in FIG. 15, (a), the main assembly charging contact member 144 is provided on an inside surface of the main assembly of the apparatus A. When the cartridge B is not mounted in the main assembly of the apparatus A, the charging contact member 144 is at a retracted position where it does not project beyond the main assembly of the apparatus A of the charging contact member 144. The main assembly charging contact member 144 functions to apply the charging bias voltage by contact with the cartridge charging contact member 141 (input electrical contact member) of the cartridge B.

The charging contact member 144 is connected with a high voltage electric circuit (voltage source circuit E) provided in the main assembly of the apparatus A through a lead or the like.

In the inside of the main assembly of the apparatus A, one end portion 147*c* of the main assembly movable member 147 (displaceable member) for operating the charging contact member 144 in interrelation with the operation of the movable member 142 described above.

The movable member 147 moves in the direction of arrows a, b in interrelation with the operation of the movable member 142. By the operator operating the second link 275 (operation member) after the cartridge B is mounted in the main assembly of the apparatus A, as shown in (b) of FIG. 15, the movable member 147 is pushed in the direction of the arrow b by the movable member 142. And, in interrelation with the operation of the movable member 147, the contact 144*a* makes a rotational motion to project beyond the inner side plate 145. By this, the electrical contact 144*a* is contacted to the electrical contact 141*a*.

Thus, the contact 144*a* is brought into contact, by the rotation thereof, to the contact 141*a* which is stationary Ad in a stand-by state at the electrical contact position. The contact 141*a* slides on the contact 141*a* after the contact 144*a* is thus contacted to the contact 141*a*. Therefore, foreign matter, developer or the like can be removed from between the contacts. In this manner, the reliability of establishment of electrical connection between the contacts can be improved.

Figure 16:
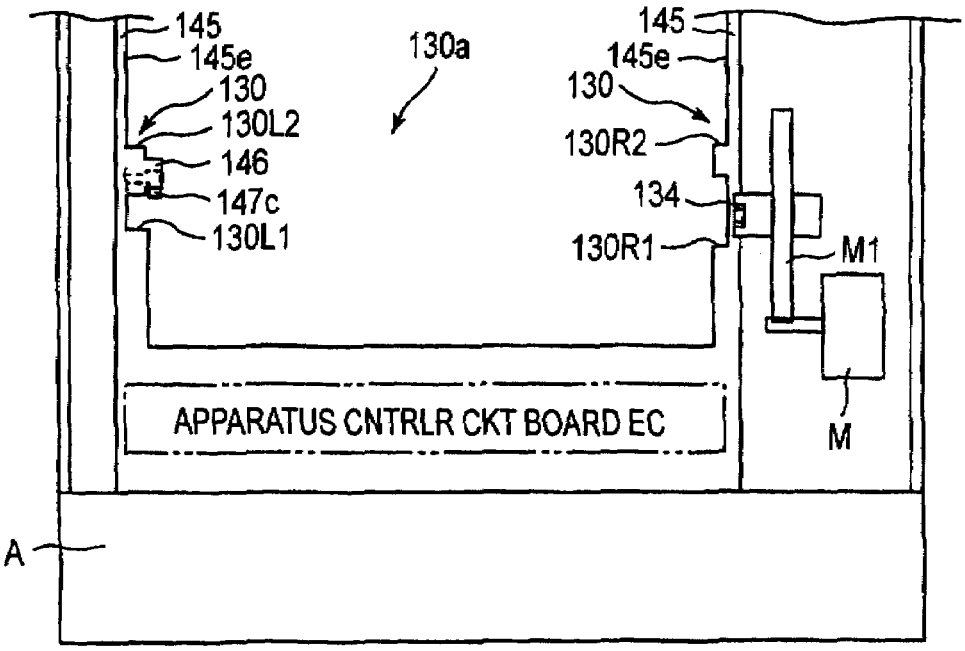
FIG. 16 illustrates a structure of a mounting portion provided in the main assembly of the image forming apparatus according to the embodiment of the present invention.

(6) Inner Structure of Main Assembly of Apparatus A:

Referring to FIG. 16, the description will be made as to the internal structure of the main assembly A of the apparatus. FIG. 16 is a front view of the inside of the main assembly A of the apparatus as seen from the front side D, that is, in the direction of mounting the cartridge B (FIG. 3).

Figure 19:
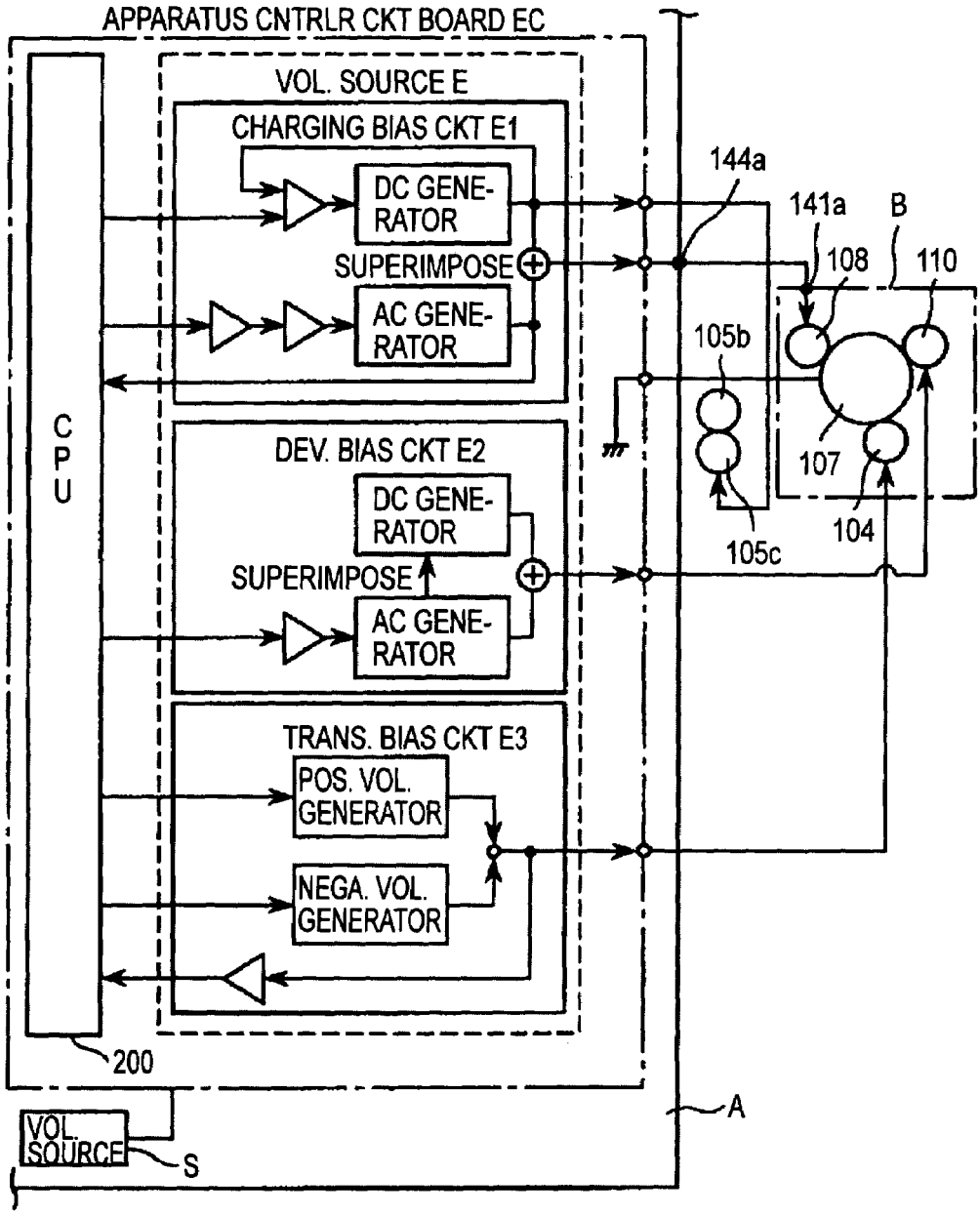
FIG. 19. illustrates a structure of a circuit board in the image forming apparatus according to the embodiment of the present invention.

At the bottom surface of the main assembly of the apparatus A, that is, below the cartridge mounting portion 130*a* there is provided an apparatus controller circuit board EC (FIG. 19). At one lateral side of the mounting portion 130*a* with respect to the mounting direction, there is disposed a motor M and a driving gear train (driving force transmitting means) M1 for transmitting the driving force from the motor M to the coupling 134 or the like, outside the inside side surface 145*e* of the inner side plate 145.

At the opposite lateral side of the mounting portion 130*a*, the displaceable engaging portion 147*c* is disposed downstream of the fixed engageable member 146 with respect to the inserting direction X of the cartridge B relative to the main assembly A of the apparatus. In addition, at least a part of the engaging portion 147*c* is overlapped with the fixed engageable member 146 as seen in the inserting direction X. In other words, a part of the engaging portion 147*c* is behind the fixed engageable member 146 as seen in the inserting direction X. The fixed member 146 is fixed on the main assembly of the apparatus A.

For this reason, even if the operator inserts his or her hand form the front side side D into the main assembly A of the apparatus for the purpose of maintenance (jam clearance operation or the like) after the cartridge B is dismounted, the hand is blocked by the fixed engageable member 146. Therefore, the displaceable engaging portion 147*c* is effectively protected from inadvertently accessed by the operator. The output contact 144*a* (not shown in FIG. 12) placed in the retracted position is prevented from moving unintentionally to the electrical connection position.

Figure 17:
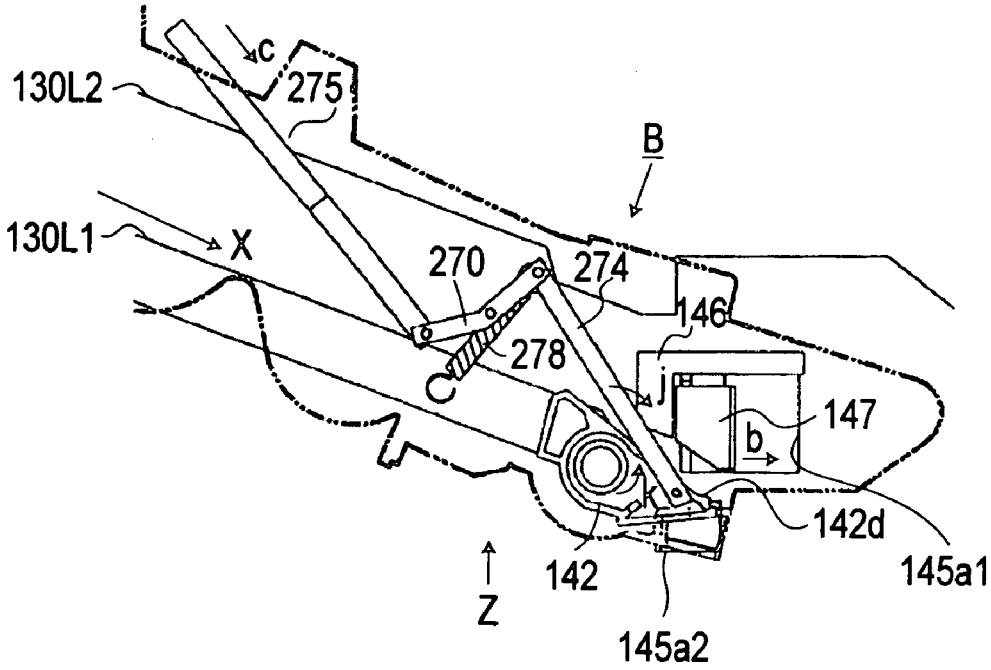
FIG. 17 illustrates structures of the movable operation member and the electrical contact of the image forming apparatus according to the embodiment of the present invention.
Figure 17:
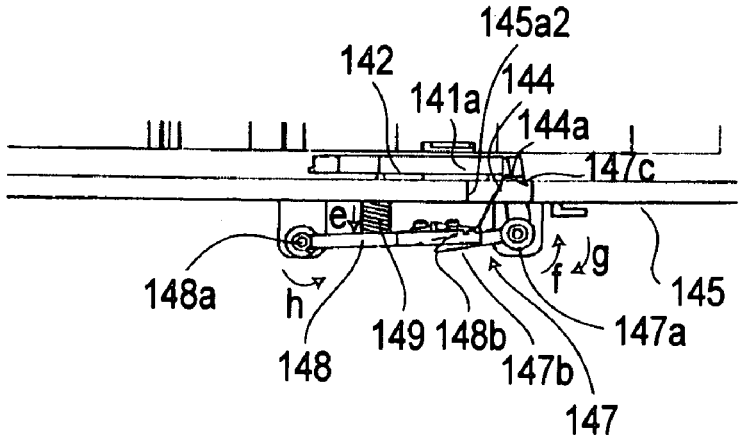
Figure 18:
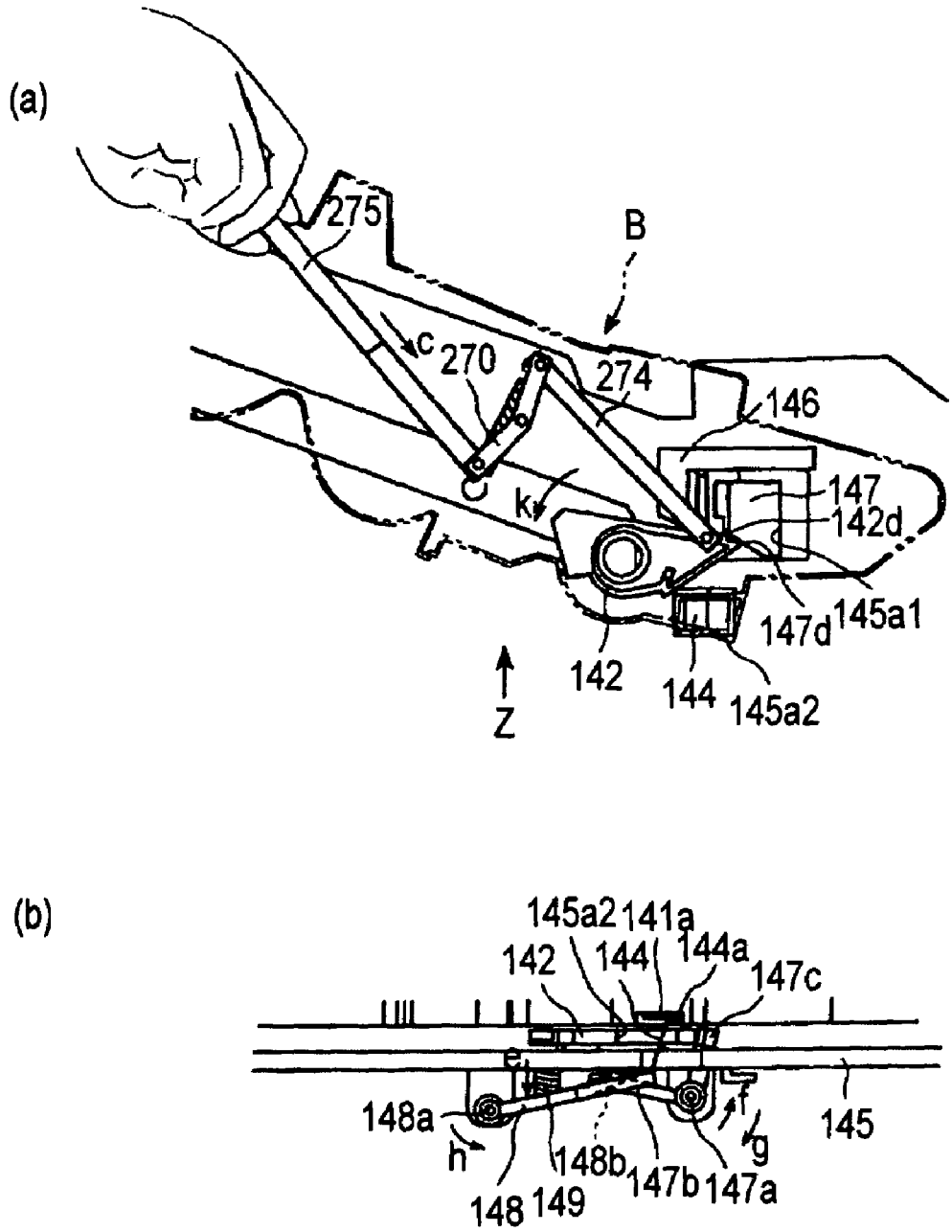
FIG. 18 illustrates structures of the movable operation member and the electrical contact of the image forming apparatus according to the embodiment of the present invention.

(7) Operations of Movable Member and Charging Contact Member:

The description will be made as to the operations of the movable member 142 and the main assembly charging contact member 144. FIG. 17 and FIG. 18 are schematic views illustrating operations when the cartridge B is set in the main assembly of the apparatus A.

(A) of FIG. 17 and (a) of FIG. 18, are views of the inner side plate 145 of the main assembly of the apparatus A as seen from an inside of the main assembly of the apparatus (in the direction of the arrow Y in FIG. 15). (b) of FIG. 17 and (b) of FIG. 18 are the views as seen in the direction of arrow Z.

As will be understood from these Figures, the main assembly movable member 147 is rotatably supported on the outside of the inner side plate 145 for rotation about the shaft portion 147*a*. The charging contact member 144 is mounted on the contact supporting member 148. The supporting member 148 is mounted for rotation about the shaft portion 148*a*. The supporting member 148 is urged in the direction of arrow e by a compression spring 149 functioning as A elastic function member. The abutting portions 147*b* and 148*b* of the movable member 147 and the supporting member 148 abut to each other.

When the supporting member 148 is urged in the direction of an arrow e, the movable member 147 is rotated in the direction of an arrow f. An abutting portion (unshown) abuts to to an edge portion of an opening 145*a*1 of the inner side plate 145. By this, the movable member 147 is correctly positioned. At this time, the charging contact member 144 is placed at a retracted position, retracted from the electrical connection position relative to the connection, wherein in the retracted position, the charging contact member 144 does not projection into the inside of the main assembly of the apparatus A through the opening 145*a*2 of the inner side plate 145.

FIG. 17, (a) and (b) show states in which the cartridge B is mounted in place in the main assembly A of the apparatus. The cartridge B is mounted in the direction of the arrow X along guide portions 130L1 and 130L2. FIG. 17 shows a state in which the cartridge B is mounted in the main assembly of the apparatus A.

In the position shown in (a) and (b) of FIG. 17, as described hereinbefore, the movable member 142 is urged in the direction of the arrow j by the elastic force of the spring 143. The movable member 142 is at the position where the abutting portion 142*b* (FIG. 12) and the abutting portion 118*e* abut to each other. At this time, the elastic force of the spring 278 applies A urging force in the direction of the arrow j, that is, assisting the force of the spring 143. The charging contact member 144 is at such a position not projecting beyond the inner side plate 145 as described hereinbefore.

In the state shown in FIG. 18, the operator manually operates the second link 275 (operation member) in the direction of the arrow c. Then, as described hereinbefore, the movable member 142 rotates in the direction of the arrow k through the arm 270 and the first link 274. At this time, a free end portion 142*d* of the movable member 142 abuts to an inclined surface 147*d* of the main assembly movable member 147. By this, the movable member 147 moves in the direction of the arrow g.

At this time, the elastic force of the spring 278 applies in a righthand side area of the elastic force said spring 278 the center of rotation of the arm 270 (center of the shaft 271) and the center of the supporting shaft portion 279 for the spring 278. Therefore, the elastic force of the spring 278 tends to rotate the arm 270 in the clockwise direction. Therefore, the urging force of the movable member 142 is canceled.

At this time, the movable member 142 receives reaction force from the movable member 147 and is positioned by abutment the abutting portion 142*c* and the abutting portion 118*f*.

As described in the foregoing, in this embodiment, after the cartridge B is set in the main assembly of the apparatus A (after it is mounted to the mounting portion 130*a*), the operator manually operates the link 275. By doing so, the movable member 142, the movable member 147 the contact supporting member 148 operates. Then, the contact 144*a* projects into the inside (the mounting portion 130*a*) of the main assembly of the apparatus A. By this, the electrical contact 144*a* is contacted to the electrical contact 141*a*. By the control of the CPU200 (FIG. 19), the voltage from the voltage source S (FIG. 19) is supplied to the charging roller 108 through the contacts 141*a*, 141*b* and a contact 150*a* of the cartridge fixed charging contact member 150. The electrical contacts 141*a*, 141*b* are provided on the cartridge movable charging contact member 141.

As described hereinbefore, the output contact 144*a* is movable between the electrical connection position and the retracted position where the output contact 144*a* is retracted from the electrical connection position and is disposed out of the cartridge mounting portion 130*a*. And, the output contact 144*a* is electrically connected with the voltage source S which will be described hereinafter through a voltage source circuit E which will be described hereinafter.

Thus, the stationary electrical contact 141*a* is contacted by the contact 144*a* which comes the electrical connection position with rotation. The electrical contact 141*a* is supplied with a voltage for enabling the charging roller 108 as the process means.

In this manner, by the movement of the electrical contact 144*a* the electrical contact 141*a*, the electrical contacts are contacted to each other. The electrical connection is stably established between the electrical contacts. Thus, the electrical connection is established accurately between the contacts.

By doing so, the application of the charging bias from the voltage source S of the main assembly of the apparatus A to the charging roller 108 is enabled.

(8) Engine Controller Circuit Board (Voltage Source Circuit):

Referring to FIG. 19, the description will be made as to the engine controller circuit board EC provided in the main assembly of the apparatus A, usable with the present invention. The circuit board EC is disposed below the mounting portion 130*a*. The circuit board EC comprises the CPU200 and the electric circuit E.

The circuit board EC comprises the CPU200 and the electric circuit E (voltage source circuit). The electric circuit E is constituted by a charging bias circuit E1, a developing bias circuit E2 and a transfer/charging bias circuit E3.

The charging bias circuit E1 generates a negative DC voltage and an AC voltage. It applies a voltage in the form of a sum of these voltages to the charging roller 108. The charging roller 108 which receives the voltage and charges the photosensitive drum 107.

The charging bias circuit E1 applies the negative DC voltage also to the fixing roller 105*b* through a driving roller 105*c*. The developing bias circuit E2 generates a negative DC voltage and an AC voltage. The developing roller 110 is supplied with a voltage in the form of a sum of these voltages. The developing roller 110 receives a voltage and operates to develop the electrostatic latent image with a developer. The transfer bias circuit E3 generate a positive or negative DC voltage. It applies positive or negative DC voltage to the transfer roller 104.

Thus, the charging roller 108 is supplied with the voltage from the voltage source S through the charging bias circuit E1. The fixing roller 105*b* and the driving roller 105*c* are supplied with the voltage from the voltage source S through the charging bias circuit E1. The developing roller 110 is supplied with the voltage from the voltage source S through the developing bias circuit E2. The transfer roller 104 is supplied with the voltage from the voltage source S through the transfer/charging bias circuit E3.

These circuits E1, E2 and E3 are on-off-controlled or subjected to the controls in response to instructions from the CPU200 provided on the circuit board EC.

These circuits E1, E2 and E3 are on-off-controlled or subjected to the controls in response to instructions from the CPU200 provided on the circuit board EC. As described in the foregoing, according to this embodiment, even if the operator inserts his or her hand into the main assembly A of the apparatus for the purpose of jam clearance (removal of the recording material 102 from the main assembly A when the recording material 102 is jammed in the main assembly A) or for the purpose of the maintenance operation, the output contact 144*a* is not easily touched by the hand. This is because the output contact 144*a* is at the retracted position. Therefore, (1) the output contact 144*a* is protected from deposition of foreign matter (developer, grease, sweat or the like deposited on the hand). It is possible that grease or the developer on parts in the main assembly A of the apparatus contaminates the operators hand, and if this occurs, the they are liable to contaminate the output contact 144*a*. (2) Or, the output contact 144*a* is not damaged. This is because static electricity of the human body may be applied on the output contact 144*a*. This is A electrostatic noise, which, however, can be avoided according to this embodiment. (3) thus, elements in the electric circuit E in the main assembly of the apparatus can be prevented from the damage which may be caused by the electrostatic noise or the like.

Accordingly, electrical conduction defect from the voltage source S (FIG. 16) to the charging roller 108 can be suppressed by (1), (2) and (3).

As described in the foregoing, the engaging portion 147*c* of the displaceable member 147 (main assembly movable member) is disposed downstream of the fixed member 146 with respect to the inserting direction X. At least a part of the engaging portion 147*c* is overlapped with the fixed member 146 as seen in the direction of the inserting direction X. Namely, as seen in the direction of the inserting direction X, at least part of the engaging portion 147*c* is positioned behind the fixed member 146. Therefore, even if the operator inserts his or her hand into the main assembly A of the apparatus for the purpose of maintenance operation such as jam clearance or the like, the fixed member 146 is effective to prevent the hand from touching the engaging portion 147*c*.

Thus, unintentional movement of the output contact 144*a* placed in the retracted position to the electrical connection position can be avoided.

According to the foregoing embodiment, the charging contact member is disposed at such a position that it does not project beyond the surface of the frame of the process cartridge. Therefore, the operator is effectively prevented from inadvertently touching the electrical contact during manipulation or handling of the cartridge. In this manner, the contact is protected from conduction defect which may otherwise be caused by the sweat, grease or the like.

The electrical connection is established between the cartridge B and the main assembly of the image forming apparatus B by the operation of the operator per se after the cartridge B is set in the main assembly of the image forming apparatus A. By this, the operator can confirm the connection between the electrical contacts 141*a*, 144*a* by himself.

Additionally, according to this embodiment, the following advantageous effects can be provided.

Even if the user inserts the hand into the main assembly of the image forming apparatus for maintenance such as jam clearance with the process cartridge being removed from the main assembly of the image forming apparatus, the electrical contact is not easily contacted by the user, since the electrical contact 144 is not projected out of the inner side surface. In addition, the main assembly movable member 147 for projecting the charging contact member 144 is disposed behind the engageable member 146. Therefore, the operator cannot easily touch the movable member. Thus, the charging contact member 144 is not supplied with electrostatic noise. In addition, the elements on the electric circuit provided in the main assembly of the apparatus A is prevented from being damaged. In addition, the contact is protected from sweat of the user or grease, so that conduction defect can be prevented beforehand.

(2) as regards the structure of the main assembly of the apparatus, the contact member is disposed at a side opposite from the driving side. By doing so, the space in the main assembly of the apparatus A can be effectively utilized. This permits downsizing of the apparatus.

(3) by disposing an electrical contact of the cartridge at a lower portion of the cartridge, the assembling property is improved. In that case, the movable member 142 is prevented from projecting toward the main assembly side of the apparatus by upward movement of the cartridge movable member 142. This permits downsizing of the main assembly of the apparatus A.

(4) the movable member 142 rotates about the shaft. This accomplishes sliding movement of the movable member 142 when the cartridge B is mounted to or demounted from the main assembly of the apparatus A. The movable member 142 is engaged with the shaft. Therefore, the assembling is easy.

(5) the movable member 142 is co-axial with the rotation shaft 118*j* of the photosensitive drum 107. Therefore, there is no been of providing an additional rotation shaft. Therefore, the cartridge B can be downsized. The movable member 142 is provided on the side surface of the cartridge B. This permits high assembling property.

Thus, the contact 144*a* is brought into contact, by the rotation thereof, to the contact 141*a* which is stationary Ad in a stand-by state at the electrical contact position. The contact 141*a* slides on the contact 141*a* after the contact 144*a* is thus contacted to the contact 141*a*. Therefore, foreign matter, developer or the like can be removed from between the contacts. In this manner, the reliability of establishment of electrical connection between the contacts can be improved.

In the foregoing embodiments, when the cartridge B is mounted to the main assembly of the apparatus A, the charging member, more particularly, the charging roller 107 (process means) receives the voltage from the main assembly of the apparatus 100 through the charging output contact 144*a* as the output contact and the charging input electrical contact 141*a* as the input electrical contact.

However, the present invention is not limited to such a structure. In an alternative, using structures similar to those described in the foregoing, when the cartridge B is mounted to the main assembly of the apparatus A, the developing roller 110 receives the voltage from the main assembly of the apparatus 100 through a development output contact (unshown) as the development output contact and the development input electrical contact (unshown) as the input electrical contact. In a further alternative, voltages may be supplied to the charging roller 108 and to the developing roller 110. Thus, the process means is enabled.

Therefore, the following embodiments will be described with respect to the charging roller 108 and/or developing roller 110, but the present invention is not limited to such examples. The present invention is applicable to voltage supply from the main assembly of the apparatus 100 to another process means such as the developing roller 110.

EMBODIMENT 2

Referring to FIG. 20–FIG. 26, the second embodiment will be described.

The cartridge B and the image forming apparatus 100 have substantially the same structures as with Embodiment 1. The same reference numerals as with the Embodiment 1 are assigned to the elements having the corresponding functions, and the detailed descriptions for such elements are omitted for simplicity.

Figure 20:
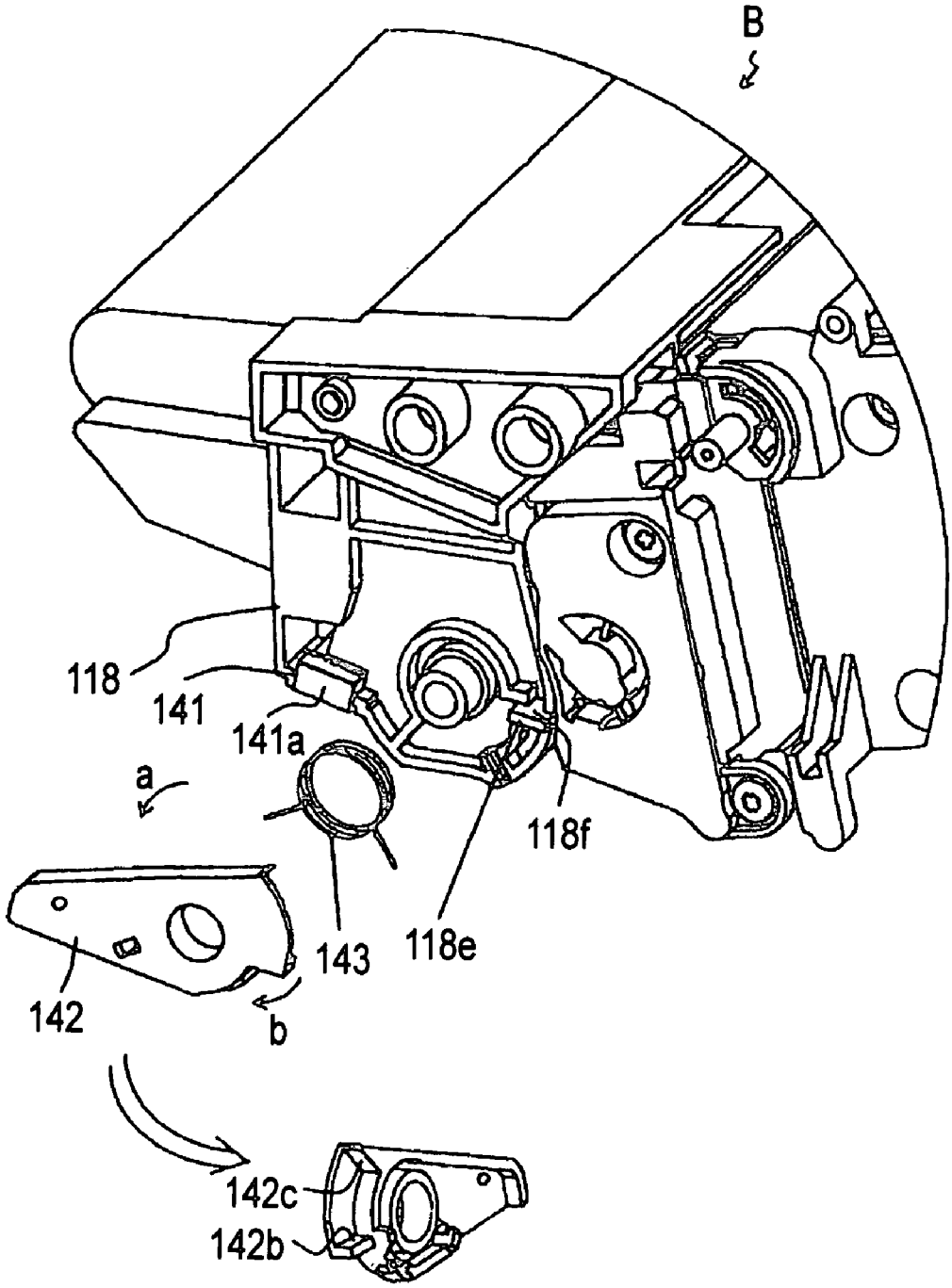
FIG. 20 illustrates a structure of the movable operation member of the process cartridge according to the embodiment of the present invention.

FIG. 20 is a perspective view of a cartridge B according to the second embodiment. On a side surface of the cartridge B, there is provided an electrical contact 141*a* of the cartridge charging contact member 141 (input electrical contact member) for applying a charging bias voltage to the charging roller 108.

A cartridge movable member (movable operation member) 142 is rotatably mounted on the drum frame 118. The movable member 142, similarly to Embodiment 1, is urged in the direction of an arrow a by a twisted coil spring 143 (elastic function member). The abutting portion 142*b* abuts to the abutting portion 118*e* of the drum frame 118. By this, the position thereof is determined in the rotational direction. When the movable member 142 rotates in the direction of the arrow b, the movable member 142 is rotatable until the abutting portion 142*c* thereof abuts to an abutting portion 118*f* of the drum frame 118.

Figure 21:
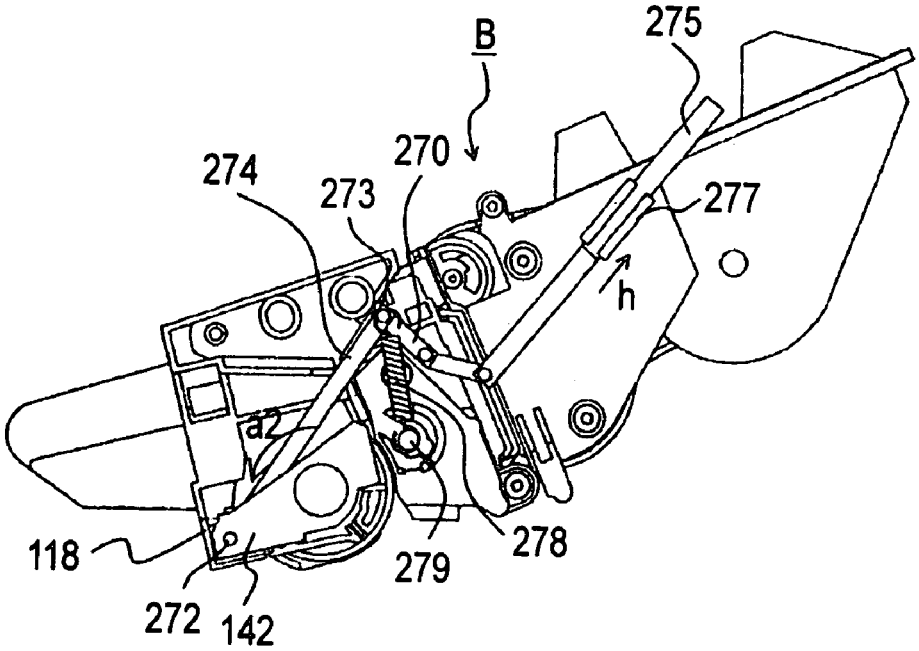
FIG. 21 illustrates a structure of the movable operation member of the process cartridge according to the embodiment of the present invention.
Figure 22:
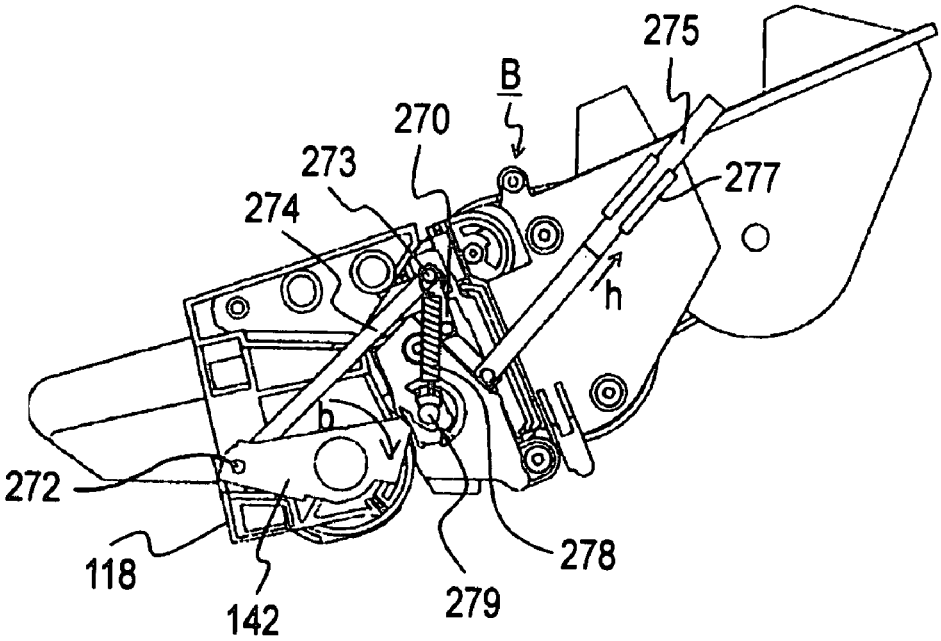
FIG. 22 illustrates a structure of the movable operation member of the process cartridge according to the embodiment of the present invention.

FIGS. 21 and 22 show a state in which the movable member 142 rotates in the direction of the arrows A and b described above.

In FIG. 21, the movable member 142 is rotated in the direction of the arrow an and is placed at a position. With this state, the electrical contact 141*a* is covered by the movable member 142. As shown in FIG. 22, when the movable member 142 rotates in the direction of the arrow b, the electrical contact 141*a* is exposed. That is, when the cartridge B is not mounted to the main assembly of the apparatus A, the movable member 142 is as shown in FIG. 21. Therefore, the electrical contact 141*a* is covered by the movable member 142. Thus, the electrical contact 141*a* is protected the movable member 142.

Figure 23:
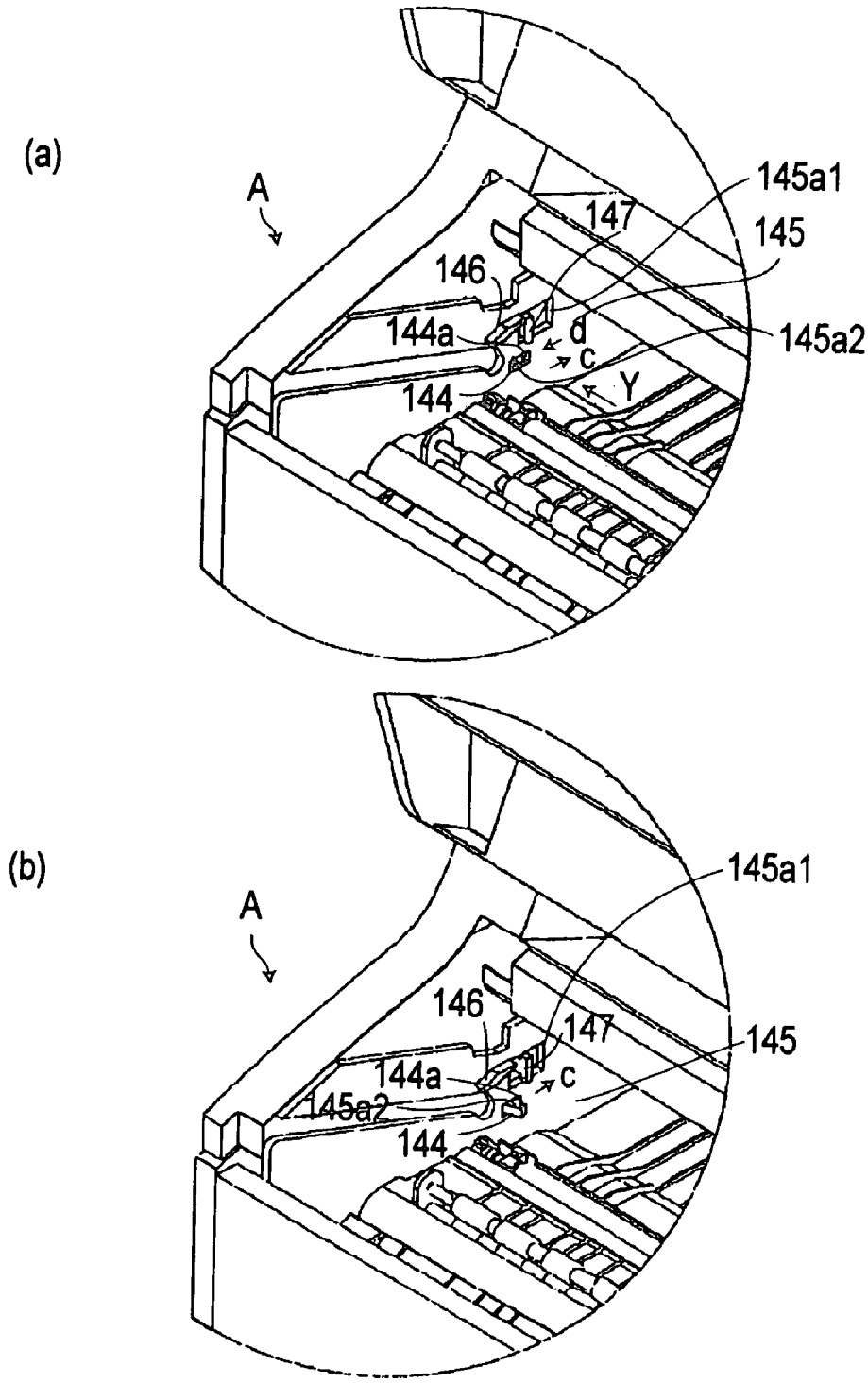
FIG. 23 illustrates a structure of an electrical contact portion in the main assembly of the image forming apparatus according to the embodiment of the present invention.

(1) Charging Contact Member of Main Assembly of Apparatus A:

Referring to FIG. 23, (a), (b), the description will be made as to the main assembly of the apparatus A to which the cartridge B is mountable.

Similarly to Embodiment 1 described above, an inner side surface of the main assembly of the apparatus A, there is provided a main assembly charging contact member 144 for applying a charging bias voltage by contact to the charging contact member 141. The fixed member of the main assembly 146 and the main assembly movable member 147 (displaceable member) have the similar structures as with Embodiment 1.

The movable member 147 moves in the direction of arrows c, d in interrelation with the operation of the user after the cartridge B is mounted in the main assembly of the apparatus A. More particularly, after the cartridge B is mounted in the main assembly of the apparatus A, the movable member 147 is pushed in the direction of the arrow c by manual operation of the movable member 142 by the user (FIG. 23, (a), (b)). In interrelation with the operation of the movable member 147, the contact 144*a* is projected beyond the inner side plate 145. By this, the contact 144*a* is contacted to the electrical contact 141*a*.

Figure 24:
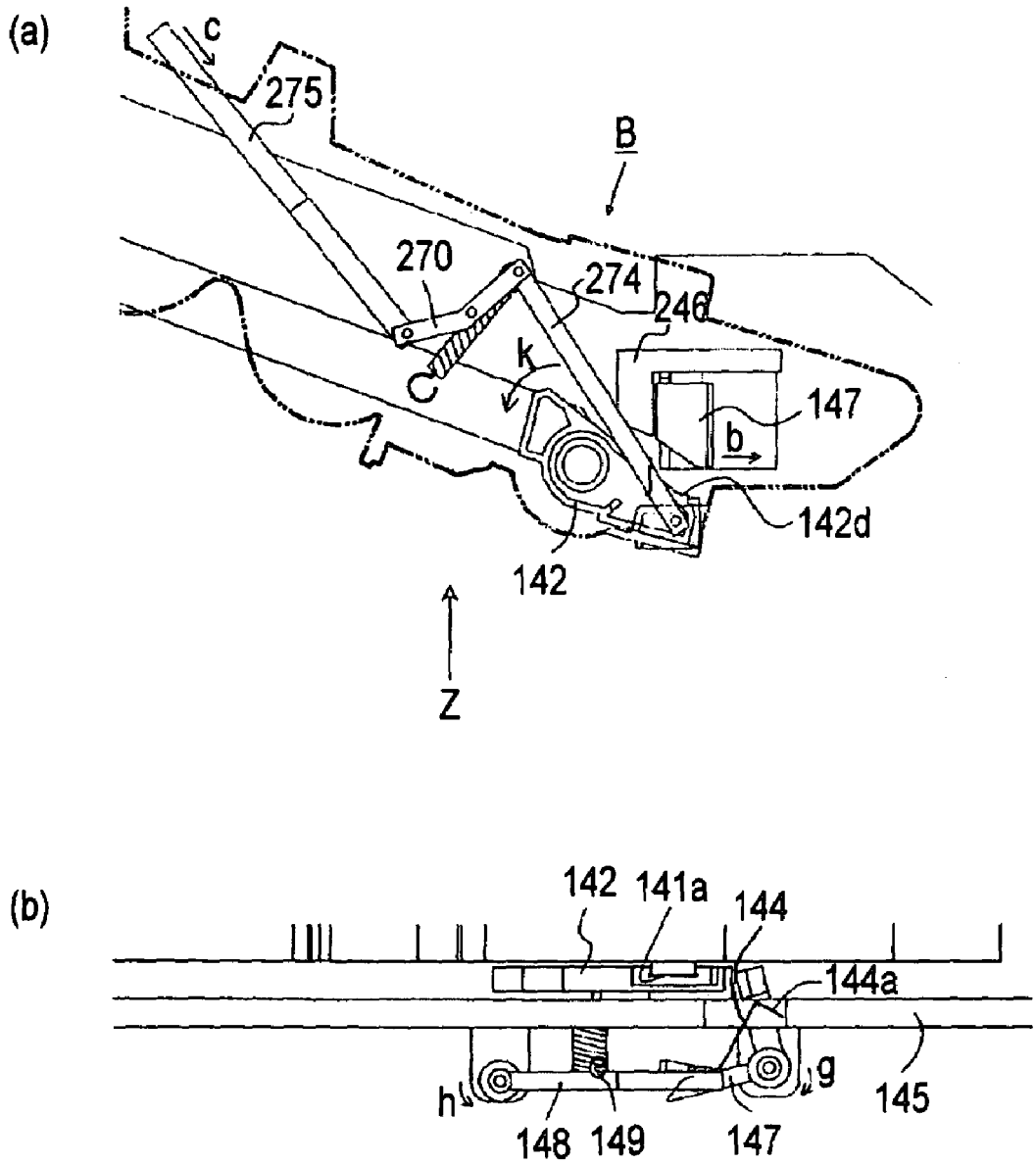
FIG. 24 illustrates structures of the movable operation member and the electrical contact of the image forming apparatus.
Figure 25:
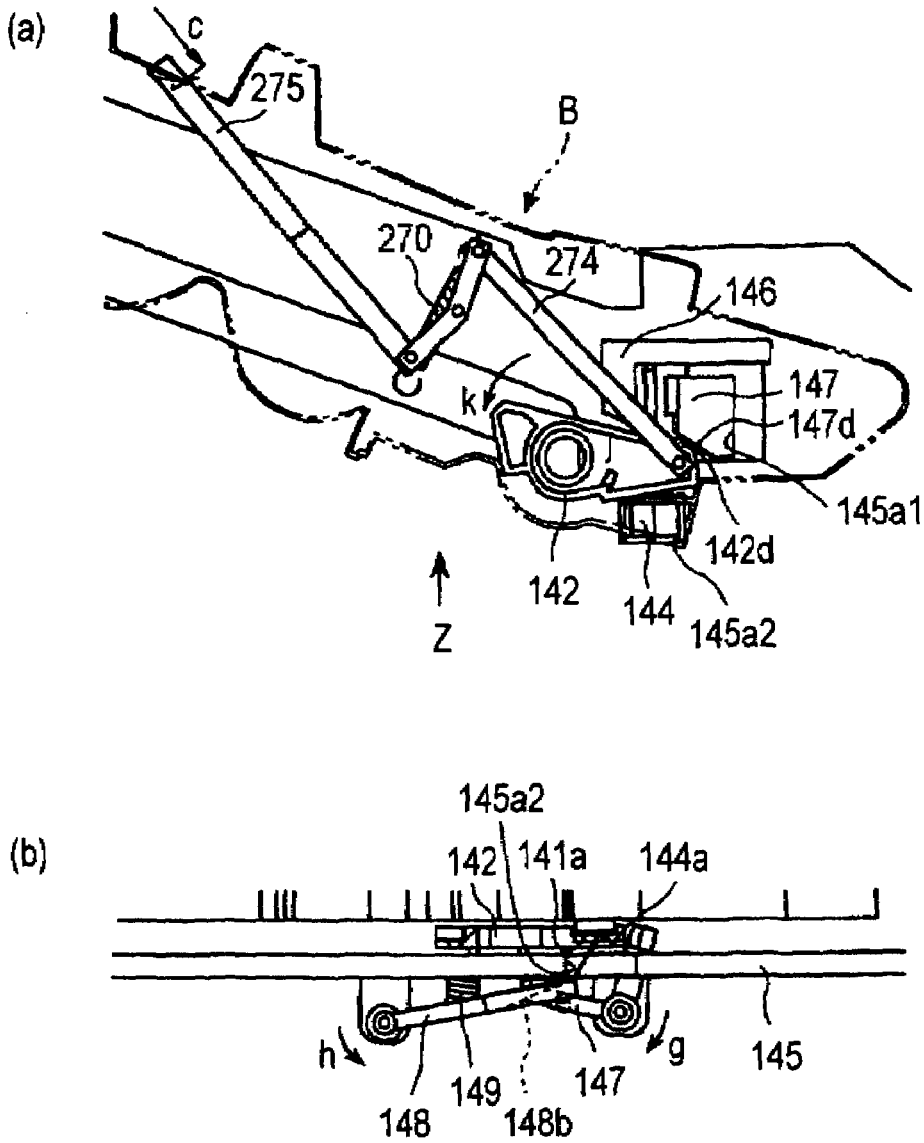
FIG. 25 illustrates structures of the movable operation member and the electrical contact of the image forming apparatus.

(2) Operations of Movable Member and Charging Contact Member:

The description will further be made as to the operation the movable member 142 and the main assembly charging contact member 144. FIGS. 24 and 25 are schematic view illustrating the operation of mounting the cartridge B into the main assembly of the apparatus A.

FIG. 24, (a) and FIG. 25, (a) are the views of the inner side plate 145 as seen from an inside of the main assembly of the apparatus A (as seen in the direction of arrow Y). FIG. 24, (b) and FIG. 25, (b) are views thereof in the direction of an arrow Z in FIG. 24, (a) and FIG. 25, (a).

FIG. 24 illustrates the behavier during the process of mounting the cartridge B into the apparatus A. FIG. 25, (a) and (b) shows a state in which the cartridge B is further inserted and is completely set.

In these Figures, the movable member 147, the charging contact member 144, the contact supporting member 148, the compression spring 149, the arm 270, said first link 274, the second link 275, the tension spring 278 and so on have the structures similar to those of Embodiment 1. Therefore, the movable member 147 is movable between a position where the contact member 144 projects beyond the inner side plate 145 and a position where it does not project out.

At this time, the movable member 142 is positioned by abutment between the abutting portion 142*c* and the abutting portion 118*f* of the drum frame 118 by a reaction force from the main assembly movable member 147.

In this embodiment, similarly to Embodiment 1, after the cartridge B is mounted to the main assembly of the apparatus A, the operator manually operate the second link 275 to rotate the movable member 142 in the direction of the arrow k. And, the movable member 142 rotates the main assembly movable member 147 in the direction of an arrow g. By doing so, the contact supporting member 148 rotates in the direction of an arrow h. The contact 144*a* is projected out of the inner side plate 145 through the opening 145*a*1 by the rotational motion thereof. By this, the contact 144*a* is brought into contact to the electrical contact 141*a*. Thus, the application of the charging bias voltage to the charging roller 108 from the main assembly of the apparatus A is enabled.

Thus, the contact 144*a* is brought into contact, by the rotation thereof, to the contact 141*a* which is stationary Ad in a stand-by state at the electrical contact position. The contact 141*a* slides on the contact 141*a* after the contact 144*a* is thus contacted to the contact 141*a*. Therefore, foreign matter, developer or the like can be removed from between the contacts. In this manner, the reliability of establishment of electrical connection between the contacts can be improved.

This embodiment provides the same advantageous effects as with the first embodiment.

More particularly, the electrical contact 141*a* is covered by the movable member 142 also in this embodiment. Therefore, the operator is effectively prevented from touching the electrical contact when the cartridge B is handled. In addition, the contact is protected from sweat of the user or grease, so that conduction defect can be prevented beforehand.

The electrical connection is established between the cartridge B and the main assembly of the image forming apparatus B by the operation of the operator per se after the cartridge B is set in the main assembly of the image forming apparatus A. By this, the operator can confirm the connection between the electrical contacts 141*a* and 144*a* by himself.

EMBODIMENT 3

Referring to FIG. 26–FIG. 30, the third embodiment will be described.

The same reference numerals as with the Embodiments 1 and 2 are assigned to the elements having the corresponding functions, and the detailed descriptions for such elements are omitted for simplicity. The same reference numerals as in Embodiments 1 and 2 are assigned to the elements having the corresponding functions in this embodiment, and the detailed description thereof is omitted for simplicity.

In the Embodiment 1, as shown in FIG. 12 and so on, the electrical contacts 141*a* is surrounded by a rib 118*g*. By this, the electrical contact 141*a* is not projected beyond the side surface of the drum frame 118, and as shown in FIG. 21, in Embodiment 2, the electrical contact 141*a* is completely covered by the movable member 142. Therefore, the input electrical electrical contact 141*a* is protected from the operator.

This embodiment shows other respective of the structures of the, electrical contact 141*a* and the movable member 142. Using such the movable members 142, the operator is effectively prevented from inadvertently touching the electrical contact 141*a*.

In FIG. 26 to FIG. 30, various examples of the cartridge movable member 142 are shown.

In the examples, the electrical contact 141*a* is disposed on a side surface of the drum frame 118 similarly to Embodiment 1 and Embodiment 2. The movable member 142 is supported and positioned in the similar manner to the embodiments.

Figure 26:
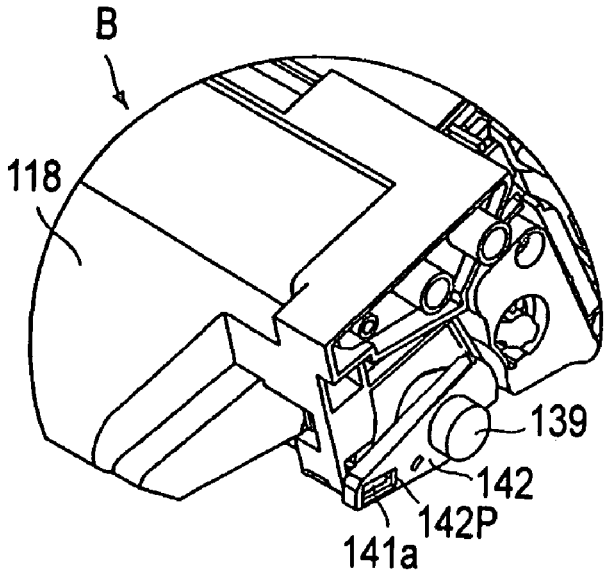
FIG. 26 illustrates a structure of the movable operation member of the process cartridge according to the embodiment of the present invention.

In the example of FIG. 26, similarly to Embodiment 2, the movable member 142 is placed at a position covering the electrical contact 141*a* in the stand-by state. However, the movable member 142 faced to the electrical contact 141*a* is provided with an opening 142*p*. In other words, the electrical contact 141*a* is not covered by the movable member 142. However, around the electrical contact 141*a*, there is provided a surface the movable member 142 which is higher than the surface of the electrical contact 141*a*. Thus, the contact 141*a* is surrounded by a portion of the movable member 142.

Figure 27:
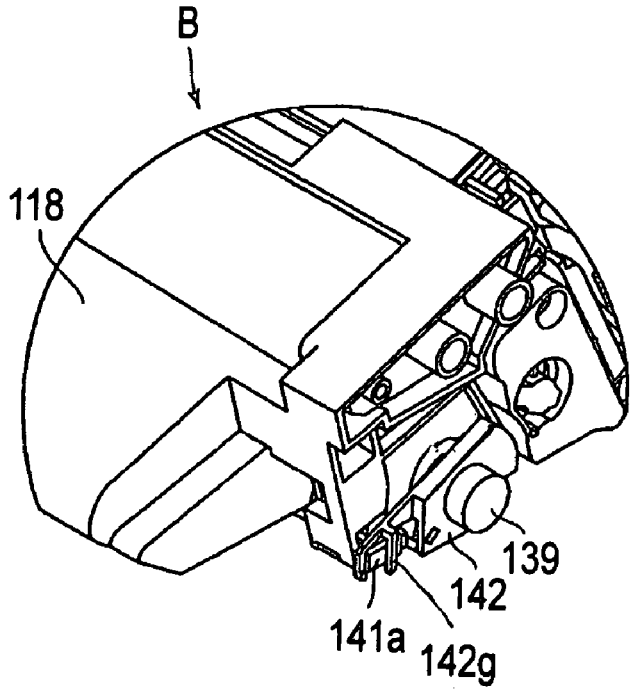
FIG. 27 illustrates a structure of the movable operation member of the process cartridge according to the embodiment of the present invention.
Figure 28:
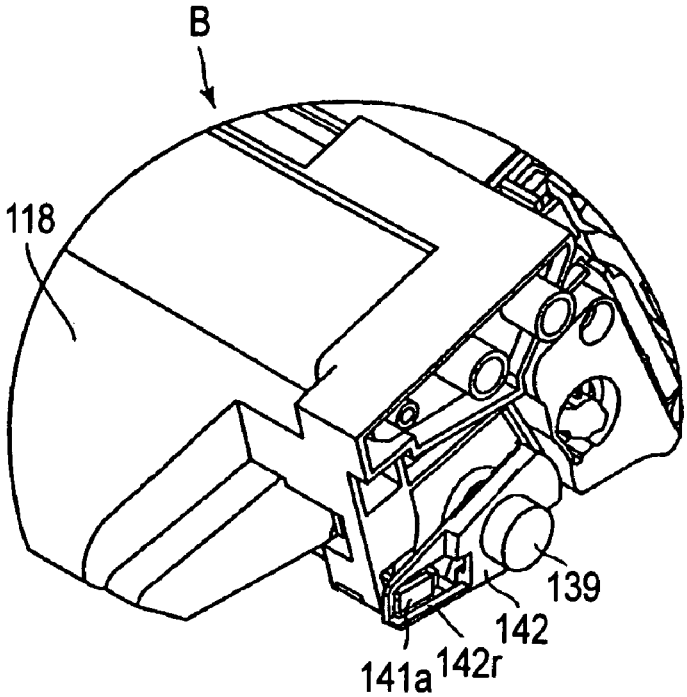
FIG. 28 illustrates a structure of the movable operation member of the process cartridge according to the embodiment of the present invention.
Figure 29:
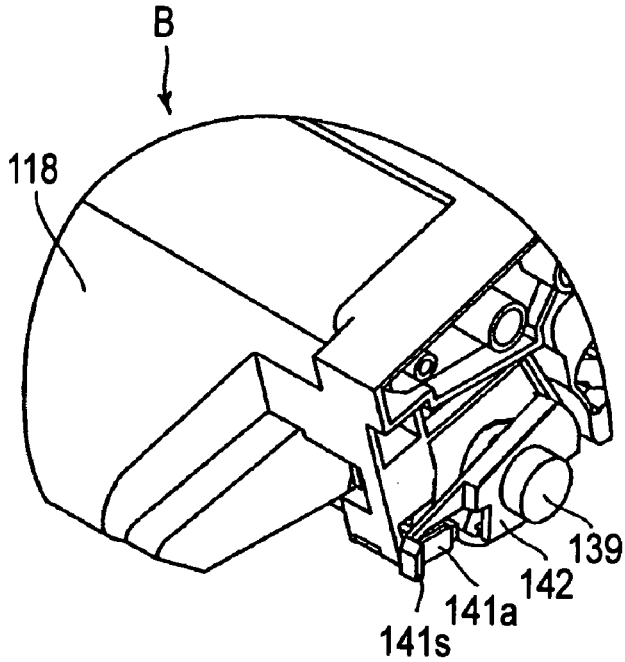
FIG. 29 illustrates a structure of the movable operation member of the process cartridge according to the embodiment of the present invention.
Figure 30:
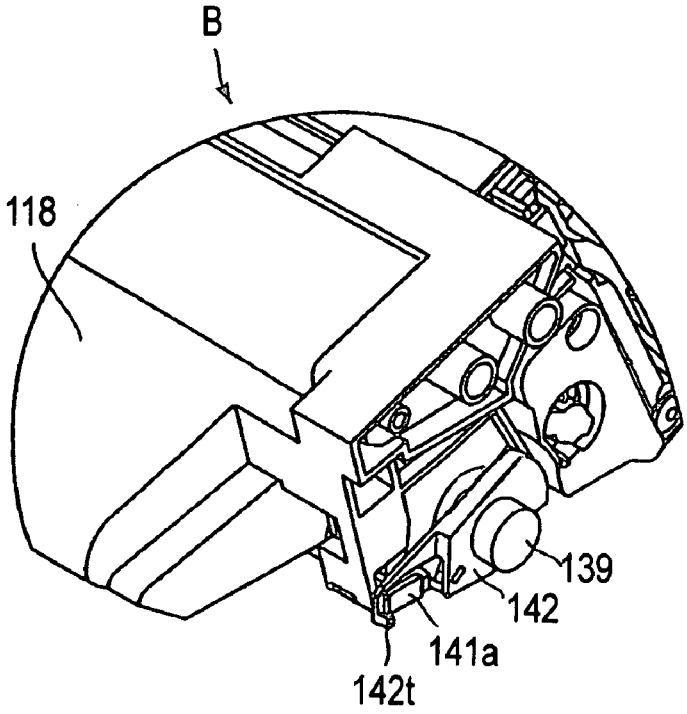
FIG. 30 illustrates a structure of the movable operation member of the process cartridge according to the embodiment of the present invention.

In the example of FIG. 27, the movable member 142 is provided with a rib 142*q*. The rib 142*q* covers a part of an upper portion of the electrical contact 141*a* when the movable member 142 is in the stand-by state. In the examples of FIGS. 28, 29 and 30, the movable member 142 is provided with projected portions (surface s) 142*r*, 142*s* Ad 142*t*. The projected portions 142*r*, 142*s* Ad 142*t* is extended partly around the electrical contact 141*a* such that top surface thereof if higher than the surface of the electrical contact 141*a* in the stand-by state of the movable member 142.

More particularly, in the example of FIG. 28, the projected portion 142*r* is provided on the movable member 142 so as to be below the electrical contact 141*a* in the Figure. In the example of FIG. 29, the projected portion 142*s* is provided on the movable member 142 so as to be at the side of the electrical contact 141*a* in the Figure. In the example of FIG. 30, the projected portion 142*t* is provided on the movable member 142 so as to be positioned at the lower corner portion of the electrical contact 141*a* in the Figure.

As will be understood, in these examples, similarly to Embodiment 1 and Embodiment 2, the movable member 142 is provided with a projected portion which is higher than the electrical contact 141*a* adjacent the electrical contact 141*a*. Therefore, when the user manipulate th cartridge B, the user is prevented from touching the electrical contact 141*a*. Thus, the contact 141*a* is protected from sweat of the user or grease, so that conduction defect can be prevented beforehand.

After the cartridge B is set in the main assembly of the apparatus A, the electrical connection is established between the cartridge B and the main assembly of the apparatus A by a manipulation of the user or operator. By this, the user can substantially confirm the establishment of the electrical connection.

This embodiment provides the advantageous effects as with Embodiment 1 and Embodiment 2.

EMBODIMENT 4

Referring to FIG. 31–FIG. 34, the fourth embodiment of the present invention will be described.

In this embodiment, the operation of the second link 275 in Embodiment 1 and Embodiment 2, is interrelated with the operation of closing the cartridge door 109 (main assembly openable member).

In this embodiment, the structures of cartridge B and the image forming apparatus 100 is similar to those of embodiment 1–Embodiment 3. The same reference numerals as in Embodiments 1, 2 and 3 are assigned to the elements having the corresponding functions in this embodiment, and the detailed description thereof is omitted for simplicity.

Figure 33:
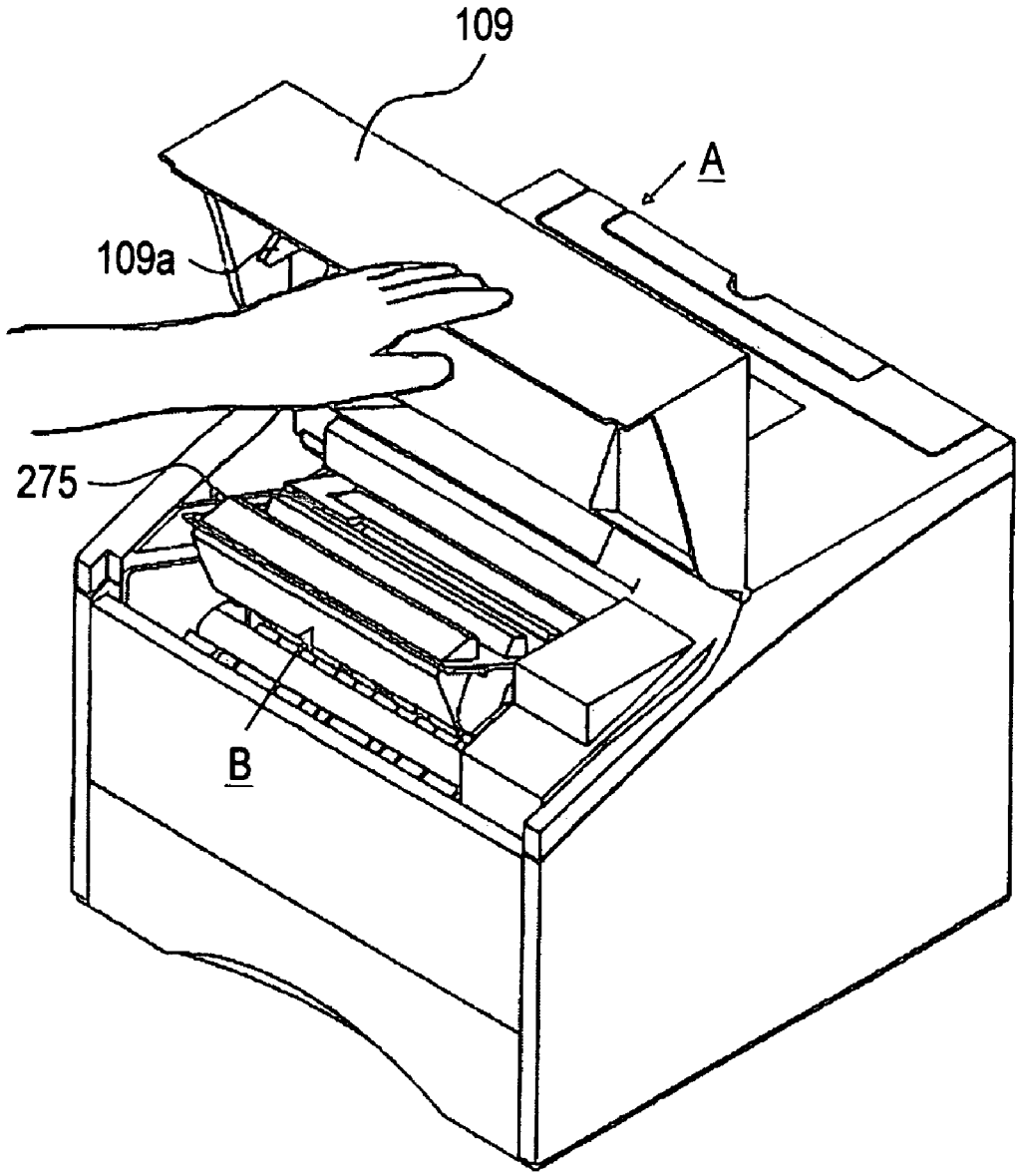
FIG. 33 is a perspective view of an image forming apparatus according to an embodiment of the present invention.

According to this embodiment, the second link 275 of Embodiment 1 and Embodiment 2 are interrelated with the closing operation the door 109 (FIG. 33).

Figure 31:
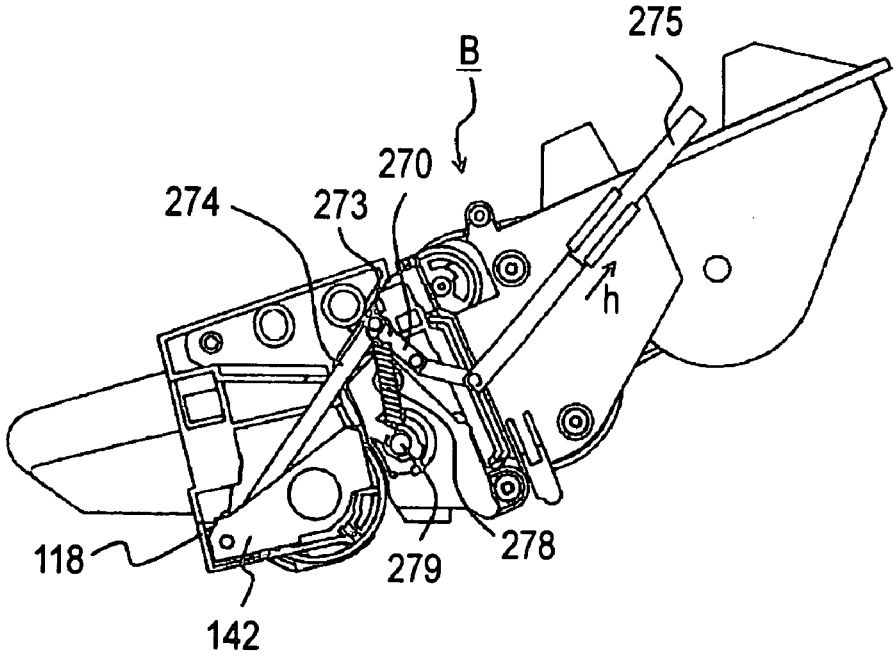
FIG. 31 illustrates a structure of the movable operation member of the process cartridge according to the embodiment of the present invention.

Referring to FIG. 31, the description will be made as to the structure of the movable member 142.

As shown in the Figure, the movable member 142 is rotatably mounted to the drum frame 118 at the side surface of the cartridge B. Similarly to Embodiment 1 and Embodiment 2, the movable member 142 is connected with the first link 275 through the first link 274 and the arm 270. The supporting structures of the links Ad arms are similar to those of Embodiment 1 and Embodiment 2. Therefore, detailed description will be omitted for simplicity.

In this embodiment, the tension spring 278 is stretched between the connecting portion 273 and the shaft portion 279, too. However, the position of the shaft portion 279 is different from that in Embodiment 1.

Figure 32:
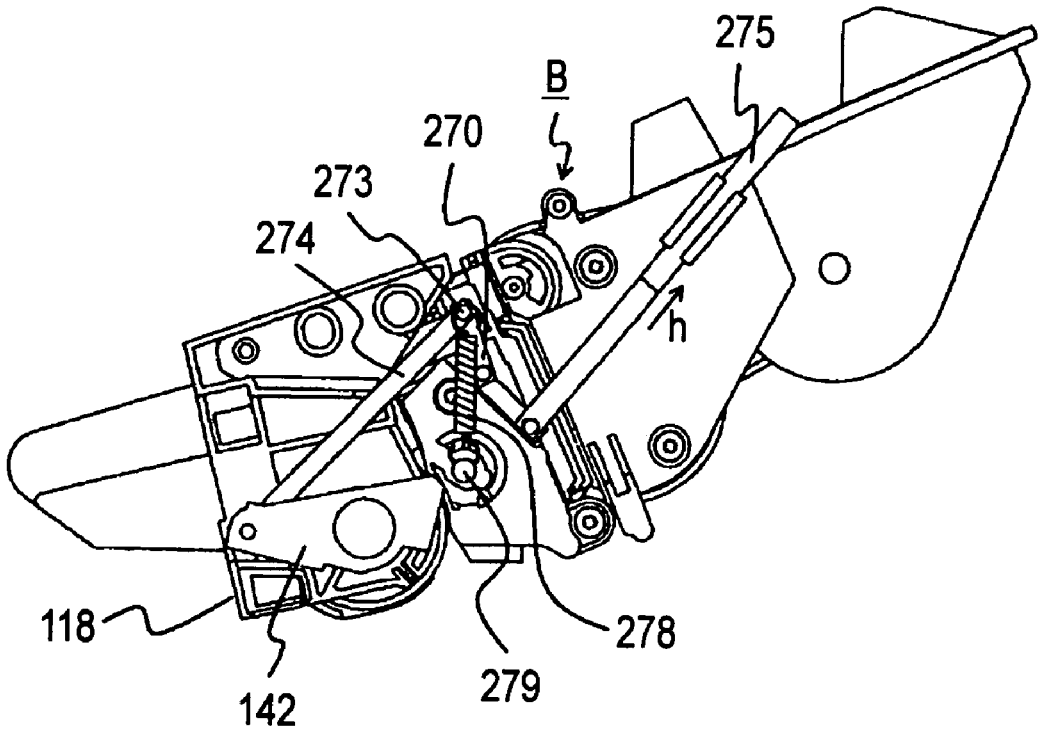
FIG. 32 illustrates a structure of the movable operation member of the process cartridge according to the embodiment of the present invention.

More particularly, as shown in FIGS. 31, 32, the tension spring 278 is disposed at such a position that arm 270 normally receives a force in the counterclockwise direction in the Figure. Therefore, the movable member 142 is always subjected to the rotational force in the counterclockwise direction. The second link 275 normally receives a force in the direction of an arrow h. In FIG. 31, the movable member 142 is rotated in the couterclockwise direction in the Figure, and is positioned. In FIG. 32, the movable member 142 is rotated in the clockwise direction and is positioned.

FIG. 33 shows a state in which the cartridge B is set in the main assembly of the apparatus A. The structures of the main assembly charging contact member 144 and the lever for operating it are similar to those in Embodiment 1 and Embodiment 2. The description thereof is omitted, accordingly.

An end of a second link 275 for rotating the movable member 142 is projected from the cartridge B. Inside the cartridge door 109, there is provided a rib 109*a* for pushing the second link 275. The door 109 can be opened or closed relative to the main assembly of the apparatus. The door 109 opens relative to the main assembly of the apparatus (FIG. 33), and enable mounting and demounting of the cartridge B relative to the main assembly of the apparatus.

Figure 34:
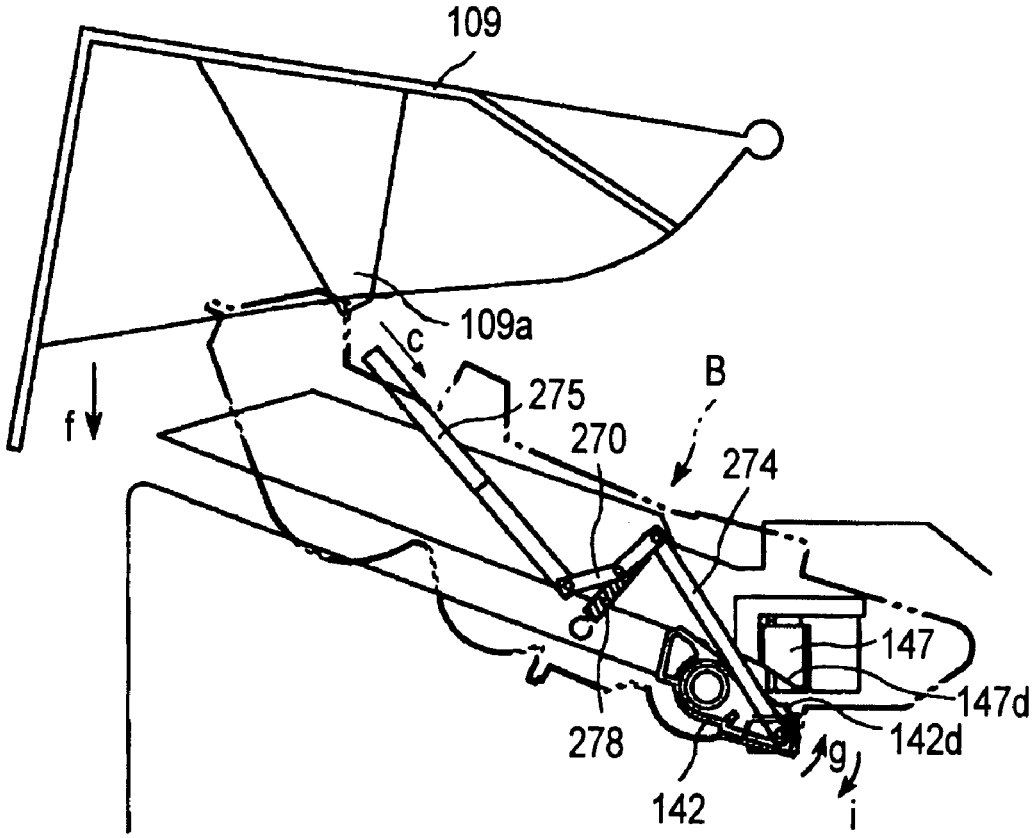
FIG. 34 illustrates structures of the movable operation member and the electrical contact of the image forming apparatus.
Figure 35:
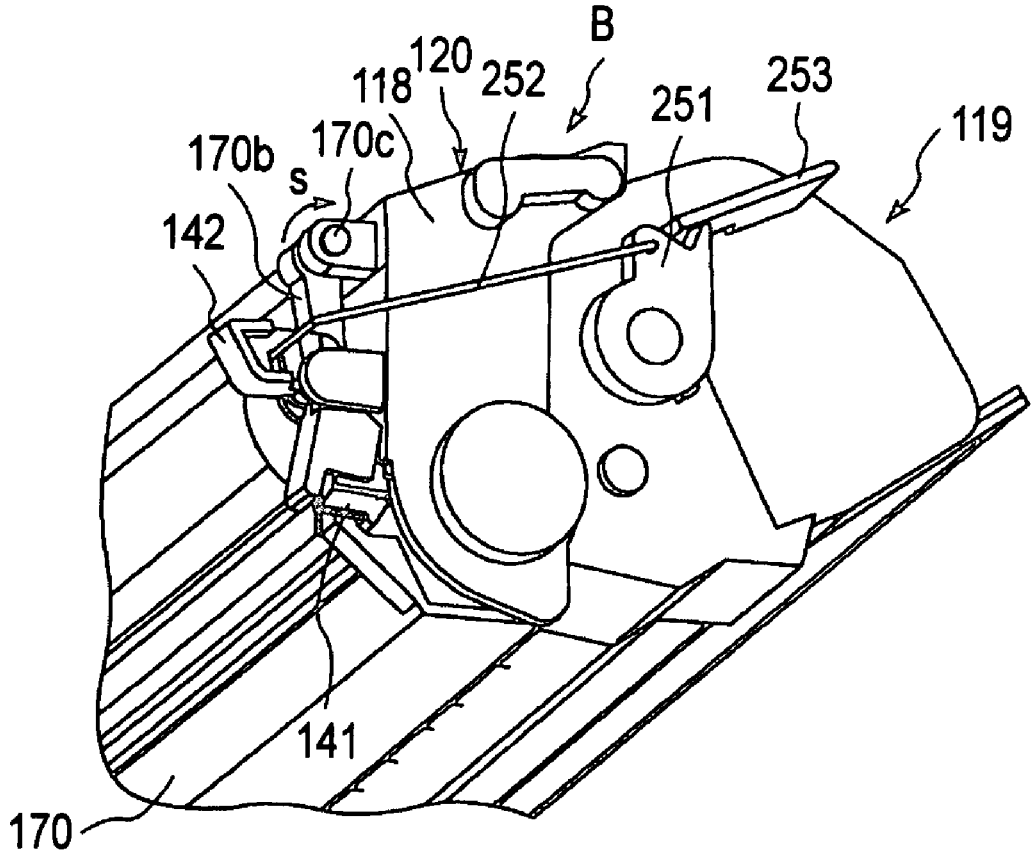
FIG. 35 is a perspective view showing a structure of a movable operation member of a process cartridge according to a further embodiment of the present invention.
Figure 36:
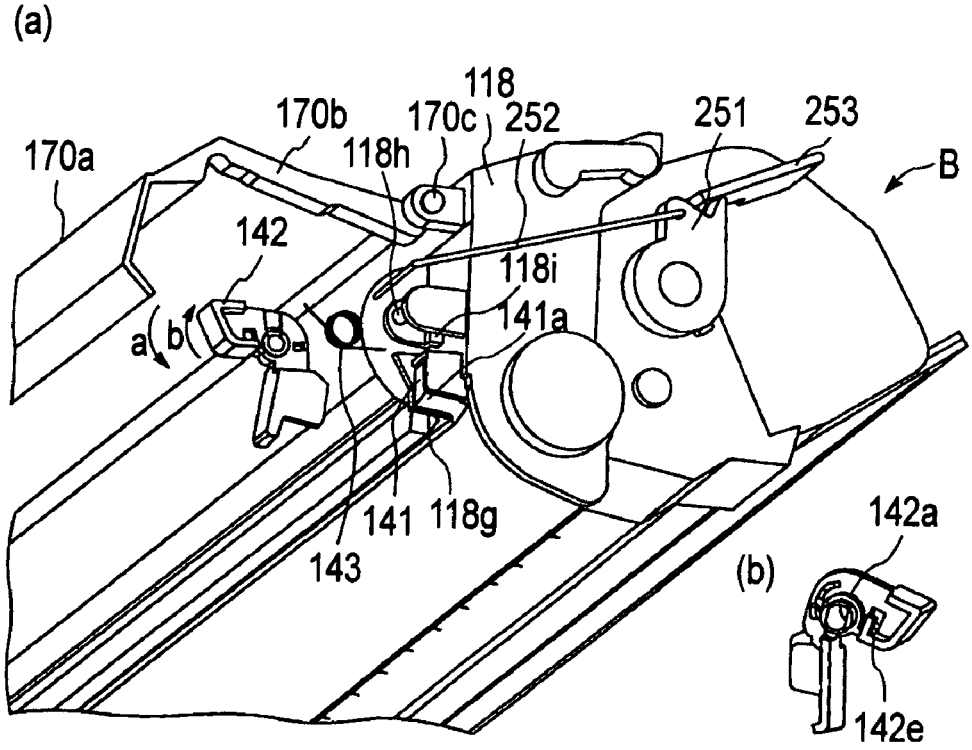
FIG. 36 is a perspective view showing a structure of a movable operation member of a process cartridge according to a further embodiment of the present invention.

As shown in FIG. 34, after the cartridge B is mounted to the main assembly of the apparatus A, the operator manually closes the door 109 in the direction of an arrow f (FIG. 33). Then, the rib 109*a* pushes the end of the second link 275 (operation member) in the direction of the arrow C. By doing so, similarly to Embodiment 1 and Embodiment 2, the movable member 142 rotates in the direction of an arrow g through the arm 270 and the first link 274. By this, the free end portion or leading end portion 142*d* of the movable member 142 is contacted to an inclined surface 147*a* of the main assembly movable member 147. Thus, in interrelation with the rotation of the movable member 142, the main assembly movable member 147 moves.

At this time, the abutting portion 142*c* and the abutting portion 118*f* of the drum frame 118 abut to each other by a reaction force received from the main assembly movable member 147. By this, the movable member 142 is correctly positioned (FIGS. 12, 20).

Then, the electrical contact 144*a* is projected into the inside of the main assembly of the apparatus (into the cartridge mounting portion 130*a*) by the rotational movement, in interrelation with the main assembly movable member 147. And, the electrical contact 144*a* moves to contact to the stationary electrical contact 141*a*. By this, the application of the charging bias to the charging roller 108 is enabled.

Thus, the contact 144*a* is brought into contact, by the rotation thereof, to the contact 141*a* which is stationary Ad in a stand-by state at the electrical contact position. The contact 141*a* slides on the contact 141*a* after the contact 144*a* is thus contacted to the contact 141*a*. Therefore, foreign matter, developer or the like can be removed from between the contacts. In this manner, the reliability of establishment of electrical connection between the contacts can be improved.

According to this embodiment, the link 275 (operation member) is operated by the operator manually closes the door 109. In the Embodiment 1 and Embodiment 2, the operator directly manipulate the link 275.

When the cartridge B is to be dismounted from the main assembly of the apparatus A, the door 109 is opened. As described in the foregoing, the movable member 142 is rotated in the direction of an arrow i by the function of the tension spring 278 (FIG. 34), and returns to the original position where the movable member 142 protects the charging bias contact.

According to this embodiment, the same advantageous effects as with Embodiment 1 and Embodiment 2 are provided, and in addition, there is no need of special manipulation by the user to establish the electrical contacts be the contacts. This is because the electrical connection is automatically established by the user closing the door 109. This is accomplished by the interrelation between the movement the link 275 (operation member) and the closing of the door 109.

EMBODIMENT 5

Referring to FIG. 35–FIG. 43, the fifth embodiment will be described.

The cartridge B and the image forming apparatus 100 have substantially the same structures as with Embodiments 1, 2 and 4. The same reference numerals as with the Embodiments 1, 2 and 4 are assigned to the elements having the corresponding functions, and the detailed descriptions for such elements are omitted for simplicity.

(1) Cartridge Movable Member:

FIG. 35–FIG. 40 show cartridges B according to the embodiment of the present invention. The cartridge B comprises a drum unit 120 and a developing unit 119. The electrical contact 141*a* for applying the charging bias voltage to the charging roller 108 is disposed adjacent a longitudinal end at a leading side of the cartridge B with respect to the mounting direction of the cartridge B into the main assembly of the apparatus A. The electrical contact 141*a* is surrounded by a rib 118*g* so as not to project beyond the surface of the drum frame 118. A region of the charging electrical contact member 141 adjacent the corner portion is A electrical contact (input electrical contact) 141*a* for electrical contact with an electrical contact (output contact) 144*a* of the main assembly charging contact member 144 provided in the main assembly of the apparatus A.

Figure 39:
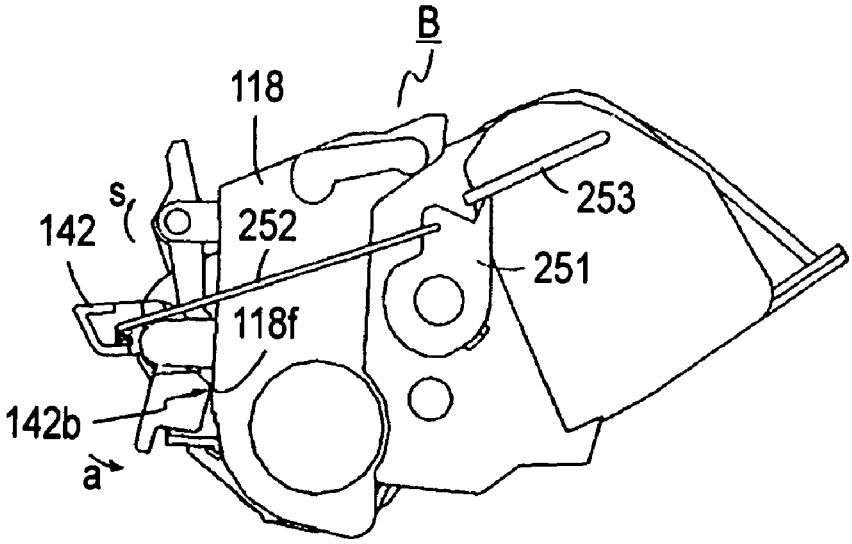
FIG. 39 is a side view of a structure of a movable operation member according to a further embodiment of the present invention.
Figure 40:
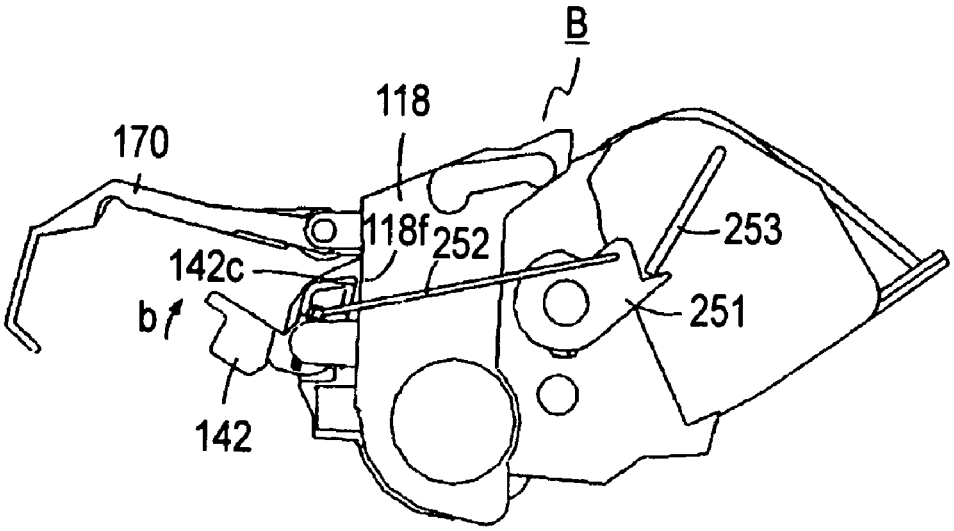
FIG. 40 is a side view of a structure of a movable operation member according to a further embodiment of the present invention.

The drum frame 118 is provided with a drum shutter 170 for protecting a photosensitive drum 107. The drum shutter 170 has a shutter portion 170*a* covering the photosensitive drum 107 and supporting arms 170*b* at the opposite ends, and is rotatable about a pivot. The drum shutter 170 rotates in the direction of an arrows in interrelation with the cartridge B mounting operation into the main assembly A of the apparatus Ad moves from a protection position for protecting the photosensitive drum 107 (FIG. 39) to an exposing position for exposing the photosensitive drum 107 (FIG. 40). On the drum frame 118, a cartridge movable member 142 (movable operation member) is rotatably mounted on a shaft 118*i*. The cartridge movable member 142 is disposed outside a path when the supporting arm 170*b* rotates in the direction of the rotational axis of the drum shutter 170.

The cartridge movable member 142 has a twisted coil spring 143 (elastic function member) in the cylindrical portion 142*a*, and one of arm portions 143*a* is hooked on a locking portion 142*e*. The other arm portion 143*b* is mounted on the locking portion 118*i* of the drum frame 118. By this, the movable member 142 is urged to rotate in the direction of an arrow a. An abutting portion 142*b* of the movable member 142 urged by the elastic force of the coil spring 143 is abuted to an abutting portion 118*e* provided on the drum frame 118. By this, the movable member 142 is positioned in the rotational direction (FIG. 39).

When the movable member 142 rotates in the direction of the arrow b, the movable member 142 is rotatable until the abutting portion 142*c* abuts to the abutting portion 118*f*. The abutting portion 118*f* is provided on the drum frame 118.

A cam member 251 and a link arm member 252 are provision between the movable member 142 and a grip portion 300 at the same side as the side having the movable member 142 with respect to the longitudinal direction of the cartridge B. The cam member 251 is connection so as to interrelate with the operation of the movable member 142 by a link arm member 252. Here, the grip portion 300 is provided on the cartridge B. More particularly, the grip portion 300 is disposed on the top surface of the toner accommodating container 114 the cartridge B. The grip portion 300 functions to facilitate mounting and demounting of the cartridge B into and out of the main assembly of the apparatus.

Figure 37:
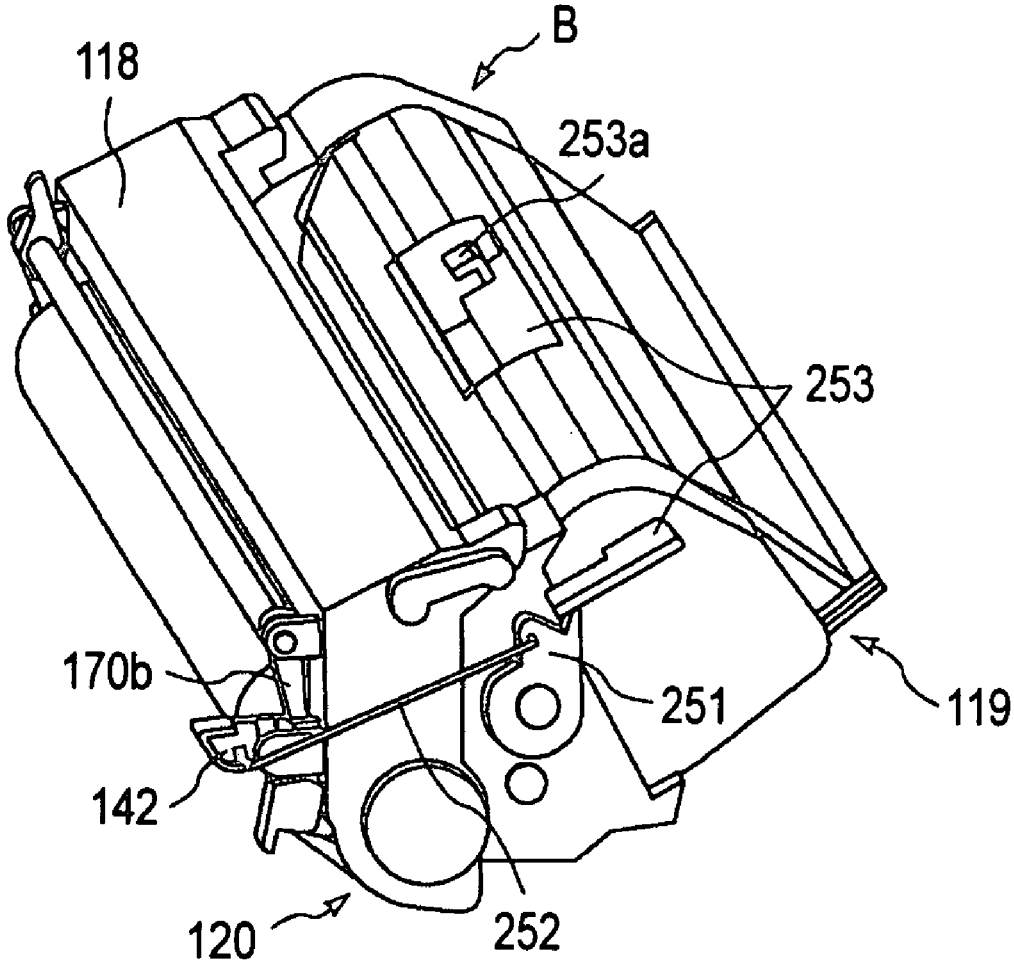
FIG. 37 is a perspective view showing a structure of a movable operation member of a process cartridge according to a further embodiment of the present invention.
Figure 38:
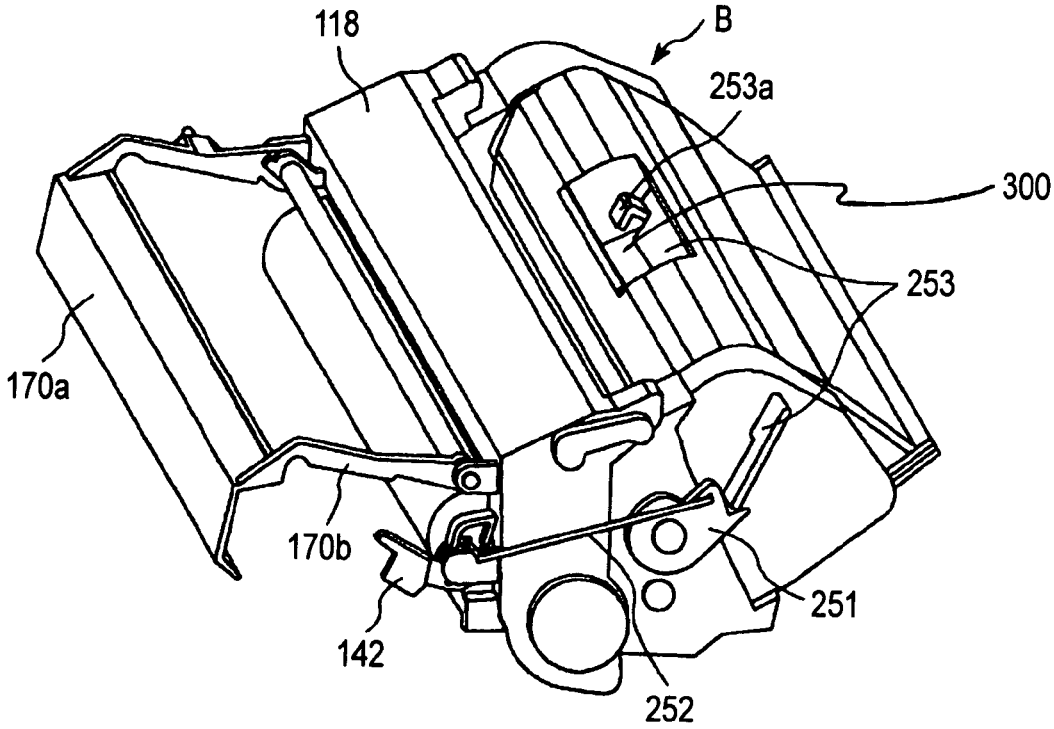
FIG. 38 is a perspective view showing a structure of a movable operation member of a process cartridge according to a further embodiment of the present invention.

The grip portion 300 is provided with an operation lever 253 (operation member) for operating the cam member 251. The operation lever 253 is provided with a projected portion 253*a* for returning the lever 253 to a stand-by position (FIGS. 37, 38).

The link arm member 252, the cam member 251 and the operation lever 253 are connected with the movable member 142. Therefore, an urging force (elastic force) is normally applied in the direction of the arrow a.

By manual and direct operation of the operation lever 253 by the user after mounting of the cartridge B in main assembly of the apparatus A, the movable member 142 is rotated in interrelation with the operation lever 253.

The embodiment, the lever 253 is positioned where the grip portion 300 is provided. The lever 253 is so disposed that user inadvertently actuate the lever 253 when the user grips the grip portion 300 to mount the cartridge B into the main assembly of the apparatus A or to transport the cartridge B.

(2) Charging Contact Member Provided in Main Assembly of Image Forming Apparatus.

The description will be made as to the main assembly A of the apparatus to which the cartridge B is mountable.

Figure 41:
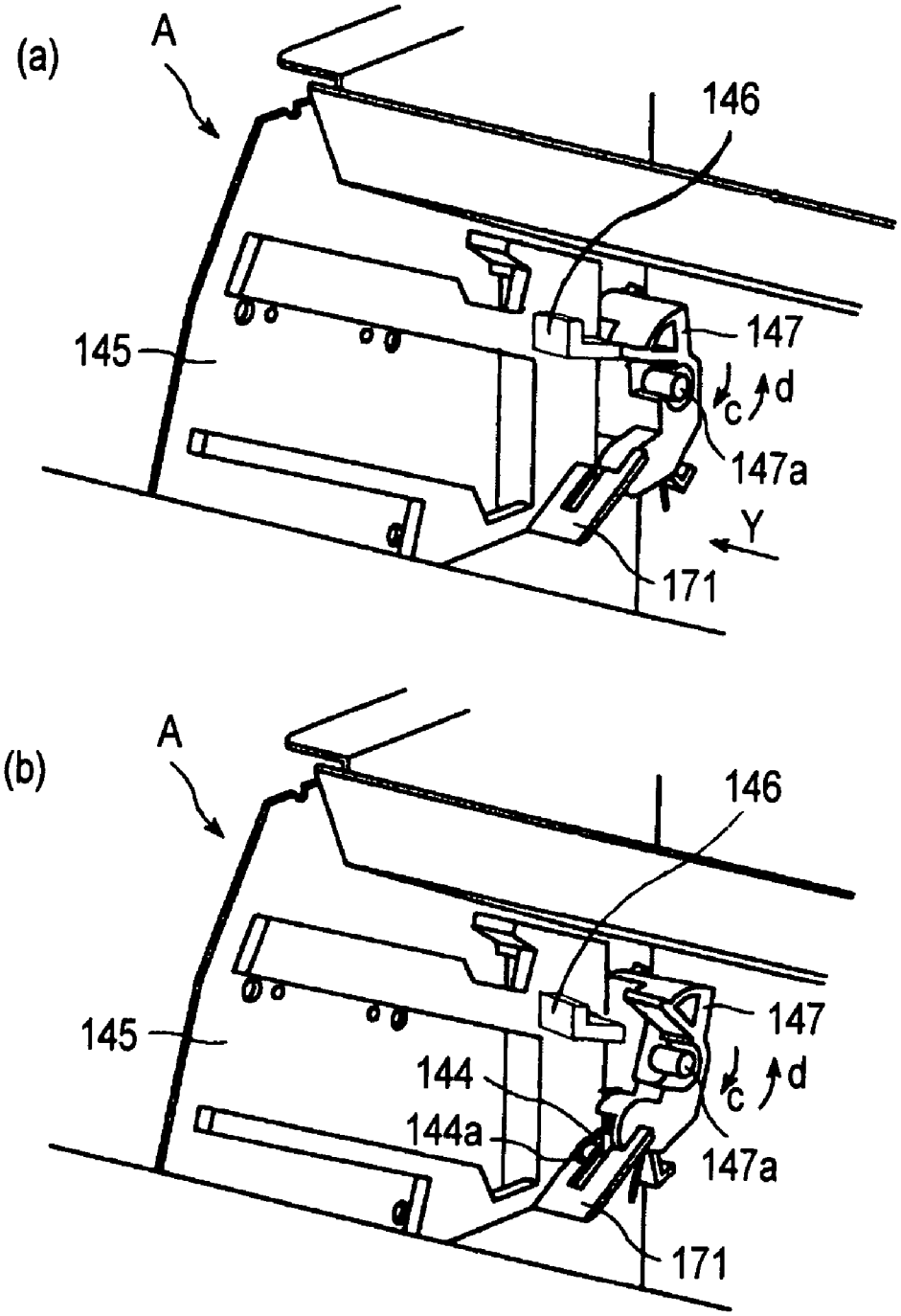
FIG. 41 is a perspective view of a connecting portion and a mounting portion of the main assembly of the apparatus for mounting the process cartridge according to a further embodiment of the present invention.

As shown in (a) and (b) of FIG. 41, inside the main assembly of the apparatus A, there is provided a main assembly charging contact member 144 for applying a charging bias voltage to the charging roller 108 by contact to the electrical contact 141*a*. When the cartridge B is not mounted to the main assembly of the apparatus A, the main assembly charging contact member 144 is in a retracted position where it is not projected from the cover 171 provided on an inner surface of the main assembly of the apparatus A (FIG. 41). The contact member 144 is connected to a high voltage electric circuit (voltage source circuit E) in the main assembly of the apparatus A by lead lines or the like.

Figure 43:
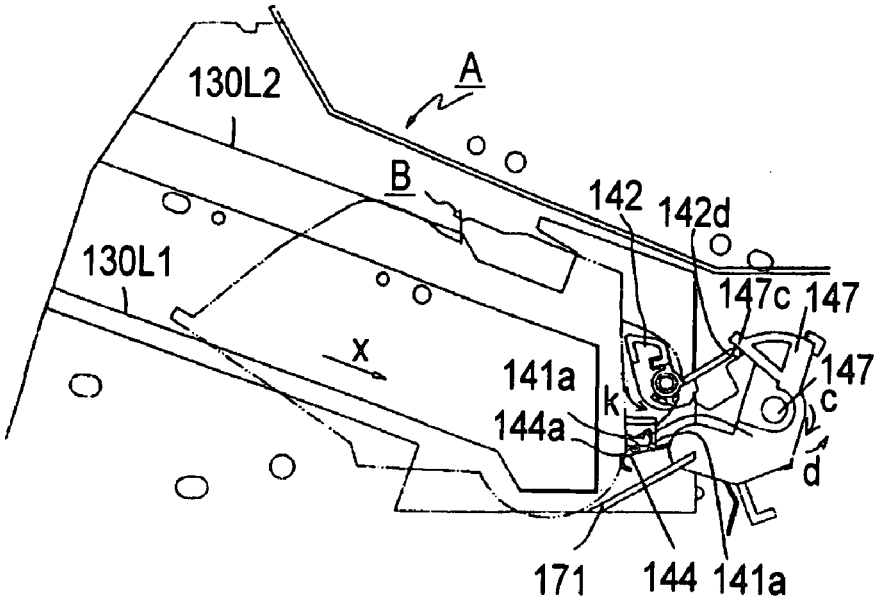
FIG. 43 illustrates structures of the movable operation member and the electrical contact of the image forming apparatus.

The main assembly movable member 147 (displaceable member) is rotatable about a center of the shaft portion 147*a*. The operator or user manipulate the lever 253 provision in the cartridge B. As shown in FIG. 43, the main assembly movable member 147 is pushed by the movable member 142 to rotate in the direction of the arrow c. The rotation of the movable member 147 is effective to project the contact member 144 by the rotational movement. Then, the electrical contact 144*a* is contacted the electrical contact 141*a*.

Figure 42:
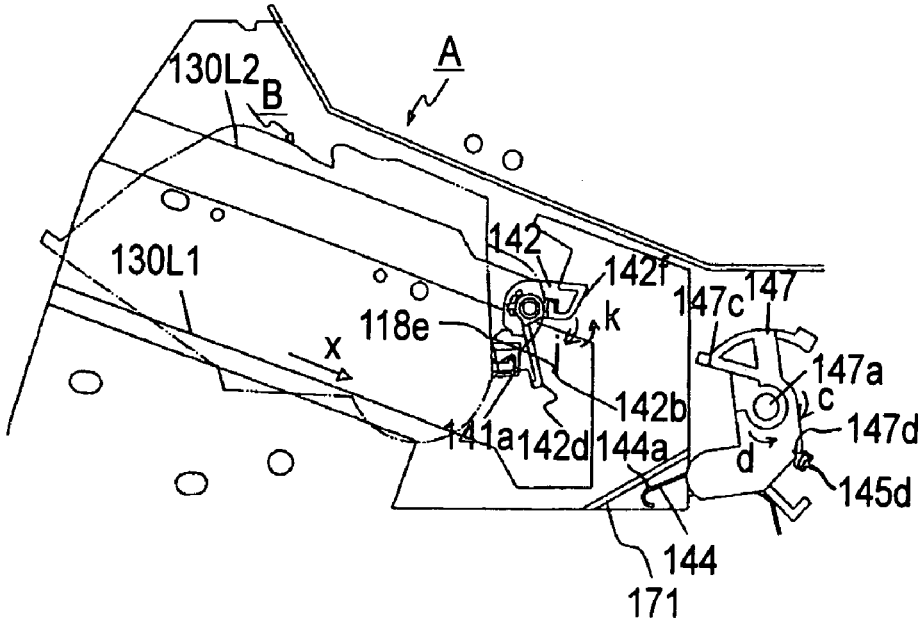
FIG. 42 illustrates structures of the movable operation member and the electrical contact of the image forming apparatus.

(3) Operations of Movable Member and Charging Contact Member:

The description will further be made as to the operation of the contact member 144. FIG. 42 is a schematic view illustrating an operation when the cartridge B is main assembly of the apparatus A is inserted into the apparatus.

FIG. 42 is a view of an inner side plate 145 provided in the main assembly of the apparatus A as seen from an inside of the main assembly of the apparatus (in the direction of arrow Y in FIG. 41). FIG. 42 shows a state in which the cartridge B is set in the main assembly of the apparatus A, FIG. 43 shows a state in which after the cartridge B is mounted to the main assembly of the apparatus A, the user carries out the operation.

As shown in FIG. 42, the main assembly movable member 147 is rotatably supported by the inner side plate 145 for rotation about the shaft portion 147*a*. The contact member 144 is mounted on the main assembly movable member 147. The main assembly movable member 147 is urged in the direction of an arrow d by A elastic force of the compression spring (unshown) (elastic function member). The main assembly movable member 147 is positioned by contact of the abutting portion 147*d* to the abutting portion 145*d* provided in the inner side plate 145. At this time, the contact member 144 is positioned at the retracted position where the contact member 144 is prevented from projecting into the main assembly of the apparatus A by the cover 171 provided in the inner side of the main assembly.

The cartridge B is inserted in the direction of an arrow X into the main assembly of the apparatus A along mounting guide portions 130L1, 130L2.

At the position shown in FIG. 42, as described hereinbefore, the movable member 142 is urged in the direction of an arrow j by the elastic force of the spring 143, and stops at a position where the abutting portion 142*b* and the abutting portion 118*e* are abuted to each other. The contact 144*a* is located at a position not projecting beyond the cover 171.

The user further inserts the cartridge B beyond the position shown in FIG. 42. Finally, the cartridge B is completely mounted to the mounting portion 130*a*. Thereafter, the user manually operate the operation lever 253 (operation member) of the cartridge B. This rotates the movable member 142 in the direction of an arrow k. Therefore, the engaging portion 142*d* of the movable member 142 pushes one end portion 147*c* of the main assembly movable member 147. This rotates the main assembly movable member 147 in the direction of the arrow c. And, the contact 144*a* thus uncovered and projected is contacted to the stationary electrical contact 141*a*.

At this time, by the reaction force from the movable member 147, the abutting portion 142*c* the abutting portion 118*f* are abuted to each other, by which the movable member 142 is positioned.

By this, the charging roller 108 can receive the charging bias from the main assembly of the apparatus A.

This embodiment also provides the advantageous effects similar to Embodiment 1.

According to this embodiment, the cartridge movable member 142 is disposed outside the passing path of the supporting arm 170*b* with respect to the rotational axis direction of the drum shutter 170. By doing so, there is no need of paying attention to the opening and closing timing of the shutter 170 and the movable member 142 upon mounting and demounting of the cartridge B. In addition, the image forming apparatus can be downsized.

EMBODIMENT 6

Referring to FIG. 44–FIG. 50, the sixth embodiment of the present invention will be described.

The cartridge B and the image forming apparatus 100 have substantially the same structures as with Embodiments 1–5. The same reference numerals as in Embodiments 1 and 2 are assigned to the elements having the corresponding functions in this embodiment, and the detailed description thereof is omitted for simplicity.

Figure 44:
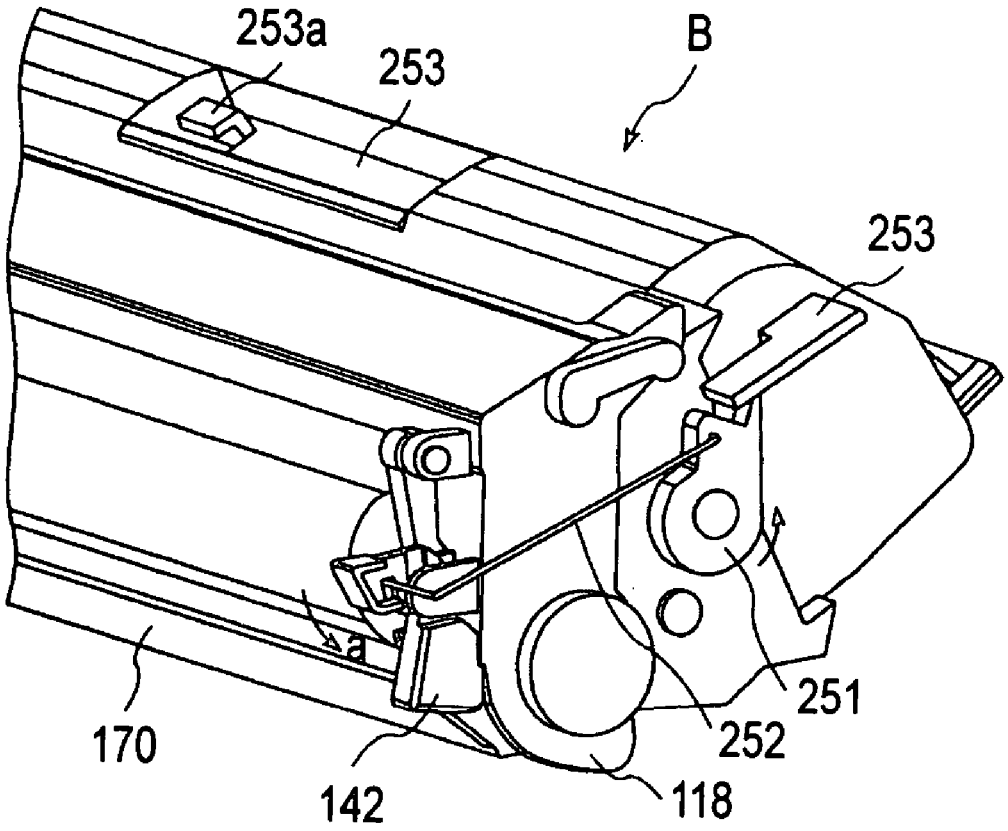
FIG. 44 is a perspective view showing a structure of a movable operation member of a process cartridge according to a further embodiment of the present invention.

(1) Cartridge Movable Member:

FIG. 44 shows a cartridge B according to this embodiment. The electrical contact 141*a* is disposed adjacent a longitudinal end (longitudinal direction of the photosensitive drum 107) at a leading side of the cartridge B with respect to the mounting direction of the cartridge B into the main assembly of the apparatus A. A region adjacent a corner portion of the charging contact member 141 constitutes A electrical contact 141*a* contactable to the contact 144*a*.

Figure 45:
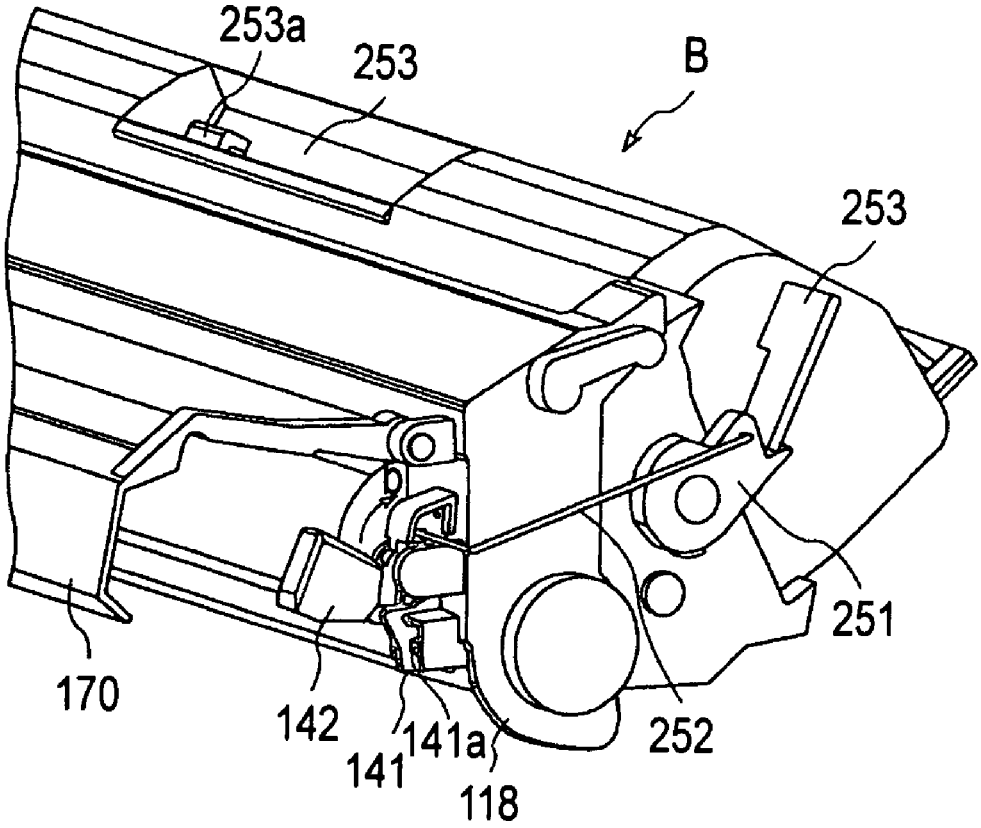
FIG. 45 is a perspective view showing a structure of a movable operation member of a process cartridge according to a further embodiment of the present invention.
Figure 46:
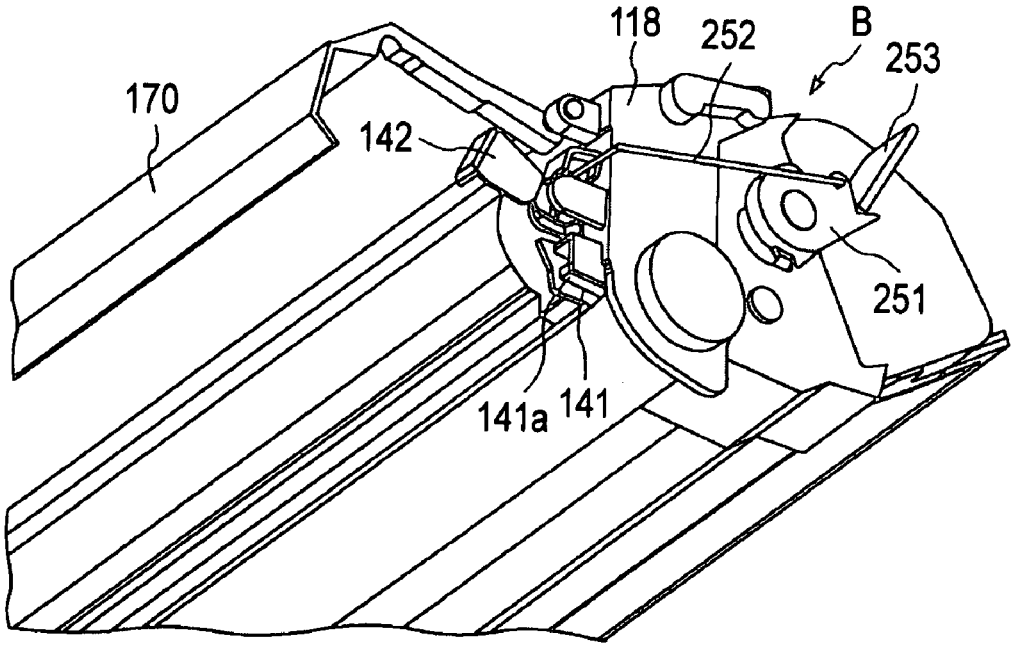
FIG. 46 is a perspective view showing a structure of a movable operation member of a process cartridge according to a further embodiment of the present invention.

As shown in FIG. 44, when the movable member 142 is rotated in the direction of the arrow an and positioned there, the electrical contact 141*a* is covered by the movable member 142. As shown in FIG. 45 and FIG. 46, when the movable member 142 rotates in the direction of the arrow b, the electrical contact 141*a* is exposed. Thus, when the cartridge B is not mounted to the main assembly of the apparatus A, the movable member 142 is in the state shown in FIG. 44, and the electrical contact 141*a* is covered by the cartridge movable member 642. By doing so, the electrical contact 141*a* is protected by the movable member 142.

Figure 47:
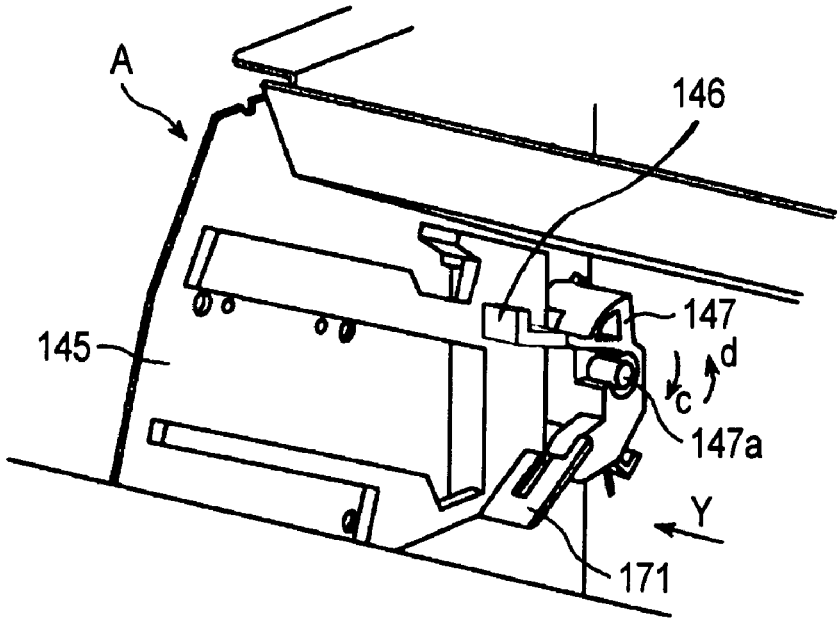
FIG. 47 is a perspective view of a connecting portion and a mounting portion of the main assembly of the apparatus for mounting the process cartridge according to a further embodiment of the present invention.
Figure 48:
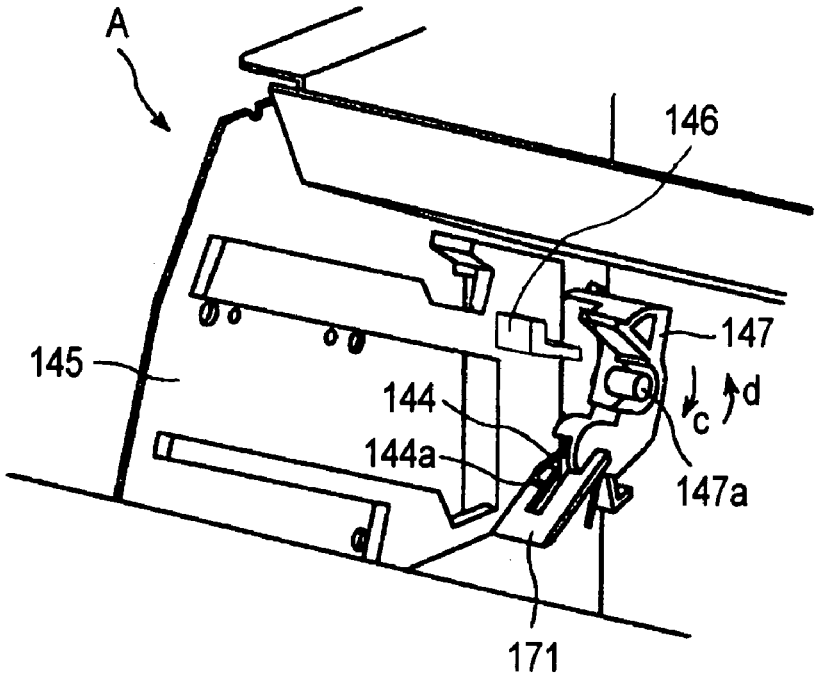
FIG. 48 is a perspective view of a connecting portion and a mounting portion of the main assembly of the apparatus for mounting the process cartridge according to a further embodiment of the present invention.

(2) Charging Contact Provided in Main Assembly of Apparatus A:

Referring to FIG. 47 and FIG. 48, the description will be made as to a main assembly of the apparatus A to which a main assembly of the apparatus A is detachably mountable.

Similarly to Embodiment 5 described in the foregoing, the main assembly of the apparatus A is provided with a main assembly charging contact member 144 (output contact member). The fixed member of the main assembly 146 and the main assembly movable member 147 have the structures similar to those of Embodiment 5.

Similarly to Embodiment 5, the main assembly movable member 147 moves in the directions of arrows c, d in interrelation with manual operation of the operation lever 253 by the user, after the cartridge B is mounted. As shown in FIG. 48, by the user operating the operation lever 253, the main assembly movable member 147 is pushed by the movable member 142. This rotates the movable member 142 in the direction of the arrow c. By this, the contact 144*a* is uncovered and projected to contact to the electrical contact 141*a*. More particularly, the contact 144*a* makes a rotational movement to contact the electrical contact 141*a* which is stationary. Thus, the electrical contacts can be stably connected with each other.

Figure 49:
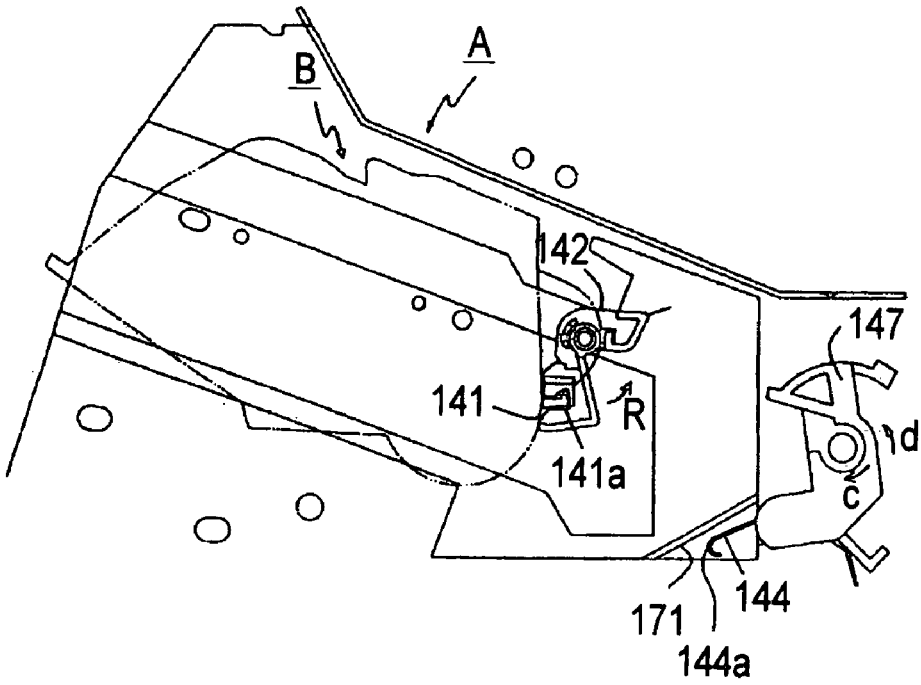
FIG. 49 illustrates structures of the movable operation member and the electrical contact of the image forming apparatus.
Figure 50:
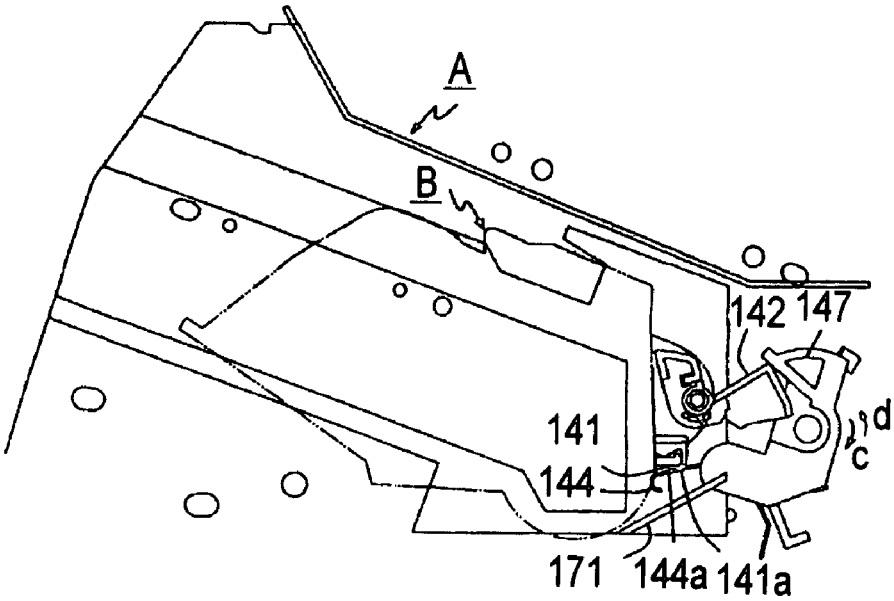
FIG. 50 illustrates structures of the movable operation member and the electrical contact of the image forming apparatus.

(3) Operations of Movable Member and Charging Contact Member:

The description will be made as to the operations of the movable member 142 and the contact member 144. FIG. 49 and FIG. 50 are schematic views showing an operation when the cartridge B is inserted into the main assembly of the apparatus A.

FIG. 49 and FIG. 50 are views of the inner side plate 145 of the main assembly of the apparatus as seen from an inside (as seen in the direction of an arrow Y in FIG. 47), and FIG. 49 shows a state during insertion of the cartridge B into the main assembly of the apparatus A. FIG. 50 shows a state in which after the cartridge B is set in the main assembly of the apparatus A, the user is manipulating the operation lever 253 (operation member).

As shown in the Figure, the movable member 147 and the contact member 144 are positioned and supported by the structures as with Embodiment 5. The contact member 144 is movable between the position where the contact member 144 uncovered and a position where it is not projected out, by the rotation of the movable member 147.

This is similar to Embodiment 5. By the user operating the lever 253 after the cartridge B is mounted to the main assembly of the apparatus A, the movable member 142 rotates in the direction of the arrow R (FIG. 49). By this, the electrical contact 141*a* is exposed. The movable member 142 rotates the movable member 147 in the direction of the arrow c. Then, the contact 144*a* is uncovered.

At this time, the movable member 142 is positioned by abutment between the abutting portion 142*c* and the abutting portion 118*f* by a reaction force from the movable member 147.

In this manner, the main assembly charging contact member 144 is contacted with the electrical contact 141*a*. Then, the application of the charging bias voltage to the charging roller 108 from the main assembly of the apparatus A is enabled.

This embodiment provides the advantageous effects similar to those of embodiment 1–s5.

EMBODIMENT 7

Referring to FIG. 51–FIG. 55, the sixth embodiment of the present invention will be described.

The cartridge B and the image forming apparatus 100 have substantially the same structures as with Embodiment 1. The structure and function of the operation member 142 are similar to those of Embodiment 5 and Embodiment 6. The same reference numerals as with the foregoing embodiments are assigned to the elements having the corresponding functions, and the detailed descriptions for such elements are omitted for simplicity.

The embodiment is a modified example of the cartridge movable member 142 of Embodiment 5 and Embodiment 6. According to this embodiment, the movable member 142 is effective to prevent the operator or user from inadvertently touch the electrical contact 141*a*.

In the examples of this embodiment, the electrical contact 141*a* is projected beyond the surface of the drum frame 118*g* at a position adjacent the longitudinal end at a leading end with respect to the mounting direction X of the process cartridge. The movable member 142 is supported and positioned similarly to Embodiment 5 and Embodiment 6.

Figure 51:
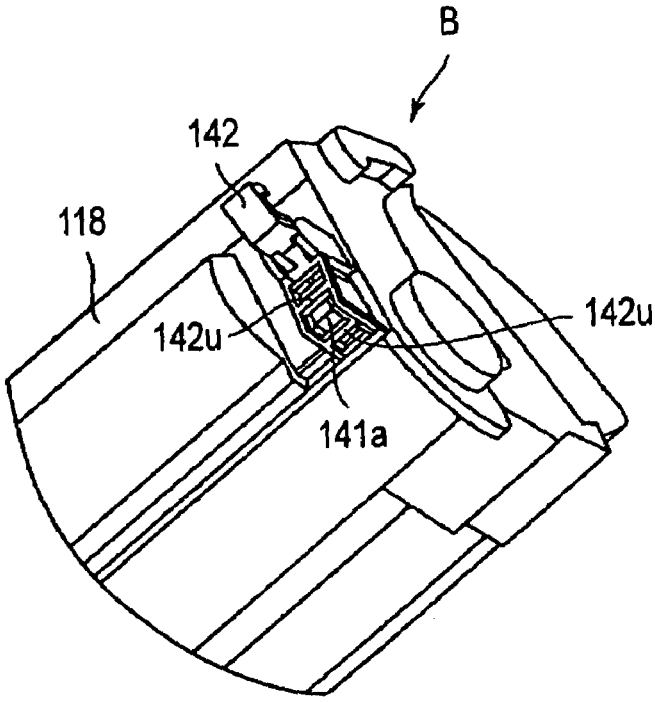
FIG. 51 illustrates a structure of the movable operation member of the process cartridge according to the embodiment of the present invention.

As shown in FIG. 51, the movable member 142 surrounds the electrical contact 141*a* in the stand-by state. In this embodiment, the electrical contact 141*a* is surrounded by a plurality of ribs 142*u*. The rib 142*u* is provided on the movable member 142.

Figure 52:
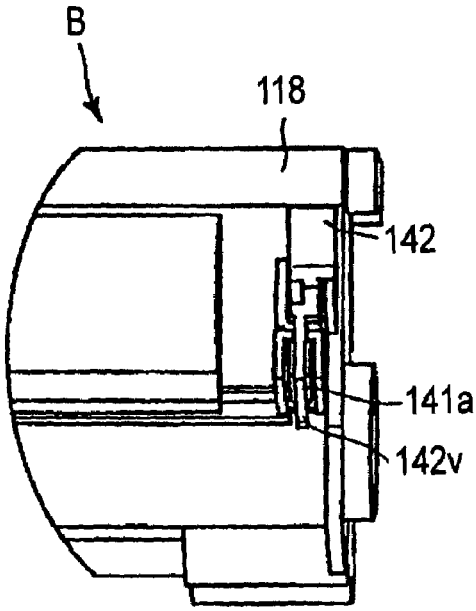
FIG. 52 illustrates a structure of the drum unit in the embodiment of the present invention.

In the example of FIG. 52, a rib 142*v* is provided on the movable member 142 to partly cover the top of the electrical contact 141*a* when the movable member 142 is in the stand-by state.

Figure 53:
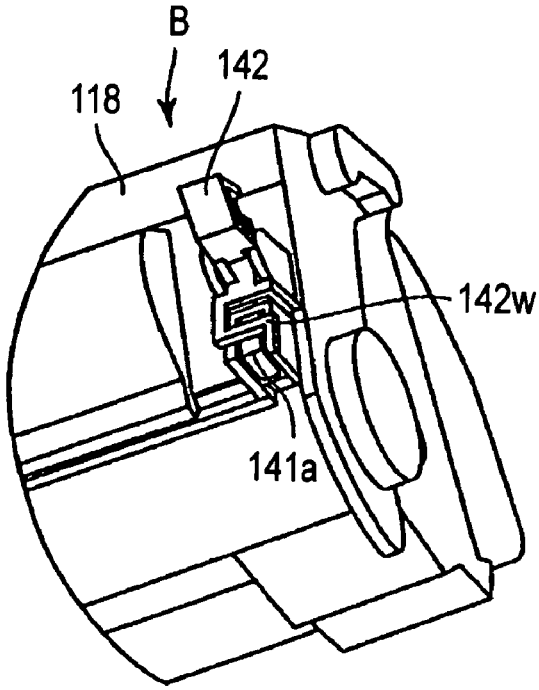
FIG. 53 illustrates a structure of the movable operation member of the process cartridge according to the embodiment of the present invention.
Figure 54:
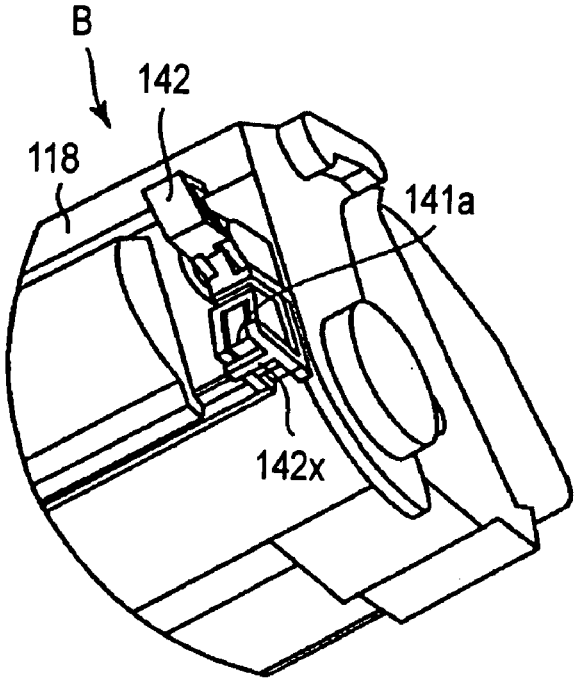
FIG. 54 illustrates a structure of the movable operation member of the process cartridge according to the embodiment of the present invention.
Figure 55:
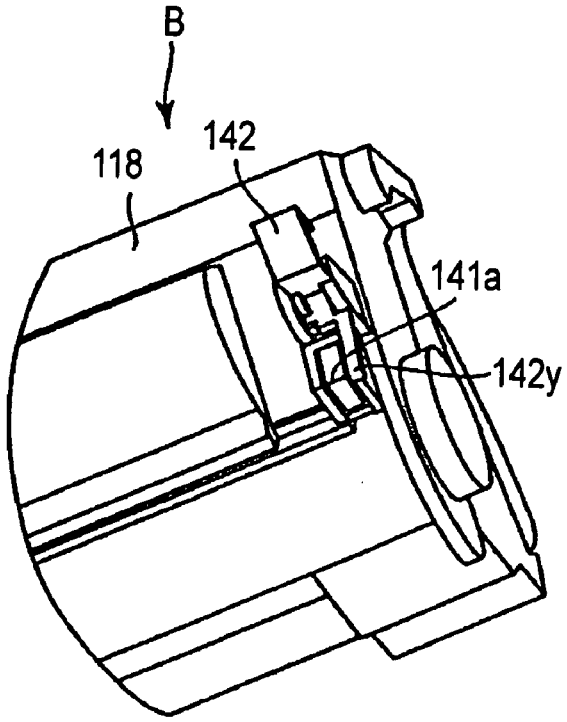
FIG. 55 illustrates a structure of the movable operation member of the process cartridge according to the embodiment of the present invention.

In the examples of FIGS. 53, 54 and 55, projected portions (surfaces) 142*w*, 142*x*, 142*y* are provided on the movable member 142 so that it is higher than the surface of the electrical contact 141*a* when the movable member 142 is in the stand-by state. The projected portions 142*w*, 142*x*, 142*y* are located partly around the electrical contact 141*a*.

In other words, in the examples of FIG. 53, the projected portion 142*w* is provided on the movable member 142 so as to be disposed above the electrical contact 141*a*. In the example of FIG. 54, the projected portion 142*x* is provided on the movable member 142 such that it faces the electrical contact 141*a* in the Figure. In the example of FIG. 55, the projected portion 142*y* is provided the movable member 142 such that it is disposed at a side surface portion of the electrical contact 141*a* in the Figure.

According to this embodiment, similarly to Embodiment 5 and Embodiment 6, the rib 142*u*, the rib 141*v* or projected portions 142*w*, 142*x*, 142*y* are provided so as to provide a surface or surfaces higher than the surface of the electrical contact 141*a*. Therefore, the operator is effectively prevented from touching the electrical contact when the cartridge B is handled. Accordingly, the electrical contact 141*a* can be effectively protected.

This embodiment provides the same advantageous effects as Embodiment 5 and Embodiment 6.

EMBODIMENT 8

Referring to FIG. 56–FIG. 61, the sixth embodiment of the present invention will be described.

The structure and function of the operation member 142 are similar to those of Embodiments 1–7 and Embodiment 6. The same reference numerals as with the Embodiments 1–7 are assigned to the elements having the corresponding functions, and the detailed descriptions for such elements are omitted for simplicity.

This embodiment fundamentally uses the cam member 251 of embodiment 5–Embodiment 7, and the operation thereof is interrelated with an operation of closing the cartridge door (openable member) 109 provided in the main assembly of the apparatus A. Here, the door 109 opens Ad closes relative to the main assembly of the apparatus A. When the cartridge B is to be mounted to or demounted from the main assembly of the apparatus, it is opened. By doing so, the mounting and demounting of the cartridge B is permitted.

Figure 56:
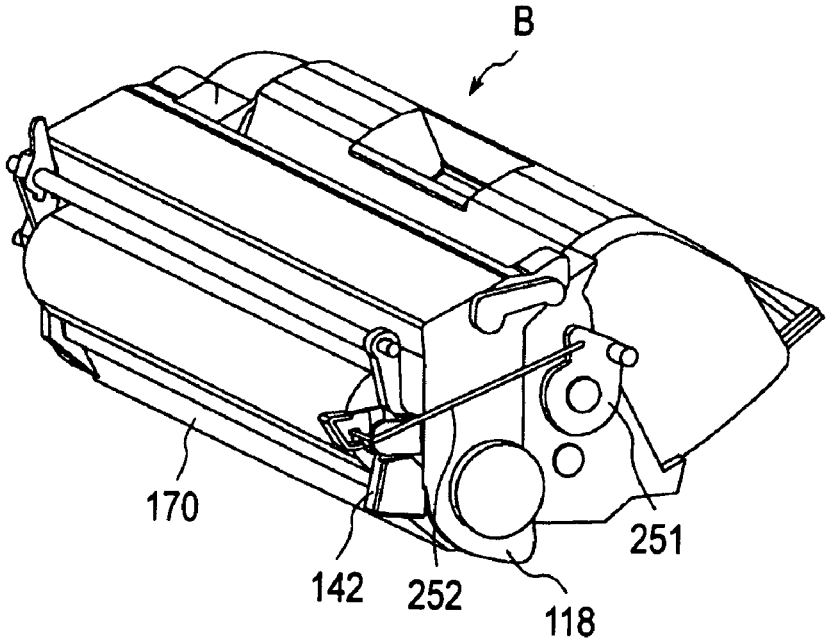
FIG. 56 is a perspective view showing a structure of a movable operation member of a process cartridge according to a further embodiment of the present invention.
Figure 57:
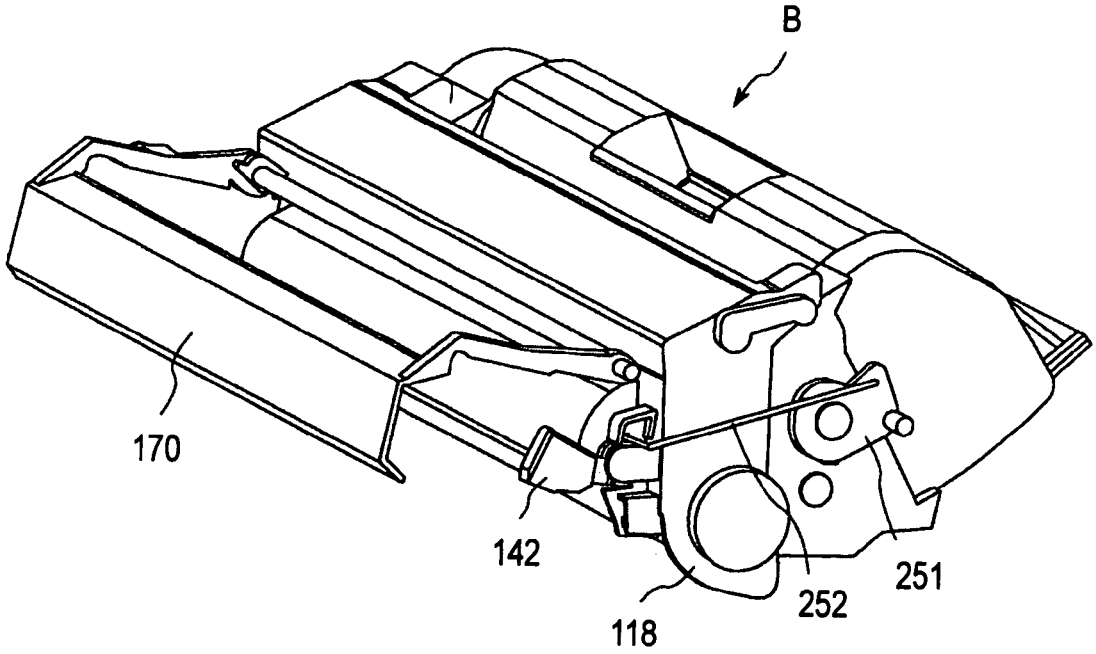
FIG. 57 is a perspective view showing a structure of a movable operation member of a process cartridge according to a further embodiment of the present invention.

Referring to FIG. 56 and FIG. 57, the description will be made as to the structure of the movable member 142 of this embodiment.

As shown in the Figure, the movable member 142 is rotatably mounted to the drum frame 118 at the side surface of the cartridge B. The movable member 142 is similar to that of embodiment 5-Embodiment 7. The movable member 142 is connected with the cam member 251 through a link arm member 252. The supporting structure for the link arm member 252 and cam member 251 is similar to Embodiment 5, and therefore, the detailed description is omitted for simplicity.

Figure 58:
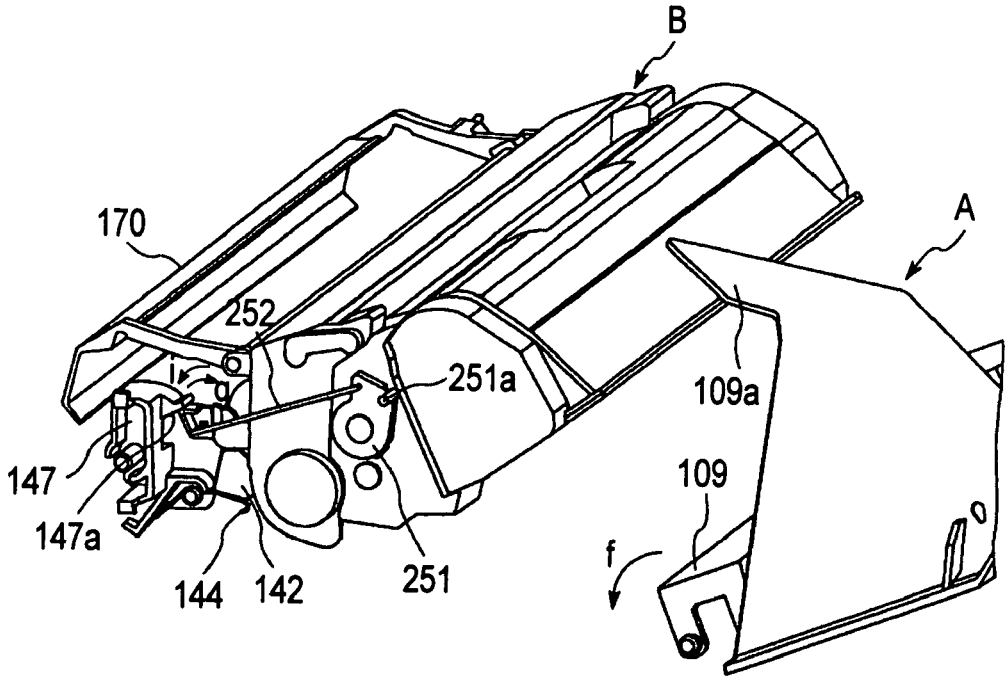
FIG. 58 is a perspective view illustrating a structure of an electrical contact.
Figure 59:
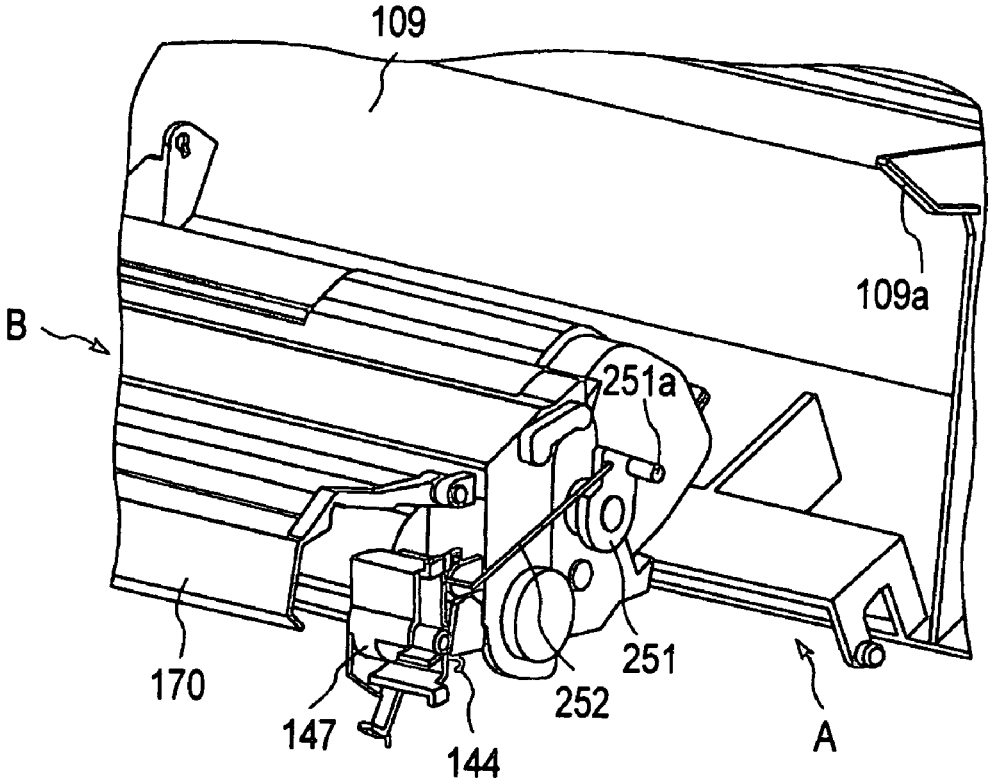
FIG. 59 is a perspective view illustrating a structure of an electrical contact.

FIG. 58 and FIG. 59 show a state in which the cartridge B is inserted in the main assembly of the apparatus A. The structures of the contact member 144, the main assembly movable member 147 for moving it, and so on, are similar those of Embodiments 5–7, and therefore, the detailed description is omitted.

A projection 251*a* is projected from an end of the cam member 251 to rotate the cam member 251 provided on the cartridge B. Inside the door 109, there is provided a rib 109*a* for pushing the cam member 251 provided on the cartridge B.

Figure 60:
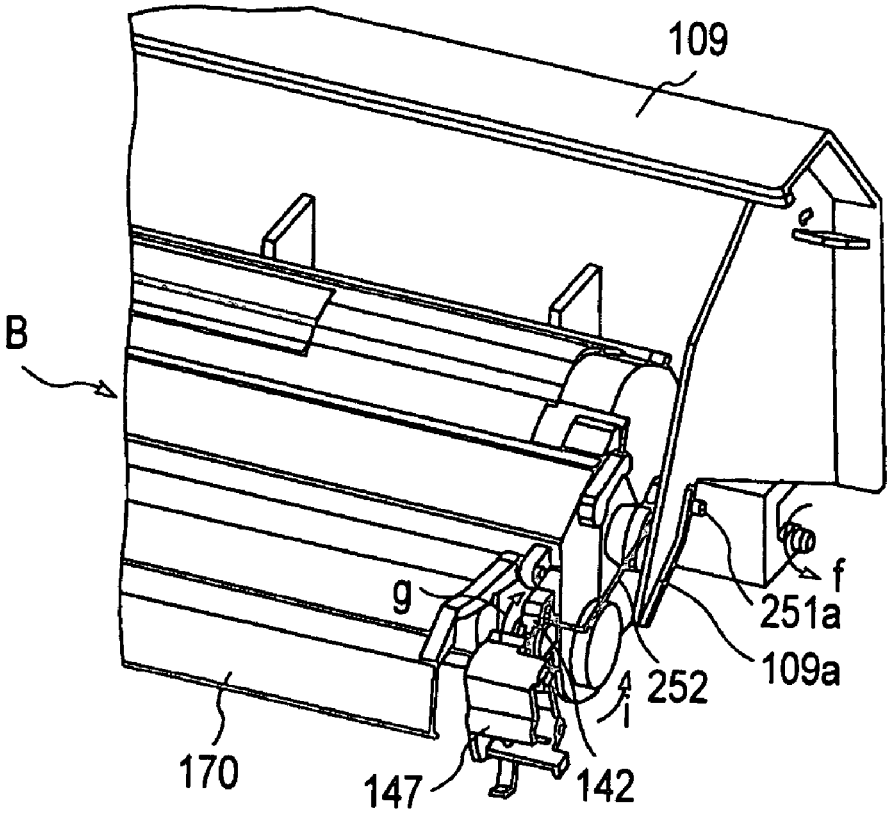
FIG. 60 is a perspective view illustrating a structure of an electrical contact.
Figure 61:
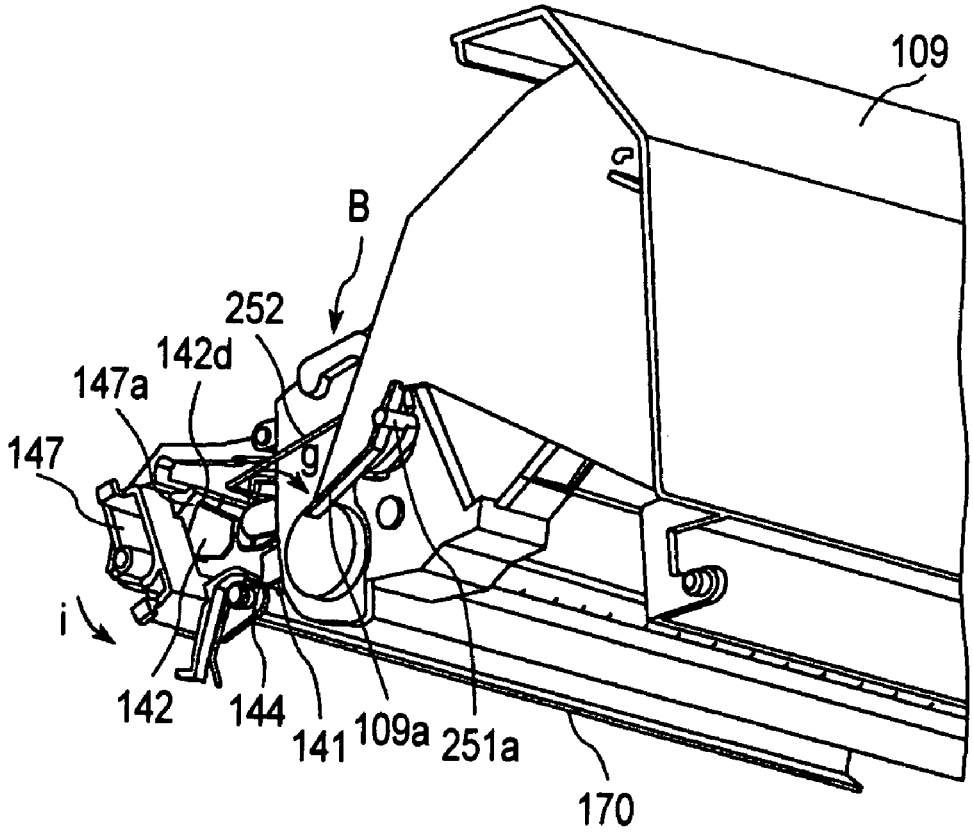
FIG. 61 is a perspective view illustrating a structure of an electrical contact.

As shown in FIG. 60 and FIG. 61, the operator mounts the cartridge B to the main assembly of the apparatus A, and then, the door 109 is closed by movement in the direction of the arrow f. Then, the rib 109*a* pushes A end of the cam member 251. By this, similarly to embodiment 5–Embodiment 7, the movable member 142 is rotated in the direction of an arrow g through the link arm member 252 (operation member). Thus, a free end portion 142*d* of the movable member 142 contacts A inclined surface 147*a* of the main assembly movable member 147. By this, the main assembly movable member 147 is moved. Then, the contact member 144 (electrical contact 144*a*) projects into the main assembly in interrelation with the main assembly movable member 147. In this manner, the electrical contact 144*a* moves to contact the stationary electrical contact 141*a*. Therefore, the application of the charging bias to the charging roller 108 is enabled.

When the cartridge B is removed from the main assembly of the apparatus A, the operator opens the door 109. Then, as described above, the movable member 142 rotates in the direction of the arrow i by the elastic force of the spring 143. And, the movable member 142 returns to the original state wherein the movable member 142 protects the charging bias contact 141*a*.

According to this embodiment, the same advantageous effects as with Embodiments 1–2 and 5–7 can be provided. Furthermore, according to this embodiment, the operation of the link arm member 252 is interrelated with the motion of the door 109. Therefore, the operator is not required to carry out a special manipulation to contact the electrical contacts.

The process cartridge B to which the present invention is applicable is not limited to a process cartridge for formation of the monochromatic image. But it may be a color cartridge for formation of multicolor image is (two-color images, three-color images, full-color images or the like) using a plurality of developing means.

In the above-described, the electrophotographic photosensitive member has been described as photosensitive drum, but the electrophotographic photosensitive member is not limited to such a photosensitive drum, but the following is usable. The photosensitive member may be a photoconductor which may be an amorphous silicon, amorphous selenium, zinc oxide, titanium oxide, organic photoconductor (OPC) or the like. The photosensitive member may be in the form of a drum, a belt or another rotatable member, or a sheet, or the like. The photosensitive member may be in the form of a drum or a belt. In the case of a drum type photosensitive member, a cylinder of aluminum alloy or the like is coated with a photoconductor by evaporation or application or the like.

The present invention is preferably usable with various known developing methods such as the magnetic brush developing method using two component toner, the cascade developing method, the touch-down developing method, the cloud developing method.

The structure of the charging means described in the foregoing is of a so-called contact type charging method, but a known charging means comprising a tungsten wire which is enclosed width metal shield of aluminum or the like at three sides. The positive or negative ions generated by application of a high voltage to said tungsten wire are directed to the surface of the photosensitive drum to uniformly charged the surface, is usable.

The charging means may be a roller type as described in the foregoing, a blade type (charging blade), a pad type, a block type, a rod type, a wire type or the like.

As for a cleaning method for removing toner remaining on the photosensitive drum, a blade, a furbrush, a magnetic brush or the like is usable. In addition, the present invention is applicable to a so-called cleanerless apparatus.

as described in the foregoing, according to the present invention, the establishment of electrical connection is carried out between the output electrical contact of the main assembly of the electrophotographic image forming apparatus Ad the input electrical contact of the process cartridge after the process cartridge is mounted to the main assembly of the apparatus. This improves the reliability of the electrical connection between the electrical contacts.

In addition, the damage of the electric circuit of the main assembly of the image forming apparatus can be effectively prevented.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 411073/2003 and 352402/2004 filed Dec. 9, 2003 and Dec. 6, 2004, which are hereby incorporated by reference.

What is claimed is:

1. A process cartridge detachably mountable to a main assembly of an electrophotographic image forming apparatus, the main assembly including an output contact movable between an electrical connecting position and a retracted position retracted from the electrical connecting position, a displaceable member configured and positioned to move the output contact, and an elastic function member configured and positioned to elastically urge the displaceable member to urge the output contact toward the retracted position away from the electrical connecting position, said process cartridge comprising:

an electrophotographic photosensitive drum;

process means actable on said electrophotographic photosensitive drum;

an operating member;

a movable operation member movable relative to a cartridge frame and operable by said operating member, after said process cartridge is mounted to the main assembly of the apparatus, to be engaged with the displaceable member provided in the main assembly of the electrophotographic image forming apparatus to move the displaceable member, in interrelation with which the output contact is moved from the retracted position to the electrical connecting position against an elastic force of the elastic function member; and an input electrical contact configured and positioned to receive a voltage for enabling said process means by engagement with the output contact moved to the electrical connecting position, wherein said movable operation member has an engaging portion engageable with the displaceable member, and by said operating member being manually operated after said process cartridge is mounted to the main assembly of the apparatus, said movable operation member is rotated in a clockwise direction, as seen in a longitudinal direction of said electrophotographic photosensitive drum from an outside of a side where said movable operation member is provided, to engage said engaging portion with the displaceable member.

2. A process cartridge according to claim 1, wherein by said operating member being operated after said process cartridge is mounted to the main assembly of the apparatus, said movable operation member is rotated about an axis of a shaft to retract from a position covering said input electrical contact and to expose said input electrical contact, thus permitting electrical connection between said input electrical contact and the output contact.

3. A process cartridge according to claim 2, wherein the shaft extends coaxially with said electrophotographic photosensitive drum, and said movable operation member is disposed at a longitudinal end of the cartridge frame.

4. A process cartridge according to claim 1, further comprising an elastic function member configured and positioned to apply an elastic force to said movable operation member to be urged to a position covering said input electrical contact.

5. A process cartridge according to claim 1, wherein said movable operation member is disposed outside a path of a supporting arm for a drum shutter configured and positioned to cover said electrophotographic photosensitive drum, wherein said movable operation member is provided on said process cartridge at a leading side of the cartridge frame with respect to a mounting direction in which said process cartridge is mounted to the main assembly of the image forming apparatus.

6. A process cartridge according to claim 2, wherein said process means includes a charging member configured and positioned to electrically charge said electrophotographic photosensitive drum, and wherein said input electrical contact receives from the output contact a voltage for charging said electrophotographic photosensitive drum.

7. A process cartridge according to claim 2, wherein said process means includes a developing member configured and positioned to develop an electrostatic latent image formed on said electrophotographic photosensitive drum, and said input electrical contact receives from the output contact a voltage for developing the electrostatic latent image.

8. An electrophotographic image forming apparatus for forming an image on a recording material, to which a process cartridge is detachably mountable, said apparatus comprising:

(i) an output contact movable between an electrical connecting position and a retracted position retracted from the electrical connecting position, (ii) a main assembly displaceable member configured and positioned to move said output contact and provided in a main assembly of said electrophotographic image forming apparatus, (iii) an elastic function member configured and positioned to elastically urge said main assembly displaceable member so as to move said output contact from the electrical connecting position to the retracted position; and (iv) a cartridge mounting portion configured and positioned to detachably mount the process cartridge, the process cartridge including an electrophotographic photosensitive drum, process means actable on the electrophotographic photosensitive drum, an operating member, a movable operation member movable relative to a cartridge frame and operable by the operating member, after the process cartridge is mounted to said cartridge mounting portion, to be engaged with said main assembly displaceable member to move said main assembly displaceable member, in interrelation with which said output contact is moved from the retracted position to the electrical connecting position against an elastic force of said elastic function member, and an input electrical contact configured and positioned to receive a voltage for enabling the process means by engagement with said output contact moved to the electrical connecting position, wherein the movable operation member has an engaging portion engageable with said main assembly displaceable member, and by the operating member being manually operated after the process cartridge is mounted to the main assembly of said apparatus, the movable operation member is rotated in a clockwise direction, as seen in a longitudinal direction of the electrophotographic photosensitive drum from an outside of a side where the movable operation member is provided, to engage the engaging portion with said main assembly displaceable member.

9. An electrophotographic image forming apparatus for forming an image on a recording material, to which a process cartridge is detachably mountable, said apparatus comprising:

(i) a voltage source;

(ii) a voltage source circuit connected with said voltage source;

(iii) a fixed member fixed in said electrophotographic image forming apparatus;

(iv) an output contact movable between an electrical connecting position and a retracted position which is retracted from the electrical connecting position, said output contact electrically connected with said voltage source through said voltage source circuit; and (v) a displaceable member provided in a main assembly of said electrophotographic image forming apparatus, having a displaceable engaging portion, configured and positioned to move said output contact, wherein said displaceable member is disposed downstream of said fixed member with respect to a mounting direction in which process cartridge is mounted to the main assembly of said electrophotographic image forming apparatus, and at least a part of said displaceable engaging portion is overlapped with said fixed member with respect to the mounting direction;

(vi) an elastic function member configured and positioned to elastically urge said displaceable member to move said output contact from the electrical connecting position to the retracted position; and (vii) a cartridge mounting portion configured and positioned to detachably mount the process cartridge, wherein the retracted position of said output contact is outside said cartridge mounting portion, the process cartridge including an electrophotographic photosensitive drum, process means actable on the electrophotographic photosensitive drum, an operating member, a movable operation member movable relative to a cartridge frame and operable by the operating member, after the process cartridge is passed by said fixed member and mounted to the main assembly of said apparatus, to be engaged with said displaceable member to move said displaceable member, in interrelation with which said output contact is moved from the retracted position to the electrical connecting position against an elastic force of said elastic function member, and an input electrical contact configured and positioned to receive a voltage for enabling the process means by engagement with said output contact moved to the electrical connecting position, wherein the movable operation member has an engaging portion engageable with said displaceable member, and by the operating member being manually operated after the process cartridge is mounted to the main assembly of said apparatus, the movable operation member is rotated in a clockwise direction, as seen in a longitudinal direction of the electrophotographic photosensitive drum from an outside of a side where the movable operation member is provided, to engage the engaging portion with said displaceable member.

10. An apparatus according to claim 8 or 9, wherein the process cartridge further comprises a driving force receiving portion configured and positioned to receive a driving force from the main assembly of said image forming apparatus when the process cartridge is mounted to the main assembly of said image forming apparatus, the driving force receiving portion being disposed at one end of the process cartridge with respect to a longitudinal direction of the electrophotographic photosensitive drum, and the movable operation member being disposed at the other end of the process cartridge with respect to the longitudinal direction.

11. An apparatus according to claim 8 or 9, wherein by the operating member being operated after the process cartridge is mounted to the main assembly of said apparatus, the movable operation member is rotated about an axis of a shaft to retract from a position covering the input electrical contact and expose the input electrical contact, thus permitting electrical connection between the input electrical contact and said output contact.

12. An apparatus according to claim 8 or 9, wherein the movable operation member includes an elastic function member configured and positioned to apply an elastic force to the movable operation member to be urged to a position covering the input electrical contact.

13. An apparatus according to claim 8 or 9, wherein the operating member is directly manually operable after the process cartridge is mounted to the main assembly of said electrophotographic image forming apparatus, or the operating member is operable by manually opening an openable member of the main assembly of said apparatus.

14. An apparatus according to claim 8 or 9, wherein the process means includes a charging member configured and positioned to electrically charge the electrophotographic photosensitive drum, and the input electrical contact receives from said output contact a voltage for charging the electrophotographic photosensitive drum.

15. An apparatus according to claim 8 or 9, wherein the process means includes a developing member configured and positioned to develop an electrostatic latent image formed on the electrophotographic photosensitive drum, and the input electrical contact receives from said output contact a voltage for developing the electrostatic latent image.

16. A process cartridge detachably mountable to a main assembly of an electrophotographic image forming apparatus, the main assembly including an output contact movable between an electrical connecting position and a retracted position retracted from the electrical connecting position, a displaceable member provided in the main assembly of the electrophotographic image forming apparatus and configured and positioned to move the output contact, and an elastic function member configured and positioned to elastically urge the displaceable member to urge the output contact toward the retracted position away from the electrical connecting position, said process cartridge comprising:

an electrophotographic photosensitive drum;

process means actable on said electrophotographic photosensitive drum;

an operating member;

a movable operation member movable relative to a cartridge frame and operable by said operating member, after said process cartridge is mounted to the main assembly of the apparatus, to be engaged with the displaceable member to move the displaceable member, in interrelation with which the output contact is moved from the retracted position to the electrical connecting position against an elastic force of the elastic function member;

an input electrical contact configured and positioned to receive a voltage for enabling said process means by engagement with the output contact moved to the electrical connecting position; and a driving force receiving portion configured and positioned to receive a driving force from the main assembly of the image forming apparatus when said process cartridge is mounted to the main assembly of the image forming apparatus, said driving force receiving portion being disposed at one end of said process cartridge with respect to a longitudinal direction of said electrophotographic photosensitive drum, and said movable operation member being disposed at the other end of said process cartridge with respect to the longitudinal direction, wherein said movable operation member has an engaging portion engageable with the displaceable member, and by said operating member being manually operated after said process cartridge is mounted to the main assembly of the apparatus, said movable operation member is rotated in a clockwise direction, as seen in a longitudinal direction of said electrophotographic photosensitive drum from an outside of a side where said movable operation member is provided, to engage said engaging portion with the displaceable member.

17. A process cartridge according to claim 16, wherein by said operating member being operated after said process cartridge is mounted to the main assembly of the apparatus, said movable operation member is rotated about an axis of a shaft to retract from a position covering said input electrical contact and to expose said input electrical contact, thus permitting electrical connection between said input electrical contact and the output contact.

18. A process cartridge according to claim 17, wherein the shaft extends coaxially with said electrophotographic photosensitive drum, and said movable operation member is disposed at a longitudinal end of the cartridge frame.

19. A process cartridge according to claim 16, further comprising an elastic function member configured and positioned to apply an elastic force to said movable operation member to be urged to a position covering said input electrical contact.

20. A process cartridge according to claim 16 or 17, wherein said movable operation member is disposed outside a path of a supporting arm for a drum shutter configured and positioned to cover said electrophotographic photosensitive drum, and wherein said movable operation member is provided on said process cartridge at a leading side of the cartridge frame with respect to a mounting direction in which said process cartridge is mounted to the main assembly of the image forming apparatus.

21. A process cartridge according to claim 17, wherein said process means includes a charging member configured and positioned to electrically charge said electrophotographic photosensitive drum, and said input electrical contact receives from the output contact a voltage for charging said electrophotographic photosensitive drum.

22. A process cartridge according to claim 17, wherein said process means includes a developing member configured and positioned to develop an electrostatic latent image formed on said electrophotographic photosensitive drum, and said input electrical contact receives from the output contact a voltage for developing the electrostatic latent image.

23. An electrophotographic image forming apparatus for forming an image on a recording material, to which a process cartridge is detachably mountable, said apparatus comprising:

(i) an output contact movable between an electrical connecting position and a retracted position retracted from the electrical connecting position;

(ii) a main assembly displaceable member provided in a main assembly of said electrophotographic image forming apparatus and configured and positioned to move said output contact;

(iii) an elastic function member configured and positioned to elastically urge said main assembly displaceable member so as to move said output contact from the electrical connecting position to the retracted position; and (iv) a cartridge mounting portion configured and positioned to detachably mount the process cartridge, the process cartridge including an electrophotographic photosensitive drum, process means actable on the electrophotographic photosensitive drum, an operating member, a movable operation member movable relative to a cartridge frame and operable by the operating member, after the process cartridge is mounted to the main assembly of said apparatus, to be engaged with said main assembly displaceable member to move said main assembly displaceable member, in interrelation with which said output contact is moved from the retracted position to the electrical connecting position against an elastic force of said elastic function member, an input electrical contact configured and positioned to receive a voltage for enabling the process means by engagement with said output contact moved to the electrical connecting position, and a driving force receiving portion configured and positioned to receive a driving force from the main assembly of said image forming apparatus when the process cartridge is mounted to the main assembly of said image forming apparatus, the driving force receiving portion being disposed at one end of the process cartridge with respect to a longitudinal direction of the electrophotographic photosensitive drum, and the movable operation member being disposed at the other end of the process cartridge with respect to the longitudinal direction, wherein the movable operation member has an engaging portion engageable with said main assembly displaceable member, and by the operating member being manually operated after the process cartridge is mounted to the main assembly of said apparatus, the movable operation member is rotated in a clockwise direction, as seen in a longitudinal direction of the electrophotographic photosensitive drum from an outside of a side where the movable operation member is provided, to engage the engaging portion with said main assembly displaceable member.

* * * * *

UNITED STATES PATENT AND TRADEMARK OFFICE

CERTIFICATE OF CORRECTION

PATENT NO. : 7,085,509 B2
APPLICATION NO. : 11/007488
DATED : August 1, 2006
INVENTOR(S) : Takeshi Kubota et al.

It is certified that error appears in the above-identified patent and that said Letters Patent is hereby corrected as shown below:

COLUMN 1:
Line 12, “A” should read --an--.
Line 15, “A” should read --an--.
Line 57, “Ad” should read --and--.

COLUMN 2:
Line 23, “portion” should read --member--.
Line 38, “Aother” should read --another--.
Line 51, “Ad” should read --and--.

COLUMN 5:
Line 61, “A” should read --an--.

COLUMN 6:
Line 4, “Ad” should read --and--.
Line 12, “A” should read --an--.
Line 13, “A” should read --an--.
Line 13, “A” should read --an--.
Line 20, “A” should read --an--.
Line 27, “A” should read --an--.
Line 28, “A” should read --an--
Line 46, “image” should read --image is--.
Line 51, “A” should read --an--.
Line 52, “A” should read --an--.

COLUMN 7:
Line 19, “A” should read --an--.
Line 21, “A” should read --an--.
Line 48, “press” should read --pressed--.
Line 56, “A” should read --an--.
Line 63, “Ad” should read --and--.

COLUMN 9:
Line 33, “projects” should read --project--.

UNITED STATES PATENT AND TRADEMARK OFFICE

CERTIFICATE OF CORRECTION

PATENT NO. : 7,085,509 B2
APPLICATION NO. : 11/007488
DATED : August 1, 2006
INVENTOR(S) : Takeshi Kubota et al.

It is certified that error appears in the above-identified patent and that said Letters Patent is hereby corrected as shown below:

COLUMN 10:
Line 8, “the” should read --of the--.
Line 26, “manipulate” should read --manipulates--.
Line 29, “couterclockwise” should read --counterclockwise--, and “t” should read --the--.
Line 39, “couterclockwise” should read --counterclockwise--.

COLUMN 11:
Line 44, “Ad” should read --and--.

COLUMN 12:
Line 13, “form” should read --from--, and “side side” should read --side--.
Line 18, “from” should read --from being--.
Line 42, “A” should read --an--.
Line 55, “projection” should read --project--.

COLUMN 13:
Line 4, “A” should read --an--.

COLUMN 14:
Line 25, “generate” should read --generates--.
Line 55, “the” (2nd occurrence) should read --then--.
Line 59, “A” should read --an--.
Line 60, “(3) thus,” should read --(3) Thus,--.

COLUMN 15:
Line 46, “A is” should read --A are--.

COLUMN 16:
Line 8, “Ad” should read --and--.

COLUMN 17:
Line 14, “protected” should read --protected by--.
Line 42, “operation” should read --operation of--.
Line 44, “view” should read --views--.
Line 52, “behavier” should read --behavior--.

UNITED STATES PATENT AND TRADEMARK OFFICE

CERTIFICATE OF CORRECTION

PATENT NO. : 7,085,509 B2
APPLICATION NO. : 11/007488
DATED : August 1, 2006
INVENTOR(S) : Takeshi Kubota et al.

It is certified that error appears in the above-identified patent and that said Letters Patent is hereby corrected as shown below:

COLUMN 18:
Line 3, “operate” should read --operates--.
Line 15, “Ad” should read --and--.
Line 51, “contacts” should read --contact--.
Line 59, “the,” should read --the--.

COLUMN 19:
Line 20, “Ad” should read --and--.
Line 21, “Ad” should read --and--, and “is” should read --are--.
Line 23, “if” should read --is--.
Line 38, “manipulate th” should read --manipulates the--.
Line 63, “is” should read --are--.

COLUMN 20:
Line 11, “Ad” should read --and--.
Line 25, “couterclockwise” should read --counterclockwise--.
Line 40, “enable” should read --enables--.

COLUMN 21:
Line 2, “Ad” should read --and--.
Line 11, “closes” should read --closing--.
Line 13, “manipulate” should read --manipulates--.
Line 28, “the” (first occurrence) should read --of the--.
Line 53, “A” should read --an--.
Line 65, “Ad” should read --and--.

COLUMN 22:
Line 15, “abuted” should read --abutted--.
Line 23, “provision” should read --provided--.
Line 26, “connection” should read --connected--.
Line 50, “actuate” should read --actuates--.

COLUMN 23:
Line 7, “manipulate” should read --manipulates--.
Line 13, “contacted” should read --contacted to--.
Line 37, “A” should read --an--.
Line 53, “abuted” should read --abutted--.
Line 59, “operate” should read --operates--.

UNITED STATES PATENT AND TRADEMARK OFFICE

CERTIFICATE OF CORRECTION

PATENT NO. : 7,085,509 B2
APPLICATION NO. : 11/007488
DATED : August 1, 2006
INVENTOR(S) : Takeshi Kubota et al.

It is certified that error appears in the above-identified patent and that said Letters Patent is hereby corrected as shown below:

COLUMN 24:
Line 2, “the” (2nd occurrence) should read --and the--.
Line 3, “abuted” should read --abutted--.
Line 36, “A” should read --an--.

COLUMN 25:
Line 26, “uncovered” should read --is uncovered--.
Line 45, “embodiment 1-s5.” should read --embodiments 1-5.--.
Line 64, “touch” should read --touching--.

COLUMN 26:
Line 52, “Ad” should read --and--.

COLUMN 27:
Line 18, “A” should read --an--.
Line 23, “A” should read --an--.
Line 48, “image is” should read --images--.

COLUMN 28:
Line 11, “charged” should read --charge--.
Line 19, “as” should read --As--.
Line 23, “Ad” should read --and--.

COLUMN 29:
Line 58, “position,” should read --position;--.
Line 62, “apparatus,” should read --apparatus;--.

UNITED STATES PATENT AND TRADEMARK OFFICE

CERTIFICATE OF CORRECTION

PATENT NO. : 7,085,509 B2
APPLICATION NO. : 11/007488
DATED : August 1, 2006
INVENTOR(S) : Takeshi Kubota et al.

It is certified that error appears in the above-identified patent and that said Letters Patent is hereby corrected as shown below:

COLUMN 30:
Line 43, "circuit; and" should read --circuit--.
Line 50, "process" should read --the process--.

Signed and Sealed this

Eighth Day of April, 2008

JON W. DUDAS
*Director of the United States Patent and Trademark Office*